US012644171B2

(12) United States Patent
Ito et al.

(10) Patent No.: US 12,644,171 B2
(45) Date of Patent: Jun. 2, 2026

(54) HOT STAMPED BODY

(71) Applicant: NIPPON STEEL CORPORATION, Tokyo (JP)

(72) Inventors: Kazuma Ito, Tokyo (JP); Shinichiro Tabata, Tokyo (JP); Yuri Toda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 43 days.

(21) Appl. No.: 18/719,744

(22) PCT Filed: Mar. 2, 2023

(86) PCT No.: PCT/JP2023/007829

§ 371 (c)(1),
(2) Date: Jun. 13, 2024

(87) PCT Pub. No.: WO2023/189174

PCT Pub. Date: Oct. 5, 2023

(65) Prior Publication Data

US 2025/0043406 A1 Feb. 6, 2025

(30) Foreign Application Priority Data

Mar. 31, 2022 (JP) ..... 2022-060691

(51) Int. Cl.

| | |
|---|---|
| ***C22C 38/60*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/30*** | (2006.01) |
| ***C22C 38/32*** | (2006.01) |
| ***C22C 38/34*** | (2006.01) |
| ***C22C 38/44*** | (2006.01) |
| ***C22C 38/48*** | (2006.01) |
| ***C22C 38/50*** | (2006.01) |
| ***C22C 38/54*** | (2006.01) |

(52) U.S. Cl.

CPC ..... *C22C 38/60* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/30* (2013.01); *C22C 38/32* (2013.01); *C22C 38/34* (2013.01); *C22C 38/44* (2013.01); *C22C 38/48* (2013.01); *C22C 38/50* (2013.01); *C22C 38/54* (2013.01)

(58) Field of Classification Search

None

See application file for complete search history.

(56) References Cited

U.S. PATENT DOCUMENTS

| | | | | |
|---|---|---|---|---|
| 11,180,824 | B2 * | 11/2021 | Toda | C22C 38/32 |
| 11,453,935 | B2 * | 9/2022 | Toda | C22C 38/12 |
| 2019/0055617 | A1 * | 2/2019 | Okatsu | C22C 38/001 |
| 2021/0102270 | A1 * | 4/2021 | Toda | C21D 8/0205 |
| 2022/0119929 | A1 | 4/2022 | Fujinaka et al. | |
| 2022/0177992 | A1 * | 6/2022 | Obata | C21D 8/0478 |
| 2022/0186339 | A1 * | 6/2022 | Takashima | C21D 8/0426 |

FOREIGN PATENT DOCUMENTS

| | | | |
|---|---|---|---|
| EP | 4 339 307 | A1 | 3/2024 |
| WO | WO 2020/189767 | A1 | 9/2020 |
| WO | WO 2022/239866 | A1 | 11/2022 |

* cited by examiner

*Primary Examiner* — Xiaobei Wang

(74) *Attorney, Agent, or Firm* — Birch, Stewart, Kolasch & Birch, LLP

(57) ABSTRACT

Provided is a hot stamped body having a chemical composition comprising, by mass %, C: 0.40 to 0.70%, P: 0.100% or less, S: 0.0100% or less, N: 0.0200% or less, O: 0.0200% or less, Al: 0.0010 to 0.500%, Nb: 0.0010 to 0.100%, Ti: 0.010 to 0.200%, Mo: 0.010 to 2.000%, B: 0.0005 to 0.0200%, etc., and balance of Fe and impurities, and a microstructure with a total amount of segregation of at least one of Mo, W, Ta, Re, Os, Ir, and Tc at prior austenite grain boundaries of 0.10 atm % or more.

17 Claims, No Drawings

HOT STAMPED BODY

FIELD

The present invention relates to a hot stamped body.

BACKGROUND

In recent years, in the automobile industry, lighter weight of car bodies has been sought from the viewpoint of improvement of fuel economy. To achieve both lighter weight of car bodies and collision safety, one effective method is to increase the strength of the steel sheet used. A high strength steel sheet is being developed due to such a background.

If making a steel sheet high in strength, the formability falls, and therefore it is generally difficult to achieve both strength and formability in the steel sheet. Hot stamping (hot pressing) is known as a technique for press-forming a material, which is difficult to form, such as a high strength steel sheet. Hot stamping is a technique of hot forming which heats then forms a material to be formed. This technique heats then forms the material, and therefore at the time of forming, the steel material is soft and has good formability. Therefore, even a high strength steel material can be formed into a complex shape with a good precision. Further, it is hardened at the same time as being formed by the press dies, and therefore a formed steel material is known to have sufficient strength.

In relation to this, PTL 1 describes a hot stamped body having a predetermined chemical composition, an average size of prior austenite grains in the microstructure of 5.0 m or less, and an average Mn concentration at the grain boundaries of the prior austenite grains of 1.0 mass % or less. Further, PTL 1 describes that according to above constitution, it is possible to provide a hot stamped body having a tensile strength of 2000 MPa or more and an excellent toughness.

CITATIONS LIST

Patent Literature

[PTL 1] WO 2020/189767

SUMMARY

Technical Problem

In a hot stamped body having such a high strength described in PTL 1, sometimes hydrogen embrittlement cracking (also referred to as "delayed fracture", etc.) becomes a problem. "Hydrogen embrittlement cracking" is the phenomenon where a steel member which is acted on by a high stress under conditions of use suddenly fractures due to hydrogen penetrating the steel from the environment. In general, it is known that hydrogen embrittlement cracking occurs more easily the higher the strength of the steel material. On the other hand, in the automobile industry, etc., further reduction of weight of the steel material is sought. To achieve such lighter weight, a need arises to raise the strength more than the past. Therefore, there is a great need for a steel material, more specifically a hot stamped body, able to solve the problem of hydrogen embrittlement even if raising the strength equal to the past or more than the same.

Therefore, the present invention has as its object to provide a hot stamped body which is high in strength and able to suppress hydrogen embrittlement by a novel constitution.

Solution to Problem

The inventors discovered that, to achieve the above object, it is possible to reduce the content of Mn and make specific elements segregate at the grain boundaries to reinforce the grain boundaries and discovered that, as a result, it is possible to remarkably improve the hydrogen embrittlement resistance regardless of the hot stamped body having a high tensile strength and thereby completed the present invention.

The present invention able to achieve this object is as follows:

(1) A hot stamped body having a chemical composition comprising, by mass %,
C: 0.40 to 0.70%,
P: 0.100% or less,
S: 0.0100% or less,
N: 0.0200% or less,
O: 0.0200% or less,
Al: 0.0010 to 0.500%,
Nb: 0.0010 to 0.100%,
Ti: 0.010 to 0.200%,
Mo: 0.010 to 2.000%,
B: 0.0005 to 0.0200%,
Si: 0 to 3.00%,
Mn: 0 to less than 0.50%,
Cr: 0 to 1.00%,
Co: 0 to 4.00%,
Ni: 0 to 3.00%,
Cu: 0 to 3.00%,
V: 0 to 3.00%,
Ca: 0 to 1.000%,
Mg: 0 to 1.000%,
REM: 0 to 1.000%,
Sb: 0 to 1.00%,
Zr: 0 to 1.00%,
Sn: 0 to 1.00%,
As: 0 to 0.100%,
W: 0 to 3.000%,
at least one of Ta, Re, Os, Ir, and Tc: 0 to 1.00% in total,
Se: 0 to 1.00%,
Bi: 0 to 1.00%, and
balance: Fe and impurities, and
a microstructure with a total amount of segregation of at least one of Mo, W, Ta, Re, Os, Ir, and Tc at prior austenite grain boundaries of 0.10 atm % or more.

(2) The hot stamped body according to the above (1), comprising, by area ratio, at least one of martensite, bainite, and tempered martensite: 70% or more in total.

(3) The hot stamped body according to the above (1) or (2), wherein the amount of segregation of Mo at the prior austenite grain boundaries is 0.10 atm % or more.

(4) The hot stamped body according to the above (1) or (2), wherein the amount of segregation of W at the prior austenite grain boundaries is 0.10 atm % or more.

(5) The hot stamped body according to any one of the above (1) to (4), wherein the total amount of segregation is 0.15 atm % or more.

(6) The hot stamped body according to any one of the above (1) to (5), having a covering on the surface.

(7) The hot stamped body according to the above (6), wherein the covering is mainly comprised of an Fe—Al-based alloy.

(8) The hot stamped body according to the above (6), wherein the covering is mainly comprised of an Fe—Zn-based alloy.

Advantageous Effects of Invention

According to the present invention, it is possible to provide a hot stamped body which is high in strength and able to suppress hydrogen embrittlement.

DESCRIPTION OF EMBODIMENTS

<Hot Stamped Body>

The hot stamped body according to an embodiment of the present invention has a chemical composition comprising, by mass %, C: 0.40 to 0.70%,
P: 0.100% or less,
S: 0.0100% or less,
N: 0.0200% or less,
O: 0.0200% or less,
Al: 0.0010 to 0.500%,
Nb: 0.0010 to 0.100%,
Ti: 0.010 to 0.200%,
Mo: 0.010 to 2.000%,
B: 0.0005 to 0.0200%,
Si: 0 to 3.00%,
Mn: 0 to less than 0.50%,
Cr: 0 to 1.00%,
Co: 0 to 4.00%,
Ni: 0 to 3.00%,
Cu: 0 to 3.00%,
V: 0 to 3.00%,
Ca: 0 to 1.000%,
Mg: 0 to 1.000%,
REM: 0 to 1.000%,
Sb: 0 to 1.00%,
Zr: 0 to 1.00%,
Sn: 0 to 1.00%,
As: 0 to 0.100%,
W: 0 to 3.000%,
at least one of Ta, Re, Os, Ir, and Tc: 0 to 1.00% in total,
Se: 0 to 1.00%,
Bi: 0 to 1.00%, and
balance: Fe and impurities, and
a microstructure with a total amount of segregation of at least one of Mo, W, Ta, Re, Os, Ir, and Tc at prior austenite grain boundaries of 0.10 atm % or more.

As explained above, it is known that hydrogen embrittlement cracking becomes easier to occur the higher the strength of the steel material. In particular, in a steel material having an extremely high strength such as a tensile strength of 2000 MPa or more, to secure high strength, the microstructure of a steel material generally contains martensite. On the other hand, in the case of such a high strength steel material, it is believed that hydrogen embrittlement mainly occurs due to hydrogen segregation at the prior austenite grain boundaries in the martensite structure. Therefore, the inventors conducted studies focusing on specific elements contained in the hot stamped body from the viewpoint of strengthening the prior austenite grain boundaries forming the starting points of hydrogen embrittlement cracking in the microstructure to thereby deal with the drop in hydrogen embrittlement resistance relating to such grain boundary cracking in a steel material having an extremely high strength such as a tensile strength of 2000 MPa or more, more specifically a hot stamped body. First, the inventors conducted studies from the viewpoint of suppressing embrittlement of the prior austenite grain boundaries and thereby strengthening the prior austenite grain boundaries. Explained in more detail, in general, sometimes a relatively large amount of Mn is added so as to improve the hardenability of the steel material along with the increase in strength of the steel material. However, in this research of the inventors, it was learned that if containing a relatively large amount of Mn, the hardenability is improved, but due to the Mn, the prior austenite grain boundaries are embrittled and hydrogen embrittlement cracking at the prior austenite grain boundaries is promoted and, as a result, the hydrogen embrittlement resistance of the hot stamped body may deteriorate. As opposed to this, the inventors discovered that by limiting the Mn content to less than 0.50 mass % in the hot stamped body, it is possible to sufficiently suppress or reduce embrittlement of the prior austenite grain boundaries due to Mn and as a result strengthen the prior austenite grain boundaries and improve the hydrogen embrittlement resistance of the hot stamped body compared with the case of containing a relatively large amount of Mn.

Next, the inventors conducted further studies from the viewpoint of positively strengthening the prior austenite grain boundaries and discovered that by making specific elements, more specifically at least one of Mo, W, Ta, Re, Os, Ir, and Tc, in particular Mo and W, segregate at the prior austenite grain boundaries to give a total amount of segregation of 0.10 atm % or more, it is possible to strengthen the prior austenite grain boundaries in the microstructure of the hot stamped body. In addition, the inventors discovered that due to the grain boundary segregation of these grain boundary strengthening elements, regardless of the Mn content being limited to less than 0.50 mass %, not only is the drop in hardenability simply suppressed, but also it is possible to make the hardenability equal to that of the case of a high Mn content or a level above the same and, as a result, regardless of the less than 0.50 mass % relatively low Mn content, possible to reliably achieve, for example, a high tensile strength of 2200 MPa or more.

While not intending to be bound to any specific theory, it is believed that by making the above grain boundary strengthening elements segregate at the prior austenite grain boundaries, it is possible to remarkably lower the grain boundary energy. By lowering the grain boundary energy, it is generally possible to suppress the formation of nuclei of ferrite. For this reason, it is believed that by making the above grain boundary strengthening elements segregate at the prior austenite grain boundaries, it is possible to suppress the drop in hardenability due to the relatively low Mn content and achieve a hardenability equal to or higher than the case of a high Mn content. In the past, for example, from the viewpoint of improvement of the hardenability, etc., it is known to add part of the grain boundary strengthening elements to the hot stamped body. However, in a hot stamped body of a high strength such as a tensile strength of more than 2000 MPa, the C content of the hot stamped body becomes higher, and therefore in the conventional method of production, these grain boundary strengthening elements form carbides and/or intermetallic compounds. These grain boundary strengthening elements could not be sufficiently made to segregate at the prior austenite grain boundaries in the dissolved state. This time, as explained later in detail in relation to the method of production of the hot stamped body, the inventors discovered that by suitably controlling the heat treatment conditions in particular in the preheating step before the hot stamping step and in the hot stamping step, it is possible to make at least one of Mo, W, Ta, Re, Os, Ir, and Tc segregate at the prior austenite grain boundaries in a predetermined total amount of segregation. Therefore, the fact that in a high strength hot stamped body containing carbon in a 0.40 mass % or more relatively high amount, by making at least one of Mo, W, Ta, Re, Os, Ir, and Tc segregate at the prior austenite grain boundaries in a predetermined total amount of segregation to strengthen the grain boundaries, regardless of the low Mn content, it is possible to maintain a high strength while improving the hydrogen embrittlement resistance was first clarified this time by the inventors. Therefore, according to the hot stamped body according to an embodiment of the present invention, regardless of the hot stamped body having a high tensile strength, for example, a high tensile strength of 2200 MPa or more, it is possible to remarkably improve the hydrogen embrittlement resistance by combination of suppression of embrittlement of the prior austenite grain boundaries based on the reduced Mn content and the positive strengthening of the prior austenite grain boundaries and improvement of hardenability by grain boundary segregation of grain boundary strengthening elements selected from at least one of Mo, W, Ta, Re, Os, Ir, and Tc.

Below, the hot stamped body according to the embodiment of the present invention will be explained in more detail. In the following explanation, the "%" of the units of content of the elements, unless otherwise indicated, means "mass %". Further, in this Description, "to" showing a numerical range, unless otherwise indicated, is used in the sense including the numerical values described before and after it as the upper limit value and lower limit value.

[C: 0.40 to 0.70%]

C is an element improving the strength of a hot stamped body. If the C content is less than 0.40%, it is not possible to obtain the desired strength at the hot stamped body. For this reason, the C content is 0.40% or more. The C content is preferably more than 0.40%, 0.42% or more, 0.44% or more, or 0.45% or more.

On the other hand, if the C content is more than 0.70%, the strength becomes too high and sometimes excellent hydrogen embrittlement resistance cannot be obtained. For this reason, the C content is 0.70% or less. Preferably, the C content is 0.68% or less, 0.67% or less, 0.65% or less, or 0.60% or less.

[P: 0.100% or Less]

P is an impurity element and segregates at the grain boundaries to cause the hydrogen embrittlement resistance to deteriorate. For this reason, the P content is 0.100% or less. The P content is preferably 0.070% or less, 0.050% or less, or 0.010% or less.

The lower limit of the P content is not particularly prescribed, but if less than 0.0001%, the dephosphorization cost greatly rises making this not preferable economically. For this reason, the P content may also be 0.0001% or more.

[S: 0.0100% or Less]

S is an impurity element and forms inclusions in the steel. The inclusions cause the hydrogen embrittlement resistance to deteriorate, therefore the S content is 0.0100% or less. The S content is preferably 0.0080% or less, 0.0050% or less, 0.0030% or less, or 0.0020% or less.

The lower limit of the S content is not particularly prescribed, but if less than 0.0001%, the desulfurization cost greatly rises making this not preferable economically. For this reason, the S content may also be 0.0001% or more.

[N: 0.0200% or Less]

N is an impurity element and forms nitrides in the steel. The nitrides cause the hydrogen embrittlement resistance to deteriorate, therefore the N content is 0.0200% or less. The N content is preferably 0.0180% or less, 0.0150% or less, 0.0100% or less, 0.0060% or less, or 0.0040% or less.

The lower limit of the N content is not particularly prescribed, but if reducing this to less than 0.0001%, the denitridation cost greatly rises making this not preferable economically. For this reason, the N content may also be 0.00010% or more.

[O: 0.0200% or Less]

O, if contained in a large amount in the steel, forms coarse oxides and causes the hydrogen embrittlement resistance to deteriorate. For this reason, the O content is 0.0200% or less. The O content is preferably 0.0150% or less, 0.0100% or less, 0.0070% or less, or 0.0040% or less.

From the viewpoint of reducing the refining costs, the O content may also be 0.0001% or more. To make a large number of fine oxides disperse at the time of deoxidation of the molten steel, the O content may be 0.0005% or more.

[Al: 0.0010 to 0.500%]

Al is an element having the action of deoxidizing the molten steel and making the steel sounder. If the Al content is less than 0.0010%, the deoxidation will not sufficiently proceed and coarse oxides will be formed causing the hydrogen embrittlement resistance to deteriorate. For this reason, the Al content is 0.0010% or more. The Al content is preferably 0.003% or more, 0.005% or more, 0.010% or more, or 0.030% or more.

On the other hand, if the Al content is more than 0.500%, coarse oxides will form in the steel causing the hydrogen embrittlement resistance of the hot stamped body to fall. For this reason, the Al content is 0.500% or less. The Al content is preferably 0.400% or less, 0.300% or less, 0.200% or less, 0.150% or less, or 0.100% or less.

[Nb: 0.0010 to 0.100%]

Nb is an element forming carbonitrides in steel and improving the strength of the hot stamped body by precipitation strengthening. Further, it is an element contributing to the refinement of the structure by the pinning effect. If the Nb content is less than 0.0010%, these effects cannot be sufficiently obtained. For this reason, the Nb content is 0.0010% or more. The Nb content is preferably 0.005% or more, 0.009% or more, or 0.015% or more.

On the other hand, if the Nb content is more than 0.100%, coarse carbonitrides are formed in the steel and the hydrogen embrittlement resistance of the hot stamped body falls. For this reason, the Nb content is 0.100% or less. The Nb content is preferably 0.080% or less, 0.060% or less, or 0.050% or less.

[Ti: 0.010 to 0.200%]

Ti is an element forming carbonitrides in steel and improving the strength of the hot stamped body by precipitation strengthening. Further, it is an element contributing to the refinement of the structure by the pinning effect. If the Ti content is less than 0.010%, these effects cannot be sufficiently obtained. For this reason, the Ti content is 0.010% or more. The Ti content is preferably 0.015% or more, 0.020% or more, or 0.025% or more.

On the other hand, if the Ti content is more than 0.200%, coarse carbonitrides are formed in the steel and the hydrogen embrittlement resistance of the hot stamped body falls. For this reason, the Ti content is 0.200% or less. The Ti content is preferably 0.180% or less, 0.150% or less, 0.100% or less, 0.060% or less, or 0.050% or less.

[Mo: 0.010 to 2.000%]

Mo is an element segregating at the austenite grain boundaries at the time of heating in the hot stamping step to thereby raise the hardenability and making the strength of the prior austenite grain boundaries rise to raise the hydrogen embrittlement resistance in the hot stamped body. If the Mo content is less than 0.010%, sometimes such an effect cannot be sufficiently obtained and the desired hydrogen embrittlement resistance cannot be obtained. For this reason, the Mo content is 0.010% or more. The Mo content is preferably 0.050% or more, 0.100% or more, 0.150% or more, 0.200% or more, 0.300% or more, or 0.500% or more.

On the other hand, if the Mo content is more than 2.000%, in the hot stamped body, coarse intermetallic compounds and carbides are formed and the hydrogen embrittlement resistance of the hot stamped body deteriorates. For this reason, the Mo content is 2.000% or less. The Mo content is preferably 1.800% or less, 1.500% or less, 1.300% or less, 1.000% or less, or 0.800% or less.

[B: 0.0005 to 0.0200%]

B is an element improving the hardenability of steel. If the B content is less than 0.0005%, the desired strength cannot be obtained. For this reason, the B content is 0.0005% or more. The B content is preferably 0.0010% or more, 0.0015% or more, or 0.0020% or more. On the other hand, if the B content is more than 0.0200%, coarse borides are formed at the hot stamped body and the hydrogen embrittlement resistance of the hot stamped body falls. For this reason, the B content is 0.0200% or less. The B content is preferably 0.0150% or less, 0.0100% or less, 0.0050% or less, 0.0040% or less, or 0.0030% or less.

The basic chemical composition of the hot stamped body according to an embodiment of the present invention is as explained above. Furthermore, the hot stamped body may, if necessary, contain at least one of the following optional elements in place of part of the Fe of the balance. For example, the hot stamped body may contain at least one element selected from the group comprising Si: 0 to 3.00%, Mn: 0 to less than 0.50%, Cr: 0 to 1.00%, Co: 0 to 4.00%, Ni: 0 to 3.00%, Cu: 0 to 3.00%, and V: 0 to 3.00%. Further, the hot stamped body may contain at least one element selected from the group comprising Ca: 0 to 1.000%, Mg: 0 to 1.000%, and REM: 0 to 1.000%. Further, the hot stamped body may also have at least one element selected from the group comprising Sb: 0 to 1.00%, Zr: 0 to 1.00%, and Sn: 0 to 1.00%. Further, the hot stamped body may contain As: 0 to 0.100%. Further, the hot stamped body may contain W: 0 to 3.000%. Further, the hot stamped body may contain at least one element of Ta, Re, Os, Ir, and Tc in a total of 0 to 1.00%. Further, the hot stamped body may contain at least one element selected from the group selected from Se: 0 to 1.00% and Bi: 0 to 1.00%. Below, these optional elements will be explained in detail.

[Si: 0 to 3.00%]

Si is an element improving the strength of the hot stamped body by solid solution strengthening. The Si content may also be 0.001% or more, but to reliably obtain this effect, the Si content is preferably 0.01% or more. The Si content may also be 0.05% or more, 0.10% or more, 0.20% or more, 0.30% or more, or 0.40% or more.

On the other hand, if excessively containing Si, at the hot stamped body, sometimes the amount of ferrite increases and the desired strength cannot be obtained. For this reason, the Si content is 3.00% or less. The Si content may also be 2.50% or less, 2.00% or less, 1.00% or less, or 0.70% or less.

[Mn: 0 to Less Than 0.50%]

Mn is an element raising the hardenability of steel and contributing to the improvement of the strength. The Mn content may be 0.001% or more, but to reliably obtain this effect, the Mn content is preferably 0.01% or more. The Mn content may also be 0.05% or more, 0.10% or more, 0.15% or more, or 0.20% or more.

On the other hand, if excessively containing Mn, sometimes the prior austenite grain boundaries become brittle and hydrogen embrittlement cracking at the prior austenite grain boundaries is promoted. For this reason, the Mn content is less than 0.50%. The Mn content may also be, 0.49% or less, 0.48% or less, 0.47% or less, 0.46% or less, 0.45% or less, 0.43% or less, 0.40% or less, 0.35% or less, or 0.30% or less.

[Cr: 0 to 1.00%]

Cr is an element dissolving in the prior austenite grains at the time of heating before hot stamping and thereby raises the strength of the hot stamped body. The Cr content may also be 0.001% or more, but to reliably obtain this effect, the Cr content is preferably 0.01% or more or 0.05% or more.

On the other hand, if excessively containing Cr, sometimes coarse carbides are formed at the hot stamped body and the hydrogen embrittlement resistance of the hot stamped body falls. For this reason, the Cr content is 1.00% or less. The Cr content may also be 0.80% or less, 0.50% or less, 0.30% or less, 0.15% or less, or 0.08% or less.

[Co: 0 to 4.00%]

Co is an element improving the strength of the hot stamped body by solid solution strengthening. The Co content may be 0.001% or more, but to reliably obtain this effect, the Co content is preferably 0.01% or more or 0.05% or more.

On the other hand, even if made to be contained in a large amount, the effect becomes saturated, therefore the Co content is preferably 4.00% or less. The Co content may also be 3.00% or less, 2.00% or less, 1.00% or less, 0.50% or less, or 0.10% or less.

[Ni: 0 to 3.00%]

Ni has the action of dissolving in the austenite grains at the time of heating in the hot stamping step and thereby raising the strength of the hot stamped body. The Ni content may be 0.001% or more, but to reliably obtain this effect, the Ni content is preferably 0.01% or more or 0.05% or more.

On the other hand, even if made to be contained in a large amount, the effect becomes saturated, therefore the Ni content is preferably 3.00% or less. The Ni content may also be 2.00% or less, 1.00% or less, 0.60% or less, 0.30% or less, or 0.10% or less.

[Cu: 0 to 3.00%]

Cu has the action of dissolving in the austenite grains at the time of heating in the hot stamping step and thereby raising the strength of the hot stamped body. The Cu content may be 0.001% or more, but to reliably obtain this effect, the Cu content is preferably 0.01% or more or 0.05% or more.

On the other hand, even if made to be contained in a large amount, the effect becomes saturated, therefore the Cu content is preferably 3.00% or less. The Cu content may also be 2.00% or less, 1.00% or less, 0.60% or less, 0.30% or less, or 0.10% or less.

[V: 0 to 3.00%]

V has the effect of forming carbonitrides in the steel to thereby improve the strength of the hot stamped body by precipitation strengthening. The V content may be 0.001% or more, but to reliably obtain this effect, the V content is preferably 0.01% or more or 0.05% or more.

On the other hand, even if made to be contained in a large amount, the effect becomes saturated, therefore the V content is preferably 3.00% or less. The V content may also be 2.00% or less, 1.00% or less, 0.60% or less, 0.30% or less, or 0.10% or less.

[Ca: 0 to 1.000%]

Ca is an element able to suppress the formation of oxides. The Ca content may be 0.0001% or more, but to reliably obtain this effect, the Ca content is preferably 0.0005% or more or 0.001% or more.

On the other hand, even if made to be contained in a large amount, the effect becomes saturated, therefore the Ca content is preferably 1.000% or less. The Ca content may also be 0.500% or less, 0.100% or less, 0.050% or less, 0.010% or less, 0.005% or less, or 0.002% or less.

[Mg: 0 to 1.000%]

Mg forms oxides and sulfides in the molten steel to suppress the formation of coarse MnS, causes dispersion of large number of fine oxides, and contributes to increased fineness of the metallographic structure. The Mg content may be 0.00010% or more, but to reliably obtain this effect, the Mg content is preferably 0.0005% or more or 0.001% or more.

On the other hand, even if made to be contained in a large amount, the effect becomes saturated, therefore the Mg content is preferably 1.000% or less. The Mg content may also be 0.500% or less, 0.100% or less, 0.050% or less, 0.010% or less, 0.005% or less, or 0.002% or less.

[REM: 0 to 1.000%]

REM is an element suppressing the formation of oxides. The REM content may be 0.0001% or more, but to reliably obtain this effect, the REM content is preferably 0.0005% or more or 0.001% or more.

On the other hand, even if made to be contained in a large amount, the effect becomes saturated, therefore the REM content is preferably 1.000% or less. The REM content may be 0.500% or less, 0.100% or less, 0.050% or less, 0.010% or less, 0.005% or less, or 0.002% or less.

In the present embodiment, "REM" is the general term for the 17 elements of atomic number 21 scandium (Sc), atomic number 39 yttrium (Y), and the lanthanoids of atomic number 57 lanthanum (La) to atomic number 71 lutetium (Lu). The REM content is the total content of these elements.

[Sb: 0 to 1.00%]

Sb is an element inhibiting the formation of oxides. To reliably obtain this effect, the Sb content is preferably 0.001% or more or 0.005% or more.

On the other hand, even if made to be contained in a large amount, the effect becomes saturated, therefore the Sb content is preferably 1.00% or less. The Sb content may also be 0.80% or less, 0.50% or less, 0.20% or less, or 0.10% or less.

[Zr: 0 to 1.00%]

Zr is an element suppressing the formation of oxides. To reliably obtain this effect, the Zr content is preferably 0.001% or more or 0.005% or more.

On the other hand, even if contained in a large amount, the above effect is saturated, therefore the Zr content is preferably 1.00% or less. The Zr content may also be 0.80% or less, 0.50% or less, 0.20% or less, or 0.10% or less.

[Sn: 0 to 1.00%]

Sn is an element suppressing the formation of oxides. If reliably obtaining this effect, the Sn content is preferably 0.001% or more or 0.005% or more.

On the other hand, even if contained in a large amount, the above effect is saturated, therefore the Sn content is preferably 1.00% or less. The Sn content may also be 0.80% or less, 0.50% or less, 0.20% or less, or 0.10% or less.

[As: 0 to 0.100%]

As causes the temperature for forming an austenite single phase to fall and thereby contributes to refinement of the prior austenite grains. If reliably obtaining this effect, the As content is preferably 0.001% or more or 0.005% or more.

On the other hand, even if contained in a large amount, the above effect is saturated, therefore the As content is preferably 0.100% or less. The As content may be 0.080% or less, 0.050% or less, 0.020% or less, or 0.010% or less.

[W: 0 to 3.000%]

W is an element segregating at the austenite grain boundaries at the time of heating in the hot stamping step to thereby raise the hardenability and causing the strength of the prior austenite grain boundaries to rise to thereby raise the hydrogen embrittlement resistance at the hot stamped body. The W content may also be 0.001% or more, but if reliably obtaining this effect, the W content is preferably 0.005%. The W content may also be 0.010% or more, 0.050% or more, 0.100% or more, 0.200% or more, 0.400% or more, 0.500% or more, or 0.800% or more.

On the other hand, even if contained in a large amount, sometimes the effect become saturated and/or the W unable to segregate in the dissolved state forms intermetallic compounds and carbides. Sometimes such intermetallic compounds and carbides act as starting points of cracking and the hydrogen embrittlement resistance of the hot stamped body falls. For this reason, the W content is preferably 3.000% or less. The W content may also be 2.500% or less, 2.000% or less, 1.800% or less, 1.500% or less, or 1.000% or less.

[At Least One of Ta, Re, Os, Ir, and Tc: 0 to 1.00% in Total]

Ta, Re, Os, Ir, and Tc are elements segregating at the prior austenite grain boundaries at the time of heating in the hot stamping step in the same way as Mo and W to raise the hardenability and raising the strength of the prior austenite grain boundaries to raise the hydrogen embrittlement resistance at the hot stamped body. The total of the content of the at least one element of Ta, Re, Os, Ir, and Tc may be 0%, but to obtain such an effect, is preferably 0.001% or more. The total of the content of the at least one element of Ta, Re, Os, Ir, and Tc is preferably 0.01% or more, more preferably 0.10% or more, still more preferably 0.15% or more. On the other hand, even if excessively containing these elements, the effect becomes saturated. Therefore, including these elements in the steel material more than necessary is liable to invite a rise in the production costs. Therefore, the total of the contents of the at least one of Ta, Re, Os, Ir, and Tc is preferably 1.00% or less and may also be 0.80% or less, 0.60% or less, or 0.40% or less.

[Se: 0 to 1.00%]

Se is an element improving the hydrogen embrittlement resistance. For this reason, Se may be included. To obtain the above effect, the Se content is preferably 0.001% or more or 0.01% or more.

On the other hand, if the Se content exceeds 1.00%, the effect becomes saturated and the costs increase. Therefore, if including Se, the Se content is preferably 1.00% or less. The Se content may also be 0.80% or less, 0.50% or less, 0.20% or less, or 0.10% or less.

[Bi: 0 to 1.00%]

Bi is an element improving the hydrogen embrittlement resistance. For this reason, Bi may be included. To obtain the above effect, the Bi content is preferably 0.001% or more or 0.01% or more.

On the other hand, if the Bi content exceeds 1.00%, the effect becomes saturated and the costs increase. Therefore, if including Bi, the Bi content is preferably 1.00% or less.

The Bi content may also be 0.80% or less, 0.50% or less, 0.20% or less, or 0.10% or less.

In the hot stamped body according to an embodiment of the present invention, the balance besides the above elements is comprised of Fe and impurities. The "impurities" are constituents, etc., entering due to various factors in the production process starting from materials such as ore and scrap, etc., when industrially producing hot stamped bodies. The method for industrial production is the blast furnace steelmaking method or electric furnace steelmaking method and includes levels entering at the time of production by either method (impurity level).

The chemical composition of the above hot stamped body may be measured by a general analysis method. For example, it may be measured using ICP-AES (Inductively Coupled Plasma-Atomic Emission Spectrometry). C and S may be measured using the combustion-infrared absorption method, N may be measured using the inert gas melting-thermal conductivity method, and O may be measured by the inert gas melting-nondispersion type infrared absorption method.

If the surface of the hot stamped body is provided with a plating layer, mechanical polishing may be used to remove the plating layer, then the chemical composition may be analyzed.

[At Least One of Martensite, Bainite, and Tempered Martensite: 70% or More in Total]

The microstructure of the hot stamped body preferably includes, by area ratio, at least one of martensite, bainite, and tempered martensite in a total of 70% or more. The remaining structure is not particularly limited, but may also be comprised of at least one of 30% or less of ferrite, retained austenite, and pearlite. Martensite, bainite, and tempered martensite are extremely hard structures, therefore by the hot stamped body containing at least one of martensite, bainite, and tempered martensite in an area ratio of a total of 70% or more, a high tensile strength, specifically a tensile strength of 2200 MPa or more, can be achieved. The total of the area ratios of the least one of martensite, bainite, and tempered martensite is preferably 75% or more, 80% or more, 85% or more, 90% or more, 92% or more, or 94% or more, more preferably 95% or more or 97% or more. The upper limit of the total of the area ratios of the at least one of martensite, bainite, and tempered martensite is not particularly prescribed and may also be 100%.

[Identification of Microstructure and Calculation of Area Ratios]

The microstructure in the hot stamped body is identified and the area ratios are calculated in the following way. First, a sample is cut out from any position 50 mm or more away from the ends of the steel material (if not possible to obtain a sample from this position, a position away from the ends) so as to enable a cross-section of thickness vertical to the surface to be examined. The size of the sample depends on the measurement device, but is a size enabling 10 mm or so to be examined in a direction vertical to the thickness direction.

The cross-section of the sample is polished using #600 to #1500 silicon carbide paper, then a liquid comprised of particle size 1 to 6 m diamond powder dispersed in alcohol or other diluent or pure water is used to polish the surface to a mirror finish. Next, the examined surface is finished by electrolytic polishing. An area of a length 50 m and 50 m in the sheet thickness direction centered at a ¼ depth position of the sheet thickness at any position in the long direction of the sample cross-section is measured at 0.1 m measurement intervals by electron backscatter diffraction to obtain crystal orientation information. For the measurement, an EBSD analysis apparatus comprised of a thermal field emission type scan electron microscope and EBSD detector may be used. For example, an EBSD analysis apparatus comprised of a JSM-7001F made by JEOL and a DVC5 model detector made by TSL may be used. At that time, the vacuum degree inside the EBSD analysis apparatus may be $9.6\times10^{-5}$ Pa or less, the acceleration voltage may be 15 kV, and the beam current level may be made 13.

The obtained crystal orientation information is analyzed using the "Phase Map" function included in the software "OIM Analysis®" attached to the EBSD analysis apparatus. Structures with fcc crystal structures are judged to be retained austenite. The area ratio of the retained austenite is obtained by calculating the area ratio of this retained austenite. Next, regions with bcc crystal structures are judged to be bainite, tempered martensite, martensite, and ferrite. In these regions, using the "Grain Average Misorientation" function included in the software "OIM Analysis®" attached to the EBSD analysis apparatus, under conditions deeming a 5° grain boundary as a crystal grain boundary, a region having a "Grain Average Misorientation" of 0.5° or less is extracted as ferrite. The area ratio of ferrite is obtained by calculating the area ratio of the extracted ferrite.

Next, the remaining region (region with "Grain Average Misorientation" of more than 0.5°) is made the area ratio of the total of martensite, tempered martensite, and bainite. The area ratio of pearlite is calculated by subtracting from 100% the area ratio of the retained austenite and the area ratios of the bainite, tempered martensite, martensite, and ferrite.

[Total Amount of Segregation of at Least One of Mo, W, Ta, Re, Os, Ir, and Tc at Prior Austenite Grain Boundaries: 0.10 Atm % or More]

In an embodiment of the present invention, the total amount of segregation of at least one of Mo, W, Ta, Re, Os, Ir, and Tc at the prior austenite grain boundaries is 0.10 atm % or more. By making at least one of Mo, W, Ta, Re, Os, Ir, and Tc segregate at the prior austenite grain boundaries to give a total amount of segregation of 0.10 atm % or more, it is possible to raise the hardenability and strengthen the prior austenite grain boundaries at the microstructure of the hot stamped body. According to an embodiment of the present invention, by combination of suppression of embrittlement of the prior austenite grain boundaries by limiting the Mn content of the hot stamped body to less than 0.50% and the positive strengthening of the prior austenite grain boundaries by segregation of specific grain boundary strengthening elements, it is possible to remarkably improve the strength of the prior austenite grain boundaries compared with the case of using only one method. Therefore, even if the hot stamped body has an extremely high tensile strength, for example, an extremely high tensile strength of 2200 MPa or more, the resistance to grain boundary cracking is extremely high, therefore it is possible to remarkably improve the hydrogen embrittlement resistance. From the viewpoint of grain boundary strengthening, the higher the total amount of segregation of the at least one of Mo, W, Ta, Re, Os, Ir, and Tc at the prior austenite grain boundaries, the more preferable. For example, it may be 0.13 atm % or more, 0.15 atm % or more, 0.18 atm % or more, or 0.20 atm % or more. The upper limit of the above total content is not particularly limited, but for example the total amount of segregation may be 3.00 atm % or less and may also be 2.00 atm % or less, 1.50 atm % or less, 1.00 atm % or less, 0.80 atm % or less, 0.60 atm % or less, or 0.40 atm % or less.

In one embodiment, the amount of segregation of Mo at the prior austenite grain boundaries may be 0.10 atm % or more, 0.13 atm % or more, 0.15 atm % or more, 0.18 atm % or more, or 0.20 atm % or more. Similarly, the amount of segregation of Mo at the prior austenite grain boundaries may be 3.00 atm % or less, 2.00 atm % or less, 1.50 atm % or less, 1.00 atm % or less, 0.80 atm % or less, 0.60 atm % or less, or 0.40 atm % or less. In another embodiment, the amount of segregation of W at the prior austenite grain boundaries may be 0.10 atm % or more, 0.13 atm % or more, 0.15 atm % or more, 0.18 atm % or more, or 0.20 atm % or more. Similarly, the amount of segregation of W at the prior austenite grain boundaries may be 3.00 atm % or less, 2.00 atm % or less, 1.50 atm % or less, 1.00 atm % or less, 0.80 atm % or less, 0.60 atm % or less, or 0.40 atm % or less. In still another embodiment, the total amount of segregation of the amount of segregation of Mo and the amount of segregation of W at the prior austenite grain boundaries may be 0.10 atm % or more, 0.13 atm % or more, 0.15 atm % or more, 0.18 atm % or more, or 0.20 atm % or more and/or may be 3.00 atm % or less, 2.00 atm % or less, 1.50 atm % or less, 1.00 atm % or less, 0.80 atm % or less, 0.60 atm % or less, or 0.40 atm % or less. In a still further embodiment, the total amount of segregation of the amount of segregation of Mo, the amount of segregation of W, and the at least one of Ta, Re, Os, Ir, and Tc at the prior austenite grain boundaries may be 0.10 atm % or more, 0.13 atm % or more, 0.15 atm % or more, 0.18 atm % or more, or 0.20 atm % or more and/or may be 3.00 atm % or less, 2.00 atm % or less, 1.50 atm % or less, 1.00 atm % or less, 0.80 atm % or less, 0.60 atm % or less, or 0.40 atm % or less.

[Method of Measurement of Total Amount of Segregation of At Least One of Mo, W, Ta, Re, Os, Ir, and Tc at Prior Austenite Grain Boundaries]

The total amount of segregation of the at least one of Mo, W, Ta, Re, Os, Ir, and Tc at the prior austenite grain boundaries is determined as follows: First, a test piece is taken from a position 50 mm or more away from the end faces of the hot stamped body. At that time, the front and back surfaces of the test piece are finished by machine polishing. Further, if there is a plating layer at the steel sheet surface, the plating layer is removed and then the front and back surfaces of the test piece of the steel sheet are finished by machine polishing. At that time, the sheet thickness is not particularly designated if the ¼ depth position of the sheet thickness can be measured, but the same amounts of the front and back surfaces of the test piece may also be removed by machine grinding so that the sheet thickness becomes 1.2 mm. The test piece is worked to a length of 20 mm and a width of 3.2 mm and formed with a V-notch of an angle of 450 at a position of a length of 11.5 mm. The test piece is dipped in a 20%-ammonium thiocyanate solution. At this time, the dipping time is not particularly limited. It is sufficient that the prior austenite grain boundaries are exposed when set inside an Auger electron emission spectrometer and fracturing. For example, it may be 48 hours. The front and back surfaces of the test piece are galvanized within 10 minutes after ending the dipping. After plating, the test piece is quickly subjected to Auger electron emission spectrometry and fractured. At that time, the time after plating to fracture of the test piece is preferably within 1.5 hours, more preferably within 0.5 hour. The test piece is set within the Auger electron emission spectrometer and fractures from the notch portion of the test piece to expose the prior austenite grain boundaries. At this time, the apparatus may be an Auger electron emission spectrometer. The model is not particularly limited, but a PHI680 made by ULVAC-PHI may be used. As the measurement conditions, the accelerating voltage may be 10 keV and the beam current may be 10 nA. An electron beam is fired at the exposed prior austenite grain boundaries by a 1 to 30 kV accelerating voltage and the atm % of specific elements at the grain boundaries (specifically at least one of Mo, W, Ta, Re, Os, Ir, and Tc) are measured. The measurement is performed at the prior austenite grain boundaries at 10 locations at a position of ¼ depth of the sheet thickness from the surface. To prevent contamination of the grain boundaries, quickly ending the measurement after fracture is preferable. The measurement should be ended within 30 minutes. The average value of the atm % of the obtained specific elements is calculated and determined as the total value of segregation of the at least one of Mo, W, Ta, Re, Os, Ir, and Tc.

[Average Size of Prior Austenite Grains: 15 m or Less]

In an embodiment of the present invention, the average size of the prior austenite grains is not particularly limited, but may for example be 15 m or less. The hot stamped body according to an embodiment of the present invention contains Nb and Ti. These elements form carbides, nitrides, and/or carbonitrides. They contribute to refinement of the structure by their pinning effect. Further, in the hot stamped body according to an embodiment of the present invention, the grain boundary strengthening elements selected from at least one of Mo, W, Ta, Re, Os, Ir, and Tc segregate at the grain boundaries, therefore it is possible to slow the speed of grain growth by the so-called "solute drag" effect. Therefore, in the hot stamped body according to an embodiment of the present invention, it is possible to refine the prior austenite grains by the pinning effect due to Nb and Ti and the solute drag effect due to grain boundary segregation of specific grain boundary strengthening elements. For example, the average size of the prior austenite grains may be 12 m or less, 10 m or less, or 8 m or less. The lower limit is not particularly prescribed, but the average size of the prior austenite grains may be for example 1 μm or more, 2 m or more, or 3 m or more.

[Method of Determination of Average Size of Prior Austenite Grains]

The average size of prior austenite grains is determined in the following way. First, a sample is cut out from any position 50 mm or more from an end face of the hot stamped body (if a sample cannot be taken from this position, a position away from the end parts) so as to enable a sheet thickness cross-section vertical to the surface to be examined. The size of the sample, while depending also on the measuring device, is made a size enabling 10 mm or so to be examined in a direction vertical to the sheet thickness direction. The cross-section of the sample is polished using #600 to #1500 silicon carbide paper, then a liquid comprised of particle size 1 to 6 m diamond powder dispersed in alcohol or other diluent or pure water is used to polish the surface to a mirror finish. Next, the examined surface is finished by electrolytic polishing. An area of a length 50 m and 50 m in the sheet thickness direction at a ¼ depth position of the sheet thickness at any position in the long direction of the sample cross-section is measured at 0.1 m measurement intervals by electron backscatter diffraction to obtain crystal orientation information. For the measurement, an EBSD analysis apparatus comprised of a thermal field emission type scan electron microscope and EBSD detector may be used. For example, an EBSD analysis apparatus comprised of a JSM-7001F made by JEOL and a DVC5 model detector made by TSL may be used. At that time, the vacuum degree inside the EBSD analysis apparatus may be $9.6\times10^{-5}$ Pa or less, the acceleration voltage may be 15 kV, and the beam current level may be made 13. The obtained crystal orientation information is used to calculate the crystal orientation of the prior austenite grains from the crystallographic orientation relationship of general prior austenite grains and crystal grains having body-centered cubic structures after transformation. For the method of calculating the crystal orientations of the prior austenite grains, the following method is used. First, a crystal orientation map of the prior austenite grains is prepared by the method described in Acta Materialia, 58(2010), 6393-6403. The average value between the shortest diameter and the longest diameter of one prior austenite grain included in the examined field is calculated. That average value is made the size of the prior austenite grain. The above operation is performed for all of the prior austenite grains except for the prior austenite grains where the crystal grains as a whole are not included in the captured field, such as at the end parts of the captured field, to find the sizes of all of the prior austenite grains in the captured field. From the obtained sizes of all prior austenite grains, the average size is calculated whereupon the average size of prior austenite grains is determined.

[Covering]

The hot stamped body according to an embodiment is provided with a covering at part or all of the surface.

The covering may be a covering mainly comprised of an Fe—Al-based alloy or may be a covering mainly comprised of an Fe—Zn-based alloy. The "covering" means a film, alloyed plating layer, or intermetallic compound layer.

A "covering mainly comprised of an Fe—Al-based alloy" is a covering containing Fe and Al in a total of 70 mass % or more, while a "covering mainly comprised of an Fe—Zn-based alloy" is a covering containing Fe and Zn in a total of 70 mass % or more. A covering mainly comprised of an Fe—Al-based alloy may further contain, in addition to the Fe and Al, Si, Mg, Ca, Sr, Ni, Cu, Mo, Mn, Cr, C, Nb, Ti, B, V, Sn, W, Sb, Zn, Co, In, Bi, Zr, Se, As, and REM and have a balance of impurities. A "covering mainly comprised of an Fe—Zn-based alloy" may further contain, in addition to the Fe and Zn, Si, Mg, Ca, Sr, Ni, Cu, Mo, Mn, Cr, C, Nb, Ti, B, V, Sn, W, Sb, Al, Co, In, Bi, Zr, Se, As, and REM and have a balance of impurities.

By having the covering, corrosion resistance is given, therefore the effect of improvement of the hydrogen embrittlement resistance at use in an automobile is obtained.

The thickness of the covering is preferably 10 to 100 m.

[Shape of Hot Stamped Body]

The shape of the hot stamped body according to an embodiment is not particularly limited. That is, the hot stamped body may be a flat shape or the steel sheet may be formed into a predetermined 3D shape. A hot stamped (hot shaped) steel member is in many cases a 3D shape, but in the present embodiment, a case of a 3D shape and a case of a flat shape are both included and referred to as a "hot stamped body". Further, the hot stamped body may be a tailored property material having different strengths depending on the location. In this case, at least part of the hot stamped body has to have a tensile strength of 2200 MPa or more. The tailored property material may be comprised of steel sheets of differing chemical compositions, strengths, and thicknesses joined together and, further, may be comprised of a steel sheet which is heated treated at parts. Further, the hot stamped body may be provided with a decarburized layer or softened layer at part of its surface layer.

[Mechanical Properties]

According to the hot stamped body of an embodiment of the present invention, excellent mechanical properties, for example, a tensile strength of 2200 MPa or more, can be achieved. The tensile strength is preferably 2300 MPa or more, more preferably 2400 MPa or more, most preferably 2500 MPa or more. The upper limit is not particularly prescribed, but, for example, the tensile strength may be 3500 MPa or less, 3300 MPa or less, or 3000 MPa or less. The tensile strength of the hot stamped body is measured by preparing a No. 5 test piece and conducting a tensile test based on JIS Z 2241: 2011. At this time, for the purpose of removing roughness at the surface of the test piece, the surface layer parts of the front and back surfaces may be removed by machining or chemical polishing.

The hot stamped body according to an embodiment of the present invention, despite as explained above having, for example, a high tensile strength of 2200 MPa or more, is excellent in hydrogen embrittlement resistance, and therefore is extremely useful for use as, for example, a frame member or bumper of an automobile or other structural member and reinforcing member where strength is required.

<Method of Production of Hot Stamped Body>

Next, a preferable method of production of the hot stamped body according to an embodiment of the present invention will be explained. The following explanation is intended to illustrate the characteristic method for producing the hot stamped body according to the embodiment of the present invention and is not intended to limit the hot stamped body to one produced by the method of production such as explained below.

In order to make specific grain boundary strengthening elements segregate at the prior austenite grain boundaries, in particular, the method of production of the hot stamped body according to an embodiment of the present invention is characterized by suitably controlling coiling conditions of the hot rolling step and the heat treatment conditions at the preheating step before the hot stamping step and at the hot stamping step. More specifically, the method of production of the hot stamped body according to an embodiment of the present invention comprises:

- hot rolling a slab having a chemical composition explained above in relation to the hot stamped body, then coiling it at a temperature of 450° C. or less (hot rolling step),
- preheating the obtained steel sheet to a temperature of more than 1200° C., then cooling it by an average cooling speed of 10° C./s or more down to less than 350° C. (preheating step), and
- hot stamping the steel sheet, wherein the hot stamping includes heating the steel sheet to a temperature region of 800 to 1000° C. and then holding it there for 60 to 600 seconds (hot stamping step). Below, the steps will be explained in detail.

[Hot Rolling Step]

In the hot rolling step, first, a slab having the chemical composition explained above in relation to the hot stamped body is heated. The method of casting the molten steel is not particularly limited. The slab may be produced by continuous casting, ingot forming, or thin slab casting. The heating before the hot rolling is not particularly limited, but the slab used contains a relatively large amount of alloying elements for obtaining a high strength steel sheet. For this reason, the slab may also be heated before being sent on for hot rolling. For the purpose of making the alloying elements dissolve in the slab, the heating temperature may be 1100° C. or more. Further, the heated slab may optionally be rough rolled before the finish rolling so as to adjust the sheet thickness, etc. The rough rolling need only be able to secure the desired sheet bar dimensions. The conditions are not particularly limited. The heated slab or the slab additionally rough rolled as needed is next subjected to finish rolling. The finish rolling is not particularly limited, but in general is performed under conditions giving an end temperature of the finish rolling of 650° C. or more. If the end temperature of the finish rolling is too low, the rolling reaction force becomes higher and it is difficult to stably obtain the desired sheet thickness. The upper limit is not particularly prescribed, but in general the end temperature of finish rolling is 950° C. or less.

[Coiling]

Next, the finish rolled hot rolled steel sheet is coiled at a temperature of 450° C. or less. Grain boundary strengthening elements selected from at least one of Mo, W, Ta, Re, Os, Ir, and Tc are present in the steel sheet in the form of carbides or intermetallic compounds before the preheating step and hot stamping step. As such carbides, carbides formed by the above grain boundary strengthening elements bonding with carbon alone (for example, WC) or carbides with grain boundary strengthening elements partially dissolved in the cementite of their microstructures ($Fe_3C$), etc., may be mentioned. As explained in detail later, in the present method, in the preheating step, the carbides or intermetallic compounds of the grain boundary strengthening elements are made to sufficiently melt and the grain boundary strengthening elements are made to dissolve in the steel sheet, then the grain boundary strengthening elements dissolved in the steel sheet are made to disperse and segregate at the austenite grain boundaries in the next hot stamping step, whereby at the finally obtained hot stamped body, it is possible to realize a microstructure where the grain boundary strengthening elements are segregated at the prior austenite grain boundaries. However, carbides or intermetallic compounds of grain boundary strengthening elements are thermally stable, therefore sometimes cannot be made to sufficiently melt by just the heat treatment at the preheating step. In such a case, the grain boundary strengthening elements can no longer be made to sufficiently dissolve in the steel sheet. Therefore, to promote the melting operation at the preheating step, it becomes extremely important to refine the carbides and/or intermetallic compounds of the grain boundary strengthening elements and render them easier to melt before the preheating step. In relation to this, by making the coiling temperature after the finish rolling 450° C. or less, it is possible to refine the carbides and/or intermetallic compounds of the grain boundary strengthening elements at the hot rolled steel sheet after coiling. For example, in the case of carbides in which grain boundary strengthening elements dissolve partially in the cementite, the carbides are formed by the grain boundary strengthening elements concentrating in the cementite at the time of coiling. Therefore, by controlling the coiling temperature to a 450° C. or less relatively low temperature, in addition to such refinement of the carbides, it is possible to reduce the amount of the grain boundary strengthening elements dissolved in the cementite, therefore it is possible to promote more the melting operation in the later preheating step. The coiling temperature is preferably 420° C. or less. The lower limit is not particularly prescribed, but the coiling temperature may for example be 250° C. or more or 300° C. or more. Further, for the purpose of softening the hot rolled steel sheet, it may be heat treated to soften after coiling. The method of heat treatment for softening is not particularly limited and may be made general conditions.

If coiling hot rolled steel sheet at a 450° C. or less, preferably a 420° C. or less, relatively low temperature, in general the percentage of bainite, martensite, and other hard structures rises in the hot rolled steel sheet and the rolling load of the rolling mills in the later cold rolling step remarkably rises. Further, preheating at a temperature of more than 1200° C. before the hot stamping step and the effects obtained due to the same, explained in detail later, i.e., the melting and dissolution of carbides and/or intermetallic compounds of the grain boundary strengthening elements, has not been known up to now. Therefore, the technical idea of combining 450° C. or less, preferably 420° C. or less, low temperature coiling at the hot rolling step, a preheating step at a temperature of more than 1200° C., and further heat treatment at the hot stamping step to thereby make specific grain boundary strengthening elements segregate at the prior austenite grain boundaries of the hot stamped body and thereby improve the hydrogen embrittlement resistance of the hot stamped body has not existed up to now and was first discovered by the inventors this time. In particular, the fact that preheating under the high temperature before the hot stamping step simply causes coarsening of the austenite grains is generally recognized. For that reason, it is believed that preheating at a temperature of more than 1200° C. has not been performed in the prior art. Further, in the present method of production, as explained above, 450° C. or less low temperature coiling at the hot rolling step, a preheating step at a temperature of more than 1200° C., and further heat treatment at the hot stamping step are combined to thereby make specific grain boundary strengthening elements segregate at the prior austenite grain boundaries of the hot stamped body and thereby improve the hydrogen embrittlement resistance of the hot stamped body. However, only naturally, if the production conditions are ones making specific grain boundary strengthening elements segregate at the prior austenite grain boundaries of the hot stamped body and thereby enabling improvement of the hydrogen embrittlement resistance of the hot stamped body, it is also possible to apply such production conditions in place of the above combination.

[Pickling Step]

After the coiling step and before the cold rolling step, optionally, pickling may be performed for removing the oxide scale formed on the surface of the hot rolled steel sheet. The pickling may be formed under conditions suitable for removing oxide scale. It may be performed at one time or may be performed divided into several times so as to reliably remove the oxide scale.

[Cold Rolling Step]

After the coiling step, the steel sheet may be optionally cold rolled. The cold rolling is not particularly limited and may be performed under any suitable conditions. For example, the rolling reduction of the cold rolling may be 30 to 80%. The number of rolling passes and the rolling reduction per pass are not particularly limited and may be suitable set so that the rolling reduction of the cold rolling as a whole becomes the above range.

[Annealing Step]

For example, after the cold rolling step, annealing may optionally be performed to adjust the microstructure and/or properties. The heating temperature of the annealing step is not particularly limited, but may for example be 800° C. or less.

[Covering Step]

For the purpose of improving the corrosion resistance, etc., the surface of the hot rolled steel sheet or cold rolled steel sheet may be treated to cover it. The covering treatment may be hot dip coating, hot dip alloyed coating, electroplating, or other treatment. For example, the steel sheet may be hot dip galvanized as covering treatment or may be hot dip galvanized and then alloyed. As the covering, a covering mainly comprised of an Fe—Al-based alloy, a covering mainly comprised of an Fe—Zn-based alloy, etc., may be illustrated. The specific conditions of the covering treatment and alloying treatment are not particularly limited and may be any suitable conditions known to persons skilled in the art.

[Temper Rolling Step]

To correct the shape of the steel sheet or adjust the surface roughness, etc., it is possible, for example, to temper roll the steel sheet after the annealing step, or after the plating step.

[Preheating Step]

In the present method, the obtained hot rolled steel sheet or cold rolled steel sheet is preheated to a temperature of more than 1200° C. before the hot stamping step, then is cooled by an average cooling speed of 10° C./s or more down to less than 350° C. In the hot stamped body according to an embodiment of the present invention, it is extremely important to make specific grain boundary strengthening elements, more specifically at least one type of Mo, W, Ta, Re, Os, Ir, and Tc, segregate at the prior austenite grain boundaries in predetermined amounts. However, the hot stamped body according to an embodiment of the present invention has a 0.40% or more relatively high C content, therefore in the hot rolled steel sheet after the hot rolling step or in the cold rolled steel sheet after the optional cold rolling step or annealing step, these grain boundary strengthening elements are present as carbides and/or intermetallic compounds. Therefore, even if subjecting such steel sheet to the hot stamping step for usual heating and shaping without the preheating step, these grain boundary strengthening elements cannot be made to sufficiently segregate at the prior austenite grain boundaries. In this case, it is no longer possible to sufficiently manifest the grain boundary strengthening action based on the grain boundary segregation of these elements. For this reason, in this method, it is extremely important to preheat the steel sheet before the hot stamping step to a relatively high temperature of more than 1200° C. to thereby make the carbides and/or intermetallic compounds of the grain boundary strengthening elements sufficiently melt and make the grain boundary strengthening elements dissolve in the steel sheet. The upper limit of the heating temperature of the preheating is not particularly prescribed, but the heating temperature may for example be 1400° C. or less. Further, after heating, the steel sheet is cooled by an average cooling speed of 10° C./s or more down to less than 350° C. By cooling by an average cooling speed of 10° C./s or more down to less than 350° C., it is possible to keep the grain boundary strengthening elements dissolved in the steel sheet from precipitating as compounds. The upper limit of the average cooling speed is not particularly prescribed, but for example the average cooling speed may be 3000° C./s or less, 1500° C./s or less, or 1200° C./s or less. The upper limit of the cooling speed is not particularly prescribed. The cooling method is also not particularly limited and may be die cooling, water cooling, oil cooling, or gas cooling. In particular, even with an extremely high average cooling speed, cooling can be relatively easily realized by utilizing die cooling or water cooled die cooling.

[Hot Stamping Step]

Finally, the preheated steel sheet is hot stamped in the hot stamping step to produce a hot stamped body having the desired chemical composition and microstructure. In particular, the grain boundary strengthening elements dissolved in the steel sheet in the previous preheating step disperse to the austenite grain boundaries and segregate there at the time of heating in the hot stamping step. For this reason, due to the following shaping and cooling operation, it is possible to achieve the desired total amount of segregation of the grain boundary strengthening elements at the prior austenite grain boundaries after the martensite transformation. From the viewpoint of achieving such dispersion and segregation of the grain boundary strengthening elements and further obtaining a high area ratio of the hard structures, the steel sheet for hot stamping use has to be heated to a temperature region of 800° C. to 1000° C. and has to be held at that temperature region for 60 to 600 seconds. If the heating temperature is less than 800° C., the grain boundary strengthening elements are not sufficiently dispersed at the austenite grain boundaries and therefore sometimes the desired total amount of segregation at the grain boundary strengthening elements cannot be achieved and the hydrogen embrittlement resistance deteriorates and/or the structure is insufficiently austenized, the area ratio of the hard structures (at least one of martensite, bainite, and tempered martensite) becomes lower, and the tensile strength deteriorates. On the other hand, if the heating temperature exceeds 1000° C., sometimes grain boundary segregation excessively proceeds, the segregated grain boundary strengthening elements precipitate as carbides or intermetallic compounds, the amount of grain boundary segregation decreases, the desired total amount of segregation at the grain boundary strengthening elements cannot be achieved, and the hydrogen embrittlement resistance deteriorates. If the holding time is less than 60 seconds, in the same way as the case where the heating temperature is less than 800° C., sometimes the grain boundary strengthening elements do not sufficiently disperse to the austenite grain boundaries and for that reason the desired total amount of segregation at the grain boundary strengthening elements cannot be achieved and the hydrogen embrittlement resistance deteriorates and/or the austenization becomes insufficient, the area ratio of the hard structures (at least one of martensite, bainite, and tempered martensite) becomes lower, and the tensile strength deteriorates. If the holding time is more than 600 seconds, sometimes, due to the long period of heating, grain boundary segregation excessively proceeds, the grain boundary strengthening elements precipitate, and such precipitates become starting points of fracture and the hydrogen embrittlement resistance deteriorates.

The heating atmosphere is not particularly limited. Usual conditions are enough. For example, it may be an air atmosphere, a gas combustion atmosphere controlled in ratio of air and fuel, and a nitrogen atmosphere. The dew points may also be controlled in these gases. The steel sheet is held at a temperature region of 800° C. to 1000° C., then hot stamped. After hot stamping, it may be cooled down to a temperature region of 250° C. or less by an average cooling speed of 20° C./s or more.

As the heating method before hot stamping, for example, furnace heating by an electric furnace, gas furnace, etc., flame heating, ohmic heating, high frequency heating, induction heating, etc., may be mentioned.

The hot stamped body according to the present embodiment is obtained by the above method. After hot stamping, it may be tempered at 130 to 600° C. or coated, then bake hardened (BH). Further, part of the hot stamped body may be tempered by being irradiated by a laser, etc., to partially provide softened regions.

Below, examples will be used to explain the present invention in more detail, but the present invention is not limited to these examples in any way.

EXAMPLES

In the following examples, hot stamped bodies according to an embodiment of the present invention were produced under various conditions and the obtained tensile strength and hydrogen embrittlement resistance of the hot stamped bodies were investigated.

First, molten steels having the chemical compositions shown in Table 1 were cast by continuous casting to produce slabs. The balances besides the constituents shown in Table 1 were Fe and impurities. These slabs were heated to a 1100° C. or more temperature and rough rolled under predetermined conditions, then were finish rolled under conditions giving an end temperature of the finish rolling of 650° C. or more and coiled at the coiling temperature shown in Table 2. After the coiling, some of the hot rolled steel sheets were subjected to predetermined heat treatment for softening. Next, the obtained hot rolled steel sheets were cold rolled by 30 to 80% predetermined rolling reductions. Next, some of the steel sheets were subjected to annealing, covering, or temper rolling under predetermined conditions. Next, the obtained steel sheets were hot stamped under the conditions shown in Table 2. The heating atmosphere and heating method in the hot stamping step, except when clearly indicated otherwise, were a gas combustion atmosphere (air-fuel ratio 0.85) and furnace heating. After the hot stamping, some of the hot stamped bodies were tempered or partially softened.

TABLE 1

| | Chemical composition (mass %), balance: Fe and impurities | | | | | | | | | | | | | | | |
|---|---|---|---|---|---|---|---|---|---|---|---|---|---|---|---|---|
| Steel | C | P | S | N | O | Al | Nb | Ti | Mo | B | Si | Mn | Cr | Co | Ni | Cu |
| A1 | 0.37 | 0.007 | 0.0006 | 0.0023 | 0.0032 | 0.043 | 0.043 | 0.048 | 0.211 | 0.0018 | 0.45 | 0.34 | 0.28 | | | |
| A2 | 0.41 | 0.008 | 0.0007 | 0.0023 | 0.0014 | 0.040 | 0.041 | 0.026 | 0.152 | 0.0029 | 0.43 | 0.29 | 0.32 | | | |
| A3 | 0.43 | 0.006 | 0.0005 | 0.0031 | 0.0032 | 0.041 | 0.038 | 0.027 | 0.222 | 0.0023 | 0.43 | 0.33 | 0.28 | | | |
| A4 | 0.44 | 0.006 | 0.0016 | 0.0019 | 0.0034 | 0.041 | 0.034 | 0.040 | 0.213 | 0.0029 | | | | | | |
| A5 | 0.45 | 0.009 | 0.0016 | 0.0027 | 0.0032 | 0.041 | 0.026 | 0.046 | 0.184 | 0.0025 | 0.45 | 0.33 | 0.29 | | | |
| A6 | 0.46 | 0.005 | 0.0009 | 0.0025 | 0.0022 | 0.047 | 0.030 | 0.030 | 0.181 | 0.0020 | | | | | | |
| A7 | 0.47 | 0.007 | 0.0018 | 0.0031 | 0.0017 | 0.044 | 0.027 | 0.036 | 0.187 | 0.0027 | 0.44 | 0.31 | 0.28 | | | |
| A8 | 0.48 | 0.008 | 0.0016 | 0.0035 | 0.0034 | 0.038 | 0.023 | 0.024 | 0.155 | 0.0027 | 0.47 | 0.31 | 0.32 | | | |
| A9 | 0.53 | 0.006 | 0.0003 | 0.0025 | 0.0021 | 0.044 | 0.040 | 0.029 | 0.174 | 0.0029 | 0.43 | 0.30 | 0.30 | | | |
| A10 | 0.57 | 0.008 | 0.0008 | 0.0033 | 0.0020 | 0.037 | 0.018 | 0.040 | 0.198 | 0.0028 | | | | | | |
| A11 | 0.58 | 0.005 | 0.0015 | 0.0022 | 0.0023 | 0.048 | 0.036 | 0.035 | 0.175 | 0.0019 | 0.40 | 0.34 | 0.30 | | | |
| A12 | 0.62 | 0.005 | 0.0012 | 0.0022 | 0.0024 | 0.043 | 0.029 | 0.039 | 0.176 | 0.0028 | 0.42 | 0.32 | 0.28 | | | |
| A13 | 0.67 | 0.007 | 0.0007 | 0.0028 | 0.0027 | 0.046 | 0.032 | 0.043 | 0.160 | 0.0026 | 0.39 | 0.32 | 0.29 | | | |
| A14 | 0.72 | 0.007 | 0.0019 | 0.0028 | 0.0019 | 0.043 | 0.019 | 0.039 | 0.174 | 0.0017 | 0.40 | 0.31 | 0.25 | | | |
| B1 | 0.49 | 0.005 | 0.0019 | 0.0032 | 0.0026 | 0.045 | 0.036 | 0.033 | 0.234 | 0.0025 | | 0.32 | 0.27 | | | |
| B2 | 0.44 | 0.005 | 0.0020 | 0.0031 | 0.0024 | 0.042 | 0.034 | 0.045 | 0.205 | 0.0033 | 0.01 | 0.30 | 0.27 | | | |
| B3 | 0.44 | 0.009 | 0.0020 | 0.0022 | 0.0027 | 0.046 | 0.038 | 0.028 | 0.144 | 0.0019 | 0.04 | 0.33 | 0.31 | | | |
| B4 | 0.46 | 0.007 | 0.0018 | 0.0033 | 0.0025 | 0.045 | 0.029 | 0.043 | 0.181 | 0.0029 | 0.07 | 0.32 | 0.30 | | | |
| B5 | 0.46 | 0.004 | 0.0020 | 0.0024 | 0.0015 | 0.040 | 0.038 | 0.033 | 0.208 | 0.0018 | 0.12 | 0.31 | 0.34 | | | |
| B6 | 0.47 | 0.004 | 0.0016 | 0.0021 | 0.0022 | 0.038 | 0.024 | 0.046 | 0.189 | 0.0024 | 0.21 | 0.32 | 0.24 | | | |
| B7 | 0.49 | 0.008 | 0.0007 | 0.0023 | 0.0031 | 0.042 | 0.027 | 0.033 | 0.136 | 0.0034 | 0.25 | 0.32 | 0.27 | | | |
| B8 | 0.45 | 0.007 | 0.0017 | 0.0022 | 0.0025 | 0.044 | 0.028 | 0.035 | 0.186 | 0.0031 | 0.33 | 0.31 | 0.27 | | | |
| B9 | 0.46 | 0.009 | 0.0003 | 0.0019 | 0.0036 | 0.046 | 0.018 | 0.048 | 0.165 | 0.0024 | 0.43 | 0.33 | 0.23 | | | |
| B10 | 0.44 | 0.005 | 0.0017 | 0.0030 | 0.0018 | 0.047 | 0.033 | 0.034 | 0.186 | 0.0024 | 0.61 | 0.32 | 0.33 | | | |
| B11 | 0.48 | 0.004 | 0.0011 | 0.0033 | 0.0030 | 0.037 | 0.025 | 0.040 | 0.165 | 0.0019 | 0.85 | 0.30 | 0.24 | | | |
| B12 | 0.47 | 0.006 | 0.0020 | 0.0031 | 0.0019 | 0.042 | 0.019 | 0.035 | 0.150 | 0.0019 | 1.81 | 0.34 | 0.29 | | | |
| B13 | 0.52 | 0.005 | 0.0016 | 0.0023 | 0.0035 | 0.040 | 0.024 | 0.044 | 0.180 | 0.0029 | 2.42 | 0.29 | 0.26 | | | |
| B14 | 0.52 | 0.007 | 0.0006 | 0.0024 | 0.0026 | 0.040 | 0.032 | 0.035 | 0.141 | 0.0027 | 2.70 | 0.33 | 0.26 | | | |
| B15 | 0.46 | 0.009 | 0.0018 | 0.0032 | 0.0029 | 0.044 | 0.029 | 0.046 | 0.128 | 0.0034 | 3.04 | 0.31 | 0.25 | | | |
| C1 | 0.44 | 0.008 | 0.0016 | 0.0033 | 0.0025 | 0.044 | 0.024 | 0.046 | 0.157 | 0.0019 | 0.42 | | 0.35 | | | |
| C2 | 0.45 | 0.005 | 0.0019 | 0.0032 | 0.0020 | 0.043 | 0.031 | 0.042 | 0.214 | 0.0031 | 0.40 | 0.15 | 0.29 | | | |
| C3 | 0.44 | 0.009 | 0.0003 | 0.0024 | 0.0016 | 0.045 | 0.035 | 0.033 | 0.235 | 0.0024 | 0.44 | 0.28 | 0.25 | | | |
| C4 | 0.45 | 0.007 | 0.0008 | 0.0029 | 0.0018 | 0.052 | 0.032 | 0.046 | 0.142 | 0.0031 | 0.41 | 0.32 | 0.31 | | | |
| C5 | 0.48 | 0.004 | 0.0008 | 0.0027 | 0.0019 | 0.050 | 0.019 | 0.045 | 0.174 | 0.0031 | 0.41 | 0.38 | 0.26 | | | |
| C6 | 0.47 | 0.006 | 0.0016 | 0.0024 | 0.0033 | 0.046 | 0.040 | 0.046 | 0.172 | 0.0033 | 0.40 | 0.41 | 0.28 | | | |
| C7 | 0.44 | 0.005 | 0.0015 | 0.0024 | 0.0016 | 0.048 | 0.017 | 0.032 | 0.214 | 0.0017 | 0.45 | 0.42 | 0.26 | | | |
| C8 | 0.47 | 0.009 | 0.0018 | 0.0025 | 0.0021 | 0.039 | 0.017 | 0.025 | 0.155 | 0.0034 | 0.41 | 0.45 | 0.25 | | | |
| C9 | 0.48 | 0.008 | 0.0021 | 0.0027 | 0.0026 | 0.043 | 0.028 | 0.043 | 0.206 | 0.0020 | 0.47 | 0.46 | 0.32 | | | |
| C10 | 0.49 | 0.008 | 0.0022 | 0.0027 | 0.0022 | 0.045 | 0.029 | 0.030 | 0.139 | 0.0031 | 0.47 | 0.47 | 0.33 | | | |
| C11 | 0.44 | 0.007 | 0.0017 | 0.0020 | 0.0019 | 0.046 | 0.031 | 0.032 | 0.198 | 0.0027 | 0.42 | 0.48 | 0.34 | | | |
| C12 | 0.46 | 0.007 | 0.0011 | 0.0019 | 0.0018 | 0.043 | 0.027 | 0.032 | 0.204 | 0.0027 | 0.43 | 0.49 | 0.32 | | | |
| C13 | 0.49 | 0.006 | 0.0018 | 0.0025 | 0.0034 | 0.048 | 0.040 | 0.042 | 0.182 | 0.0017 | 0.44 | 0.49 | 0.29 | | | |
| C14 | 0.47 | 0.004 | 0.0004 | 0.0022 | 0.0019 | 0.045 | 0.030 | 0.035 | 0.193 | 0.0030 | 0.42 | 0.55 | 0.25 | | | |
| D1 | 0.45 | 0.001 | 0.0008 | 0.0035 | 0.0035 | 0.048 | 0.027 | 0.036 | 0.200 | 0.0022 | 0.42 | 0.29 | 0.31 | | | |
| D2 | 0.46 | 0.004 | 0.0014 | 0.0029 | 0.0023 | 0.050 | 0.036 | 0.031 | 0.135 | 0.0020 | 0.42 | 0.33 | 0.32 | | | |
| D3 | 0.46 | 0.006 | 0.0020 | 0.0027 | 0.0015 | 0.048 | 0.025 | 0.043 | 0.236 | 0.0021 | 0.43 | 0.33 | 0.29 | | | |
| D4 | 0.46 | 0.008 | 0.0005 | 0.0032 | 0.0014 | 0.045 | 0.036 | 0.030 | 0.126 | 0.0034 | 0.47 | 0.34 | 0.25 | | | |
| D5 | 0.44 | 0.011 | 0.0003 | 0.0025 | 0.0029 | 0.049 | 0.018 | 0.031 | 0.178 | 0.0017 | 0.43 | 0.30 | 0.25 | | | |
| D6 | 0.46 | 0.042 | 0.0009 | 0.0027 | 0.0017 | 0.042 | 0.030 | 0.047 | 0.172 | 0.0019 | 0.38 | 0.33 | 0.26 | | | |
| D7 | 0.47 | 0.072 | 0.0013 | 0.0028 | 0.0021 | 0.046 | 0.043 | 0.026 | 0.137 | 0.0029 | 0.41 | 0.31 | 0.26 | | | |
| D8 | 0.47 | 0.090 | 0.0008 | 0.0025 | 0.0031 | 0.048 | 0.042 | 0.038 | 0.237 | 0.0029 | 0.40 | 0.31 | 0.31 | | | |
| D9 | 0.48 | 0.120 | 0.0015 | 0.0030 | 0.0029 | 0.047 | 0.032 | 0.047 | 0.203 | 0.0020 | 0.45 | 0.34 | 0.27 | | | |
| E1 | 0.45 | 0.007 | 0.0001 | 0.0035 | 0.0018 | 0.046 | 0.039 | 0.030 | 0.231 | 0.0021 | 0.41 | 0.30 | 0.28 | | | |
| E2 | 0.46 | 0.009 | 0.0003 | 0.0034 | 0.0027 | 0.044 | 0.038 | 0.044 | 0.136 | 0.0025 | 0.38 | 0.30 | 0.30 | | | |
| E3 | 0.48 | 0.009 | 0.0008 | 0.0021 | 0.0014 | 0.050 | 0.018 | 0.032 | 0.173 | 0.0021 | 0.43 | 0.30 | 0.24 | | | |
| E4 | 0.47 | 0.007 | 0.0011 | 0.0031 | 0.0030 | 0.046 | 0.028 | 0.032 | 0.195 | 0.0019 | 0.40 | 0.34 | 0.30 | | | |
| E5 | 0.45 | 0.005 | 0.0021 | 0.0033 | 0.0023 | 0.039 | 0.038 | 0.034 | 0.138 | 0.0028 | 0.41 | 0.35 | 0.36 | | | |
| E6 | 0.47 | 0.009 | 0.0045 | 0.0034 | 0.0027 | 0.047 | 0.035 | 0.035 | 0.195 | 0.0021 | 0.43 | 0.31 | 0.26 | | | |
| E7 | 0.49 | 0.006 | 0.0068 | 0.0021 | 0.0023 | 0.038 | 0.023 | 0.044 | 0.224 | 0.0033 | 0.46 | 0.32 | 0.31 | | | |
| E8 | 0.46 | 0.004 | 0.0090 | 0.0031 | 0.0019 | 0.046 | 0.036 | 0.032 | 0.156 | 0.0030 | 0.45 | 0.32 | 0.29 | | | |

TABLE 1-continued

| | | | | | | | | | | | | | |
|---|---|---|---|---|---|---|---|---|---|---|---|---|---|
| E9 | 0.45 | 0.008 | 0.0156 | 0.0019 | 0.0034 | 0.041 | 0.040 | 0.045 | 0.228 | 0.0021 | 0.43 | 0.34 | 0.24 |
| F1 | 0.43 | 0.007 | 0.0006 | 0.0002 | 0.0025 | 0.039 | 0.029 | 0.037 | 0.177 | 0.0018 | 0.41 | 0.31 | 0.28 |
| F2 | 0.49 | 0.005 | 0.0016 | 0.0008 | 0.0023 | 0.049 | 0.033 | 0.027 | 0.193 | 0.0022 | 0.43 | 0.31 | 0.31 |
| F3 | 0.44 | 0.004 | 0.0004 | 0.0018 | 0.0036 | 0.044 | 0.029 | 0.027 | 0.140 | 0.0022 | 0.45 | 0.31 | 0.23 |
| F4 | 0.46 | 0.005 | 0.0022 | 0.0029 | 0.0035 | 0.046 | 0.042 | 0.044 | 0.148 | 0.0021 | 0.40 | 0.35 | 0.27 |
| F5 | 0.49 | 0.005 | 0.0003 | 0.0045 | 0.0022 | 0.047 | 0.021 | 0.034 | 0.161 | 0.0029 | 0.40 | 0.32 | 0.33 |
| F6 | 0.43 | 0.004 | 0.0008 | 0.0064 | 0.0024 | 0.041 | 0.040 | 0.040 | 0.140 | 0.0021 | 0.39 | 0.31 | 0.31 |
| F7 | 0.45 | 0.009 | 0.0004 | 0.0103 | 0.0028 | 0.043 | 0.039 | 0.041 | 0.182 | 0.0028 | 0.43 | 0.34 | 0.32 |
| F8 | 0.45 | 0.004 | 0.0016 | 0.0174 | 0.0022 | 0.046 | 0.026 | 0.038 | 0.170 | 0.0030 | 0.45 | 0.33 | 0.23 |
| F9 | 0.45 | 0.007 | 0.0003 | 0.0213 | 0.0033 | 0.042 | 0.041 | 0.035 | 0.207 | 0.0024 | 0.39 | 0.32 | 0.27 |
| G1 | 0.45 | 0.004 | 0.0016 | 0.0029 | 0.0006 | 0.045 | 0.035 | 0.026 | 0.217 | 0.0019 | 0.42 | 0.34 | 0.30 |
| G2 | 0.45 | 0.007 | 0.0008 | 0.0022 | 0.0013 | 0.051 | 0.036 | 0.041 | 0.176 | 0.0020 | 0.42 | 0.32 | 0.22 |
| G3 | 0.44 | 0.007 | 0.0012 | 0.0020 | 0.0023 | 0.044 | 0.037 | 0.037 | 0.206 | 0.0023 | 0.45 | 0.33 | 0.33 |
| G4 | 0.43 | 0.005 | 0.0021 | 0.0025 | 0.0036 | 0.048 | 0.023 | 0.027 | 0.197 | 0.0032 | 0.43 | 0.33 | 0.32 |
| G5 | 0.47 | 0.007 | 0.0013 | 0.0019 | 0.0052 | 0.044 | 0.023 | 0.028 | 0.153 | 0.0025 | 0.46 | 0.32 | 0.26 |
| G6 | 0.45 | 0.008 | 0.0012 | 0.0027 | 0.0087 | 0.051 | 0.035 | 0.045 | 0.166 | 0.0019 | 0.45 | 0.35 | 0.29 |
| G7 | 0.48 | 0.004 | 0.0003 | 0.0020 | 0.0189 | 0.047 | 0.031 | 0.041 | 0.146 | 0.0023 | 0.44 | 0.33 | 0.27 |
| G8 | 0.48 | 0.009 | 0.0012 | 0.0023 | 0.0237 | 0.037 | 0.037 | 0.041 | 0.150 | 0.0030 | 0.38 | 0.30 | 0.27 |
| H1 | 0.48 | 0.004 | 0.0004 | 0.0024 | 0.0035 | 0.0007 | 0.038 | 0.027 | 0.208 | 0.0029 | 0.41 | 0.31 | 0.32 |
| H2 | 0.46 | 0.005 | 0.0016 | 0.0025 | 0.0034 | 0.001 | 0.025 | 0.034 | 0.179 | 0.0025 | 0.43 | 0.34 | 0.26 |
| H3 | 0.46 | 0.006 | 0.0007 | 0.0022 | 0.0030 | 0.005 | 0.030 | 0.046 | 0.143 | 0.0019 | 0.45 | 0.32 | 0.32 |
| H4 | 0.44 | 0.009 | 0.0012 | 0.0024 | 0.0016 | 0.015 | 0.040 | 0.040 | 0.222 | 0.0027 | 0.40 | 0.30 | 0.30 |
| H5 | 0.48 | 0.006 | 0.0020 | 0.0022 | 0.0025 | 0.024 | 0.031 | 0.042 | 0.142 | 0.0030 | 0.42 | 0.34 | 0.26 |
| H6 | 0.44 | 0.008 | 0.0012 | 0.0021 | 0.0032 | 0.038 | 0.037 | 0.032 | 0.212 | 0.0020 | 0.40 | 0.30 | 0.30 |
| H7 | 0.46 | 0.009 | 0.0005 | 0.0025 | 0.0018 | 0.049 | 0.030 | 0.039 | 0.189 | 0.0020 | 0.42 | 0.34 | 0.30 |
| H8 | 0.44 | 0.006 | 0.0016 | 0.0026 | 0.0024 | 0.067 | 0.026 | 0.047 | 0.132 | 0.0029 | 0.38 | 0.33 | 0.27 |
| H9 | 0.48 | 0.006 | 0.0004 | 0.0026 | 0.0014 | 0.085 | 0.019 | 0.037 | 0.140 | 0.0033 | 0.44 | 0.33 | 0.35 |
| H10 | 0.46 | 0.006 | 0.0007 | 0.0021 | 0.0022 | 0.132 | 0.025 | 0.044 | 0.174 | 0.0032 | 0.40 | 0.31 | 0.29 |
| H11 | 0.45 | 0.008 | 0.0018 | 0.0019 | 0.0021 | 0.256 | 0.033 | 0.038 | 0.181 | 0.0030 | 0.45 | 0.33 | 0.34 |
| H12 | 0.46 | 0.009 | 0.0006 | 0.0018 | 0.0032 | 0.350 | 0.027 | 0.033 | 0.209 | 0.0021 | 0.44 | 0.29 | 0.30 |
| H13 | 0.45 | 0.007 | 0.0005 | 0.0023 | 0.0032 | 0.486 | 0.035 | 0.031 | 0.156 | 0.0023 | 0.37 | 0.31 | 0.31 |
| H14 | 0.47 | 0.006 | 0.0013 | 0.0029 | 0.0029 | 0.521 | 0.032 | 0.037 | 0.146 | 0.0027 | 0.46 | 0.32 | 0.30 |
| I1 | 0.44 | 0.009 | 0.0007 | 0.0023 | 0.0018 | 0.048 | 0.0006 | 0.038 | 0.128 | 0.0019 | 0.42 | 0.30 | 0.35 |
| I2 | 0.46 | 0.008 | 0.0015 | 0.0035 | 0.0029 | 0.045 | 0.001 | 0.037 | 0.218 | 0.0019 | 0.41 | 0.34 | 0.25 |
| I3 | 0.44 | 0.005 | 0.0018 | 0.0025 | 0.0030 | 0.048 | 0.004 | 0.028 | 0.217 | 0.0019 | 0.44 | 0.31 | 0.25 |
| I4 | 0.46 | 0.005 | 0.0015 | 0.0029 | 0.0016 | 0.045 | 0.007 | 0.045 | 0.217 | 0.0030 | 0.47 | 0.35 | 0.31 |
| I5 | 0.44 | 0.005 | 0.0008 | 0.0034 | 0.0016 | 0.043 | 0.012 | 0.042 | 0.227 | 0.0030 | 0.38 | 0.32 | 0.28 |
| I6 | 0.48 | 0.008 | 0.0010 | 0.0024 | 0.0035 | 0.039 | 0.018 | 0.034 | 0.136 | 0.0029 | 0.41 | 0.34 | 0.30 |
| I7 | 0.44 | 0.005 | 0.0011 | 0.0021 | 0.0022 | 0.047 | 0.024 | 0.037 | 0.129 | 0.0030 | 0.42 | 0.30 | 0.32 |
| I8 | 0.48 | 0.004 | 0.0010 | 0.0028 | 0.0019 | 0.041 | 0.036 | 0.035 | 0.192 | 0.0018 | 0.41 | 0.30 | 0.27 |
| I9 | 0.44 | 0.004 | 0.0017 | 0.0029 | 0.0024 | 0.039 | 0.040 | 0.030 | 0.137 | 0.0026 | 0.42 | 0.33 | 0.29 |
| I10 | 0.45 | 0.004 | 0.0006 | 0.0019 | 0.0030 | 0.049 | 0.056 | 0.026 | 0.158 | 0.0030 | 0.42 | 0.30 | 0.26 |
| I11 | 0.48 | 0.009 | 0.0021 | 0.0024 | 0.0027 | 0.044 | 0.068 | 0.040 | 0.228 | 0.0024 | 0.41 | 0.35 | 0.29 |
| I12 | 0.48 | 0.004 | 0.0021 | 0.0019 | 0.0013 | 0.047 | 0.081 | 0.047 | 0.191 | 0.0024 | 0.40 | 0.32 | 0.31 |
| I13 | 0.46 | 0.004 | 0.0009 | 0.0019 | 0.0029 | 0.042 | 0.088 | 0.033 | 0.152 | 0.0020 | 0.39 | 0.32 | 0.32 |
| I14 | 0.45 | 0.004 | 0.0010 | 0.0033 | 0.0027 | 0.049 | 0.120 | 0.036 | 0.156 | 0.0025 | 0.46 | 0.32 | 0.28 |
| J1 | 0.48 | 0.006 | 0.0016 | 0.0021 | 0.0028 | 0.051 | 0.044 | 0.007 | 0.198 | 0.0030 | 0.38 | 0.31 | 0.28 |
| J2 | 0.46 | 0.005 | 0.0013 | 0.0022 | 0.0025 | 0.046 | 0.032 | 0.011 | 0.185 | 0.0025 | 0.42 | 0.33 | 0.33 |
| J3 | 0.43 | 0.005 | 0.0018 | 0.0029 | 0.0023 | 0.046 | 0.043 | 0.016 | 0.196 | 0.0025 | 0.42 | 0.33 | 0.26 |
| J4 | 0.45 | 0.005 | 0.0014 | 0.0018 | 0.0019 | 0.051 | 0.021 | 0.023 | 0.221 | 0.0029 | 0.40 | 0.31 | 0.31 |
| J5 | 0.46 | 0.008 | 0.0008 | 0.0032 | 0.0029 | 0.040 | 0.022 | 0.026 | 0.133 | 0.0026 | 0.39 | 0.33 | 0.26 |
| J6 | 0.45 | 0.004 | 0.0021 | 0.0030 | 0.0017 | 0.047 | 0.031 | 0.030 | 0.175 | 0.0028 | 0.43 | 0.33 | 0.24 |
| J7 | 0.45 | 0.008 | 0.0003 | 0.0030 | 0.0013 | 0.048 | 0.027 | 0.046 | 0.135 | 0.0018 | 0.37 | 0.31 | 0.33 |
| J8 | 0.47 | 0.008 | 0.0020 | 0.0028 | 0.0035 | 0.050 | 0.033 | 0.056 | 0.198 | 0.0021 | 0.43 | 0.31 | 0.28 |
| J9 | 0.46 | 0.008 | 0.0013 | 0.0029 | 0.0025 | 0.047 | 0.039 | 0.081 | 0.144 | 0.0024 | 0.45 | 0.35 | 0.24 |
| J10 | 0.47 | 0.005 | 0.0015 | 0.0023 | 0.0020 | 0.046 | 0.023 | 0.114 | 0.226 | 0.0027 | 0.44 | 0.30 | 0.29 |
| J11 | 0.45 | 0.008 | 0.0013 | 0.0018 | 0.0025 | 0.048 | 0.042 | 0.183 | 0.132 | 0.0023 | 0.44 | 0.31 | 0.30 |
| J12 | 0.45 | 0.008 | 0.0009 | 0.0021 | 0.0018 | 0.041 | 0.025 | 0.213 | 0.179 | 0.0026 | 0.40 | 0.30 | 0.28 |
| K1 | 0.45 | 0.004 | 0.0007 | 0.0031 | 0.0020 | 0.041 | 0.037 | 0.046 | 0.190 | 0.0021 | 0.44 | 0.33 | |
| K2 | 0.45 | 0.004 | 0.0006 | 0.0026 | 0.0023 | 0.037 | 0.025 | 0.029 | 0.207 | 0.0024 | 0.40 | 0.33 | 0.01 |
| K3 | 0.48 | 0.004 | 0.0006 | 0.0022 | 0.0021 | 0.039 | 0.038 | 0.037 | 0.218 | 0.0019 | 0.39 | 0.34 | 0.05 |
| K4 | 0.46 | 0.009 | 0.0012 | 0.0028 | 0.0020 | 0.039 | 0.025 | 0.033 | 0.126 | 0.0035 | 0.42 | 0.31 | 0.09 |
| K5 | 0.43 | 0.007 | 0.0016 | 0.0018 | 0.0016 | 0.048 | 0.031 | 0.032 | 0.220 | 0.0019 | 0.39 | 0.34 | 0.13 |
| K6 | 0.47 | 0.004 | 0.0016 | 0.0022 | 0.0018 | 0.041 | 0.037 | 0.036 | 0.181 | 0.0025 | 0.40 | 0.35 | 0.19 |
| K7 | 0.48 | 0.008 | 0.0018 | 0.0032 | 0.0034 | 0.046 | 0.021 | 0.032 | 0.192 | 0.0026 | 0.47 | 0.31 | 0.21 |
| K8 | 0.43 | 0.008 | 0.0022 | 0.0020 | 0.0024 | 0.045 | 0.037 | 0.029 | 0.179 | 0.0026 | 0.42 | 0.35 | 0.27 |
| K9 | 0.45 | 0.004 | 0.0010 | 0.0026 | 0.0022 | 0.050 | 0.038 | 0.041 | 0.224 | 0.0025 | 0.43 | 0.32 | 0.34 |
| K10 | 0.44 | 0.006 | 0.0003 | 0.0030 | 0.0019 | 0.053 | 0.023 | 0.043 | 0.228 | 0.0018 | 0.40 | 0.33 | 0.41 |
| K11 | 0.45 | 0.007 | 0.0005 | 0.0029 | 0.0028 | 0.037 | 0.032 | 0.033 | 0.170 | 0.0030 | 0.44 | 0.32 | 0.63 |
| K12 | 0.43 | 0.006 | 0.0004 | 0.0022 | 0.0030 | 0.052 | 0.040 | 0.035 | 0.204 | 0.0028 | 0.39 | 0.30 | 0.74 |
| K13 | 0.48 | 0.006 | 0.0011 | 0.0026 | 0.0022 | 0.045 | 0.027 | 0.037 | 0.131 | 0.0021 | 0.42 | 0.31 | 0.93 |
| K14 | 0.44 | 0.006 | 0.0012 | 0.0031 | 0.0034 | 0.050 | 0.038 | 0.037 | 0.210 | 0.0021 | 0.43 | 0.32 | 1.08 |
| L1 | 0.45 | 0.009 | 0.0003 | 0.0026 | 0.0034 | 0.039 | 0.019 | 0.036 | 0.009 | 0.0018 | 0.43 | 0.30 | 0.32 |
| L2 | 0.45 | 0.004 | 0.0014 | 0.0026 | 0.0029 | 0.052 | 0.030 | 0.034 | 0.012 | 0.0033 | 0.41 | 0.33 | 0.25 |
| L3 | 0.46 | 0.004 | 0.0016 | 0.0021 | 0.0026 | 0.051 | 0.037 | 0.039 | 0.011 | 0.0028 | 0.44 | 0.31 | 0.32 |
| L4 | 0.45 | 0.004 | 0.0008 | 0.0032 | 0.0034 | 0.037 | 0.018 | 0.040 | 0.054 | 0.0026 | 0.45 | 0.34 | 0.24 |
| L5 | 0.44 | 0.005 | 0.0008 | 0.0022 | 0.0023 | 0.040 | 0.031 | 0.029 | 0.140 | 0.0033 | 0.40 | 0.34 | 0.30 |
| L6 | 0.44 | 0.009 | 0.0015 | 0.0022 | 0.0032 | 0.043 | 0.024 | 0.029 | 0.175 | 0.0024 | 0.39 | 0.29 | 0.28 |
| L7 | 0.47 | 0.007 | 0.0008 | 0.0029 | 0.0022 | 0.048 | 0.037 | 0.028 | 0.241 | 0.0026 | 0.42 | 0.35 | 0.31 |
| L8 | 0.47 | 0.004 | 0.0023 | 0.0024 | 0.0027 | 0.039 | 0.039 | 0.027 | 0.480 | 0.0030 | 0.39 | 0.32 | 0.24 |

TABLE 1-continued

| | | | | | | | | | | | | | | | | |
|---|---|---|---|---|---|---|---|---|---|---|---|---|---|---|---|---|
| L9 | 0.46 | 0.007 | 0.0009 | 0.0024 | 0.0018 | 0.049 | 0.021 | 0.039 | 0.667 | 0.0023 | 0.45 | 0.32 | 0.27 | | | |
| L10 | 0.46 | 0.008 | 0.0020 | 0.0029 | 0.0037 | 0.042 | 0.039 | 0.041 | 1.032 | 0.0018 | 0.42 | 0.30 | 0.29 | | | |
| L11 | 0.47 | 0.005 | 0.0019 | 0.0035 | 0.0015 | 0.040 | 0.032 | 0.031 | 1.454 | 0.0019 | 0.39 | 0.31 | 0.25 | | | |
| L12 | 0.47 | 0.009 | 0.0010 | 0.0027 | 0.0021 | 0.048 | 0.038 | 0.028 | 1.921 | 0.0031 | 0.41 | 0.32 | 0.28 | | | |
| L13 | 0.47 | 0.006 | 0.0022 | 0.0032 | 0.0032 | 0.046 | 0.027 | 0.025 | 2.112 | 0.0019 | 0.40 | 0.32 | 0.25 | | | |
| M1 | 0.47 | 0.007 | 0.0018 | 0.0031 | 0.0033 | 0.048 | 0.019 | 0.027 | 0.137 | 0.0002 | 0.40 | 0.30 | 0.33 | | | |
| M2 | 0.48 | 0.007 | 0.0016 | 0.0021 | 0.0023 | 0.053 | 0.036 | 0.025 | 0.182 | 0.0006 | 0.40 | 0.29 | 0.33 | | | |
| M3 | 0.47 | 0.008 | 0.0019 | 0.0024 | 0.0036 | 0.041 | 0.023 | 0.034 | 0.179 | 0.0011 | 0.41 | 0.31 | 0.26 | | | |
| M4 | 0.45 | 0.004 | 0.0013 | 0.0026 | 0.0032 | 0.048 | 0.034 | 0.032 | 0.202 | 0.0018 | 0.41 | 0.31 | 0.25 | | | |
| M5 | 0.47 | 0.006 | 0.0019 | 0.0021 | 0.0033 | 0.044 | 0.031 | 0.042 | 0.174 | 0.0022 | 0.44 | 0.31 | 0.33 | | | |
| M6 | 0.44 | 0.005 | 0.0012 | 0.0021 | 0.0023 | 0.051 | 0.026 | 0.044 | 0.152 | 0.0032 | 0.47 | 0.29 | 0.33 | | | |
| M7 | 0.47 | 0.004 | 0.0009 | 0.0025 | 0.0030 | 0.045 | 0.024 | 0.025 | 0.133 | 0.0046 | 0.39 | 0.31 | 0.32 | | | |
| M8 | 0.45 | 0.007 | 0.0022 | 0.0021 | 0.0019 | 0.046 | 0.031 | 0.044 | 0.190 | 0.0076 | 0.43 | 0.35 | 0.24 | | | |
| M9 | 0.47 | 0.008 | 0.0009 | 0.0033 | 0.0034 | 0.040 | 0.034 | 0.038 | 0.140 | 0.0121 | 0.40 | 0.31 | 0.30 | | | |
| M10 | 0.45 | 0.007 | 0.0009 | 0.0023 | 0.0033 | 0.042 | 0.039 | 0.035 | 0.131 | 0.0182 | 0.44 | 0.34 | 0.26 | | | |
| M11 | 0.44 | 0.009 | 0.0016 | 0.0030 | 0.0031 | 0.047 | 0.02 | 0.042 | 0.171 | 0.0221 | 0.44 | 0.32 | 0.26 | | | |
| N1 | 0.45 | 0.007 | 0.0006 | 0.0029 | 0.0019 | 0.045 | 0.018 | 0.036 | 0.137 | 0.0032 | 0.43 | 0.33 | 0.30 | 0.05 | | |
| N2 | 0.44 | 0.004 | 0.0006 | 0.0024 | 0.0023 | 0.049 | 0.038 | 0.028 | 0.169 | 0.0017 | 0.45 | 0.33 | 0.28 | 0.12 | | |
| N3 | 0.44 | 0.005 | 0.0020 | 0.0030 | 0.0016 | 0.051 | 0.019 | 0.029 | 0.153 | 0.0034 | 0.40 | 0.31 | 0.29 | 0.23 | | |
| N4 | 0.46 | 0.005 | 0.0019 | 0.0033 | 0.0014 | 0.049 | 0.035 | 0.026 | 0.136 | 0.0032 | 0.40 | 0.33 | 0.33 | 0.41 | | |
| N5 | 0.47 | 0.007 | 0.0018 | 0.0032 | 0.0016 | 0.043 | 0.030 | 0.038 | 0.172 | 0.0023 | 0.42 | 0.30 | 0.24 | 0.64 | | |
| N6 | 0.45 | 0.006 | 0.0008 | 0.0026 | 0.0023 | 0.051 | 0.042 | 0.037 | 0.202 | 0.0024 | 0.42 | 0.31 | 0.31 | 0.81 | | |
| N7 | 0.45 | 0.007 | 0.0017 | 0.0030 | 0.0020 | 0.039 | 0.037 | 0.030 | 0.212 | 0.0026 | 0.43 | 0.31 | 0.28 | 1.05 | | |
| N8 | 0.48 | 0.006 | 0.0014 | 0.0034 | 0.0019 | 0.051 | 0.034 | 0.033 | 0.134 | 0.0020 | 0.39 | 0.33 | 0.26 | 1.31 | | |
| N9 | 0.44 | 0.005 | 0.0004 | 0.0030 | 0.0018 | 0.052 | 0.035 | 0.042 | 0.203 | 0.0030 | 0.45 | 0.35 | 0.27 | 1.63 | | |
| N10 | 0.45 | 0.004 | 0.0008 | 0.0030 | 0.0026 | 0.047 | 0.025 | 0.043 | 0.154 | 0.0020 | 0.46 | 0.30 | 0.24 | 1.77 | | |
| N11 | 0.47 | 0.007 | 0.0006 | 0.0028 | 0.0024 | 0.048 | 0.038 | 0.028 | 0.212 | 0.0023 | 0.42 | 0.32 | 0.27 | 1.83 | | |
| N12 | 0.47 | 0.004 | 0.0015 | 0.0022 | 0.0027 | 0.046 | 0.029 | 0.033 | 0.201 | 0.0028 | 0.38 | 0.32 | 0.33 | 2.43 | | |
| N13 | 0.45 | 0.008 | 0.0017 | 0.0019 | 0.0028 | 0.040 | 0.025 | 0.027 | 0.190 | 0.0026 | 0.44 | 0.29 | 0.26 | 3.51 | | |
| O1 | 0.44 | 0.006 | 0.0015 | 0.0029 | 0.0029 | 0.042 | 0.018 | 0.028 | 0.153 | 0.0027 | 0.41 | 0.31 | 0.28 | | 0.02 | |
| O2 | 0.45 | 0.006 | 0.0015 | 0.0025 | 0.0031 | 0.048 | 0.034 | 0.041 | 0.125 | 0.0028 | 0.42 | 0.33 | 0.31 | | 0.13 | |
| O3 | 0.48 | 0.004 | 0.0012 | 0.0031 | 0.0021 | 0.049 | 0.022 | 0.036 | 0.147 | 0.0021 | 0.37 | 0.33 | 0.33 | | 0.23 | |
| O4 | 0.46 | 0.006 | 0.0017 | 0.0019 | 0.0027 | 0.048 | 0.025 | 0.042 | 0.156 | 0.0022 | 0.42 | 0.34 | 0.25 | | 0.39 | |
| O5 | 0.44 | 0.004 | 0.0019 | 0.0033 | 0.0030 | 0.050 | 0.039 | 0.028 | 0.148 | 0.0026 | 0.44 | 0.31 | 0.26 | | 0.83 | |
| O6 | 0.47 | 0.008 | 0.0022 | 0.0025 | 0.0026 | 0.043 | 0.019 | 0.045 | 0.202 | 0.0030 | 0.39 | 0.33 | 0.28 | | 1.22 | |
| O7 | 0.48 | 0.005 | 0.0016 | 0.0021 | 0.0014 | 0.044 | 0.031 | 0.027 | 0.164 | 0.0028 | 0.44 | 0.29 | 0.33 | | 1.65 | |
| O8 | 0.44 | 0.004 | 0.0011 | 0.0023 | 0.0027 | 0.044 | 0.039 | 0.035 | 0.168 | 0.0026 | 0.41 | 0.34 | 0.29 | | 1.90 | |
| O9 | 0.46 | 0.009 | 0.0005 | 0.0023 | 0.0017 | 0.049 | 0.031 | 0.035 | 0.171 | 0.0029 | 0.42 | 0.34 | 0.29 | | 2.05 | |
| O10 | 0.46 | 0.009 | 0.0017 | 0.0019 | 0.0025 | 0.037 | 0.019 | 0.034 | 0.169 | 0.0029 | 0.46 | 0.32 | 0.31 | | 2.69 | |
| O11 | 0.47 | 0.008 | 0.0010 | 0.0025 | 0.0016 | 0.039 | 0.029 | 0.028 | 0.162 | 0.0030 | 0.41 | 0.34 | 0.35 | | 2.82 | |
| O12 | 0.45 | 0.006 | 0.0018 | 0.0026 | 0.0032 | 0.048 | 0.022 | 0.025 | 0.211 | 0.0027 | 0.43 | 0.31 | 0.33 | | 2.85 | |
| P1 | 0.49 | 0.005 | 0.0015 | 0.0032 | 0.0026 | 0.040 | 0.022 | 0.041 | 0.136 | 0.0034 | 0.42 | 0.32 | 0.27 | | | 0.05 |
| P2 | 0.46 | 0.005 | 0.0020 | 0.0030 | 0.0022 | 0.042 | 0.026 | 0.026 | 0.171 | 0.0025 | 0.42 | 0.33 | 0.22 | | | 0.11 |
| P3 | 0.46 | 0.006 | 0.0008 | 0.0027 | 0.0019 | 0.042 | 0.018 | 0.033 | 0.153 | 0.0020 | 0.45 | 0.31 | 0.32 | | | 0.23 |
| P4 | 0.45 | 0.004 | 0.0006 | 0.0032 | 0.0017 | 0.053 | 0.023 | 0.031 | 0.129 | 0.0025 | 0.38 | 0.33 | 0.31 | | | 0.42 |
| P5 | 0.47 | 0.007 | 0.0016 | 0.0024 | 0.0015 | 0.047 | 0.026 | 0.040 | 0.172 | 0.0020 | 0.47 | 0.34 | 0.26 | | | 0.81 |
| P6 | 0.45 | 0.008 | 0.0012 | 0.0028 | 0.0022 | 0.042 | 0.023 | 0.031 | 0.159 | 0.0025 | 0.37 | 0.31 | 0.31 | | | 1.28 |
| P7 | 0.43 | 0.006 | 0.0009 | 0.0029 | 0.0018 | 0.043 | 0.022 | 0.042 | 0.238 | 0.0026 | 0.41 | 0.30 | 0.23 | | | 1.63 |
| P8 | 0.44 | 0.007 | 0.0008 | 0.0018 | 0.0028 | 0.047 | 0.024 | 0.031 | 0.214 | 0.0021 | 0.46 | 0.32 | 0.34 | | | 1.88 |
| P9 | 0.45 | 0.008 | 0.0016 | 0.0032 | 0.0023 | 0.049 | 0.033 | 0.041 | 0.186 | 0.0033 | 0.44 | 0.30 | 0.25 | | | 2.30 |
| P10 | 0.47 | 0.008 | 0.0012 | 0.0023 | 0.0031 | 0.045 | 0.025 | 0.029 | 0.196 | 0.0023 | 0.46 | 0.31 | 0.25 | | | 2.47 |
| P11 | 0.48 | 0.004 | 0.0013 | 0.0033 | 0.0035 | 0.043 | 0.039 | 0.034 | 0.185 | 0.0019 | 0.42 | 0.31 | 0.22 | | | 2.82 |
| P12 | 0.45 | 0.009 | 0.0003 | 0.0026 | 0.0018 | 0.049 | 0.022 | 0.030 | 0.136 | 0.0023 | 0.40 | 0.32 | 0.28 | | | 2.76 |
| Q1 | 0.49 | 0.006 | 0.0016 | 0.0027 | 0.0027 | 0.040 | 0.026 | 0.038 | 0.182 | 0.0028 | 0.43 | 0.35 | 0.36 | | | |
| Q2 | 0.47 | 0.008 | 0.0003 | 0.0032 | 0.0027 | 0.046 | 0.019 | 0.026 | 0.136 | 0.0023 | 0.44 | 0.32 | 0.31 | | | |
| Q3 | 0.45 | 0.009 | 0.0013 | 0.0018 | 0.0032 | 0.045 | 0.029 | 0.048 | 0.226 | 0.0019 | 0.40 | 0.29 | 0.28 | | | |
| Q4 | 0.46 | 0.005 | 0.0012 | 0.0026 | 0.0017 | 0.047 | 0.020 | 0.030 | 0.221 | 0.0030 | 0.39 | 0.34 | 0.23 | | | |
| Q5 | 0.46 | 0.007 | 0.0015 | 0.0020 | 0.0023 | 0.039 | 0.022 | 0.040 | 0.183 | 0.0032 | 0.43 | 0.33 | 0.27 | | | |
| Q6 | 0.45 | 0.005 | 0.0021 | 0.0026 | 0.0026 | 0.049 | 0.033 | 0.027 | 0.203 | 0.0025 | 0.43 | 0.33 | 0.27 | | | |
| Q7 | 0.47 | 0.005 | 0.0016 | 0.0030 | 0.0032 | 0.041 | 0.022 | 0.033 | 0.206 | 0.0026 | 0.42 | 0.33 | 0.33 | | | |
| Q8 | 0.49 | 0.006 | 0.0007 | 0.0018 | 0.0030 | 0.047 | 0.021 | 0.035 | 0.141 | 0.0019 | 0.46 | 0.31 | 0.30 | | | |
| Q9 | 0.49 | 0.004 | 0.0007 | 0.0034 | 0.0020 | 0.045 | 0.039 | 0.035 | 0.162 | 0.0029 | 0.39 | 0.31 | 0.23 | | | |
| Q10 | 0.47 | 0.008 | 0.0010 | 0.0032 | 0.0014 | 0.044 | 0.029 | 0.027 | 0.162 | 0.0019 | 0.43 | 0.30 | 0.26 | | | |
| Q11 | 0.47 | 0.006 | 0.0018 | 0.0018 | 0.0023 | 0.037 | 0.025 | 0.031 | 0.147 | 0.0029 | 0.46 | 0.33 | 0.33 | | | |
| Q12 | 0.46 | 0.004 | 0.0007 | 0.0020 | 0.0022 | 0.044 | 0.036 | 0.041 | 0.141 | 0.0030 | 0.41 | 0.33 | 0.28 | | | |
| R1 | 0.46 | 0.004 | 0.0008 | 0.0027 | 0.0025 | 0.048 | 0.031 | 0.031 | 0.170 | 0.0031 | 0.38 | 0.32 | 0.33 | | | |
| R2 | 0.46 | 0.008 | 0.0009 | 0.0033 | 0.0025 | 0.042 | 0.025 | 0.040 | 0.144 | 0.0031 | 0.42 | 0.34 | 0.26 | | | |
| R3 | 0.44 | 0.008 | 0.0005 | 0.0027 | 0.0020 | 0.040 | 0.035 | 0.027 | 0.173 | 0.0027 | 0.40 | 0.31 | 0.29 | | | |
| R4 | 0.45 | 0.006 | 0.0009 | 0.0030 | 0.0033 | 0.044 | 0.037 | 0.036 | 0.222 | 0.0017 | 0.45 | 0.33 | 0.28 | | | |
| R5 | 0.47 | 0.006 | 0.0021 | 0.0021 | 0.0023 | 0.046 | 0.027 | 0.032 | 0.163 | 0.0034 | 0.42 | 0.32 | 0.30 | | | |
| R6 | 0.47 | 0.008 | 0.0019 | 0.0020 | 0.0020 | 0.040 | 0.042 | 0.037 | 0.149 | 0.0021 | 0.40 | 0.31 | 0.30 | | | |
| R7 | 0.48 | 0.008 | 0.0008 | 0.0029 | 0.0017 | 0.043 | 0.035 | 0.027 | 0.168 | 0.0030 | 0.42 | 0.32 | 0.29 | | | |
| R8 | 0.47 | 0.008 | 0.0018 | 0.0032 | 0.0032 | 0.039 | 0.035 | 0.042 | 0.228 | 0.0030 | 0.43 | 0.32 | 0.29 | | | |
| S1 | 0.45 | 0.007 | 0.0003 | 0.0028 | 0.0016 | 0.045 | 0.024 | 0.039 | 0.169 | 0.0022 | 0.44 | 0.31 | 0.31 | | | |
| S2 | 0.47 | 0.009 | 0.0014 | 0.0023 | 0.0029 | 0.037 | 0.028 | 0.029 | 0.168 | 0.0027 | 0.45 | 0.34 | 0.24 | | | |
| S3 | 0.43 | 0.004 | 0.0012 | 0.0031 | 0.0032 | 0.040 | 0.030 | 0.044 | 0.176 | 0.0023 | 0.38 | 0.35 | 0.25 | | | |
| S4 | 0.48 | 0.008 | 0.0020 | 0.0028 | 0.0014 | 0.049 | 0.037 | 0.044 | 0.144 | 0.0026 | 0.46 | 0.30 | 0.31 | | | |
| S5 | 0.47 | 0.004 | 0.0003 | 0.0021 | 0.0018 | 0.041 | 0.041 | 0.044 | 0.145 | 0.0026 | 0.46 | 0.30 | 0.34 | | | |
| S6 | 0.45 | 0.005 | 0.0012 | 0.0024 | 0.0030 | 0.042 | 0.026 | 0.046 | 0.205 | 0.0029 | 0.42 | 0.31 | 0.30 | | | |
| S7 | 0.45 | 0.009 | 0.0020 | 0.0032 | 0.0031 | 0.039 | 0.038 | 0.032 | 0.151 | 0.0026 | 0.45 | 0.31 | 0.29 | | | |

TABLE 1-continued

| | | | | | | | | | | | | | |
|---|---|---|---|---|---|---|---|---|---|---|---|---|---|
| S8 | 0.43 | 0.004 | 0.0017 | 0.0030 | 0.0015 | 0.049 | 0.037 | 0.028 | 0.156 | 0.0026 | 0.43 | 0.31 | 0.26 |
| T1 | 0.44 | 0.004 | 0.0021 | 0.0025 | 0.0022 | 0.042 | 0.031 | 0.025 | 0.198 | 0.0025 | 0.43 | 0.33 | 0.33 |
| T2 | 0.45 | 0.009 | 0.0004 | 0.0020 | 0.0034 | 0.038 | 0.020 | 0.035 | 0.208 | 0.0021 | 0.41 | 0.35 | 0.27 |
| T3 | 0.46 | 0.007 | 0.0021 | 0.0023 | 0.0034 | 0.045 | 0.030 | 0.037 | 0.182 | 0.0024 | 0.37 | 0.31 | 0.27 |
| T4 | 0.45 | 0.007 | 0.0009 | 0.0023 | 0.0033 | 0.040 | 0.018 | 0.034 | 0.176 | 0.0033 | 0.39 | 0.31 | 0.23 |
| T5 | 0.48 | 0.004 | 0.0006 | 0.0028 | 0.0016 | 0.049 | 0.029 | 0.037 | 0.204 | 0.0019 | 0.44 | 0.32 | 0.27 |
| T6 | 0.43 | 0.005 | 0.0020 | 0.0031 | 0.0014 | 0.043 | 0.030 | 0.041 | 0.227 | 0.0020 | 0.43 | 0.31 | 0.24 |
| T7 | 0.46 | 0.009 | 0.0003 | 0.0031 | 0.0028 | 0.050 | 0.035 | 0.032 | 0.157 | 0.0034 | 0.40 | 0.31 | 0.35 |
| T8 | 0.46 | 0.008 | 0.0009 | 0.0024 | 0.0026 | 0.038 | 0.033 | 0.039 | 0.139 | 0.0023 | 0.40 | 0.33 | 0.33 |
| U1 | 0.48 | 0.008 | 0.0014 | 0.0030 | 0.0021 | 0.047 | 0.025 | 0.034 | 0.195 | 0.0023 | 0.45 | 0.31 | 0.32 |
| U2 | 0.46 | 0.004 | 0.0016 | 0.0019 | 0.0036 | 0.041 | 0.025 | 0.039 | 0.203 | 0.0034 | 0.41 | 0.34 | 0.26 |
| U3 | 0.45 | 0.009 | 0.0015 | 0.0030 | 0.0013 | 0.045 | 0.029 | 0.031 | 0.165 | 0.0024 | 0.40 | 0.32 | 0.27 |
| U4 | 0.43 | 0.006 | 0.0014 | 0.0029 | 0.0026 | 0.040 | 0.036 | 0.035 | 0.176 | 0.0030 | 0.42 | 0.33 | 0.36 |
| U5 | 0.45 | 0.005 | 0.0021 | 0.0032 | 0.0020 | 0.039 | 0.036 | 0.036 | 0.161 | 0.0022 | 0.47 | 0.33 | 0.26 |
| U6 | 0.48 | 0.006 | 0.0019 | 0.0022 | 0.0034 | 0.043 | 0.020 | 0.043 | 0.165 | 0.0029 | 0.38 | 0.33 | 0.27 |
| U7 | 0.45 | 0.005 | 0.0008 | 0.0031 | 0.0029 | 0.044 | 0.031 | 0.039 | 0.209 | 0.0023 | 0.42 | 0.31 | 0.24 |
| U8 | 0.44 | 0.004 | 0.0007 | 0.0021 | 0.0024 | 0.051 | 0.038 | 0.036 | 0.143 | 0.0024 | 0.41 | 0.31 | 0.25 |
| V1 | 0.43 | 0.006 | 0.0016 | 0.0033 | 0.0014 | 0.046 | 0.020 | 0.031 | 0.147 | 0.0020 | 0.47 | 0.33 | 0.33 |
| V2 | 0.48 | 0.007 | 0.0004 | 0.0022 | 0.0023 | 0.044 | 0.020 | 0.043 | 0.195 | 0.0029 | 0.39 | 0.32 | 0.31 |
| V3 | 0.45 | 0.009 | 0.0015 | 0.0033 | 0.0030 | 0.047 | 0.035 | 0.048 | 0.202 | 0.0025 | 0.45 | 0.35 | 0.27 |
| V4 | 0.46 | 0.009 | 0.0018 | 0.0026 | 0.0032 | 0.042 | 0.039 | 0.044 | 0.226 | 0.0024 | 0.45 | 0.32 | 0.28 |
| V5 | 0.47 | 0.007 | 0.0011 | 0.0029 | 0.0034 | 0.049 | 0.022 | 0.030 | 0.165 | 0.0021 | 0.43 | 0.34 | 0.34 |
| V6 | 0.44 | 0.005 | 0.0020 | 0.0028 | 0.0022 | 0.044 | 0.029 | 0.031 | 0.199 | 0.0024 | 0.44 | 0.33 | 0.33 |
| V7 | 0.45 | 0.009 | 0.0006 | 0.0026 | 0.0017 | 0.046 | 0.034 | 0.039 | 0.185 | 0.0023 | 0.46 | 0.32 | 0.32 |
| V8 | 0.46 | 0.004 | 0.0006 | 0.0025 | 0.0028 | 0.049 | 0.040 | 0.042 | 0.219 | 0.0029 | 0.40 | 0.29 | 0.28 |
| W1 | 0.47 | 0.008 | 0.0006 | 0.0026 | 0.0020 | 0.048 | 0.034 | 0.034 | 0.182 | 0.0028 | 0.44 | 0.35 | 0.33 |
| W2 | 0.46 | 0.007 | 0.0009 | 0.0031 | 0.0033 | 0.047 | 0.032 | 0.029 | 0.146 | 0.0024 | 0.41 | 0.30 | 0.31 |
| W3 | 0.44 | 0.005 | 0.0007 | 0.0025 | 0.0031 | 0.045 | 0.024 | 0.039 | 0.169 | 0.0023 | 0.42 | 0.34 | 0.31 |
| W4 | 0.47 | 0.007 | 0.0020 | 0.0030 | 0.0024 | 0.049 | 0.018 | 0.033 | 0.232 | 0.0033 | 0.40 | 0.35 | 0.33 |
| W5 | 0.46 | 0.005 | 0.0003 | 0.0023 | 0.0026 | 0.044 | 0.039 | 0.031 | 0.141 | 0.0024 | 0.40 | 0.31 | 0.32 |
| W6 | 0.45 | 0.009 | 0.0016 | 0.0024 | 0.0014 | 0.047 | 0.024 | 0.027 | 0.205 | 0.0028 | 0.45 | 0.32 | 0.29 |
| W7 | 0.47 | 0.005 | 0.0004 | 0.0024 | 0.0013 | 0.052 | 0.022 | 0.040 | 0.235 | 0.0019 | 0.38 | 0.34 | 0.31 |
| W8 | 0.46 | 0.006 | 0.0009 | 0.0030 | 0.0022 | 0.049 | 0.018 | 0.041 | 0.182 | 0.0019 | 0.45 | 0.31 | 0.30 |
| X1 | 0.46 | 0.006 | 0.0017 | 0.0029 | 0.0026 | 0.046 | 0.028 | 0.026 | 0.205 | 0.0021 | 0.41 | 0.31 | 0.32 |
| X2 | 0.44 | 0.008 | 0.0010 | 0.0029 | 0.0018 | 0.047 | 0.032 | 0.037 | 0.139 | 0.0023 | 0.38 | 0.31 | 0.29 |
| X3 | 0.46 | 0.006 | 0.0020 | 0.0023 | 0.0031 | 0.045 | 0.022 | 0.039 | 0.220 | 0.0034 | 0.47 | 0.32 | 0.34 |
| Y1 | 0.49 | 0.009 | 0.0007 | 0.0018 | 0.0019 | 0.041 | 0.040 | 0.026 | 0.208 | 0.0028 | 0.42 | 0.33 | 0.32 |
| Y2 | 0.46 | 0.007 | 0.0008 | 0.0026 | 0.0031 | 0.048 | 0.036 | 0.033 | 0.136 | 0.0019 | 0.43 | 0.30 | 0.30 |
| Y3 | 0.45 | 0.009 | 0.0012 | 0.0032 | 0.0025 | 0.042 | 0.039 | 0.042 | 0.158 | 0.0028 | 0.40 | 0.30 | 0.30 |
| Y4 | 0.48 | 0.008 | 0.0004 | 0.0020 | 0.0029 | 0.040 | 0.021 | 0.039 | 0.154 | 0.0020 | 0.40 | 0.32 | 0.29 |
| Y5 | 0.45 | 0.005 | 0.0014 | 0.0023 | 0.0019 | 0.041 | 0.041 | 0.027 | 0.167 | 0.0029 | 0.44 | 0.32 | 0.33 |
| Y6 | 0.47 | 0.004 | 0.0019 | 0.0032 | 0.0021 | 0.046 | 0.026 | 0.037 | 0.227 | 0.0033 | 0.41 | 0.32 | 0.33 |
| Y7 | 0.45 | 0.004 | 0.0005 | 0.0022 | 0.0019 | 0.045 | 0.040 | 0.038 | 0.171 | 0.0031 | 0.40 | 0.29 | 0.30 |
| Y8 | 0.49 | 0.006 | 0.0016 | 0.0031 | 0.0025 | 0.047 | 0.037 | 0.026 | 0.138 | 0.0026 | 0.42 | 0.33 | 0.31 |
| Y9 | 0.45 | 0.004 | 0.0017 | 0.0033 | 0.0018 | 0.046 | 0.028 | 0.032 | 0.179 | 0.0031 | 0.45 | 0.30 | 0.23 |
| Y10 | 0.46 | 0.004 | 0.0018 | 0.0022 | 0.0014 | 0.050 | 0.019 | 0.033 | 0.189 | 0.0030 | 0.42 | 0.35 | 0.33 |
| Z1 | 0.44 | 0.006 | 0.0020 | 0.0026 | 0.0020 | 0.040 | 0.020 | 0.035 | 0.153 | 0.0022 | 0.46 | 0.32 | 0.23 |
| Z2 | 0.47 | 0.005 | 0.0015 | 0.0018 | 0.0034 | 0.043 | 0.025 | 0.032 | 0.212 | 0.0025 | 0.39 | 0.32 | 0.26 |
| Z3 | 0.48 | 0.004 | 0.0018 | 0.0023 | 0.0029 | 0.043 | 0.035 | 0.043 | 0.202 | 0.0017 | 0.38 | 0.30 | 0.31 |
| Z4 | 0.46 | 0.005 | 0.0006 | 0.0019 | 0.0017 | 0.049 | 0.027 | 0.044 | 0.201 | 0.0032 | 0.44 | 0.30 | 0.25 |
| Z5 | 0.48 | 0.005 | 0.0008 | 0.0032 | 0.0031 | 0.048 | 0.031 | 0.026 | 0.142 | 0.0033 | 0.45 | 0.29 | 0.33 |
| Z6 | 0.44 | 0.007 | 0.0015 | 0.0033 | 0.0015 | 0.047 | 0.040 | 0.025 | 0.148 | 0.0026 | 0.44 | 0.31 | 0.26 |
| Z7 | 0.48 | 0.009 | 0.0016 | 0.0021 | 0.0015 | 0.042 | 0.026 | 0.037 | 0.228 | 0.0017 | 0.43 | 0.33 | 0.32 |
| Z8 | 0.46 | 0.006 | 0.0009 | 0.0028 | 0.0024 | 0.050 | 0.034 | 0.036 | 0.141 | 0.0032 | 0.42 | 0.31 | 0.31 |
| Z9 | 0.45 | 0.004 | 0.0006 | 0.0030 | 0.0017 | 0.046 | 0.033 | 0.036 | 0.212 | 0.0023 | 0.41 | 0.31 | 0.24 |
| Z10 | 0.45 | 0.006 | 0.0005 | 0.0029 | 0.0023 | 0.042 | 0.026 | 0.033 | 0.166 | 0.0029 | 0.42 | 0.32 | 0.28 |
| AA1 | 0.48 | 0.005 | 0.0019 | 0.0020 | 0.0032 | 0.050 | 0.017 | 0.027 | 0.185 | 0.0022 | 0.44 | 0.31 | 0.25 |
| AA2 | 0.48 | 0.004 | 0.0014 | 0.0028 | 0.0028 | 0.043 | 0.029 | 0.043 | 0.204 | 0.0022 | 0.45 | 0.32 | 0.28 |
| AA3 | 0.46 | 0.008 | 0.0015 | 0.0034 | 0.0020 | 0.042 | 0.023 | 0.029 | 0.152 | 0.0021 | 0.44 | 0.33 | 0.22 |
| AA4 | 0.45 | 0.004 | 0.0007 | 0.0028 | 0.0026 | 0.041 | 0.040 | 0.041 | 0.176 | 0.0020 | 0.47 | 0.32 | 0.29 |
| AA5 | 0.48 | 0.005 | 0.0009 | 0.0020 | 0.0021 | 0.048 | 0.031 | 0.039 | 0.169 | 0.0022 | 0.43 | 0.31 | 0.33 |
| AA6 | 0.49 | 0.005 | 0.0015 | 0.0028 | 0.0019 | 0.041 | 0.020 | 0.046 | 0.209 | 0.0021 | 0.47 | 0.30 | 0.24 |
| AA7 | 0.46 | 0.005 | 0.0004 | 0.0024 | 0.0025 | 0.046 | 0.029 | 0.030 | 0.197 | 0.0033 | 0.44 | 0.34 | 0.25 |
| AA8 | 0.47 | 0.006 | 0.0005 | 0.0029 | 0.0022 | 0.039 | 0.029 | 0.045 | 0.168 | 0.0024 | 0.39 | 0.33 | 0.23 |
| AA9 | 0.48 | 0.004 | 0.0013 | 0.0022 | 0.0018 | 0.039 | 0.027 | 0.032 | 0.184 | 0.0019 | 0.43 | 0.30 | 0.27 |
| AA10 | 0.47 | 0.009 | 0.0014 | 0.0022 | 0.0023 | 0.040 | 0.035 | 0.032 | 0.183 | 0.0023 | 0.43 | 0.34 | 0.29 |
| BB1 | 0.45 | 0.007 | 0.0009 | 0.0032 | 0.0032 | 0.040 | 0.018 | 0.033 | 0.152 | 0.0032 | 0.46 | 0.33 | 0.25 |
| BB2 | 0.46 | 0.008 | 0.0007 | 0.0030 | 0.0023 | 0.043 | 0.027 | 0.042 | 0.146 | 0.0023 | 0.45 | 0.32 | 0.32 |
| BB3 | 0.46 | 0.004 | 0.0015 | 0.0021 | 0.0029 | 0.049 | 0.026 | 0.039 | 0.171 | 0.0023 | 0.39 | 0.34 | 0.31 |
| BB4 | 0.45 | 0.008 | 0.0014 | 0.0019 | 0.0024 | 0.046 | 0.030 | 0.036 | 0.178 | 0.0019 | 0.38 | 0.30 | 0.30 |
| BB5 | 0.45 | 0.008 | 0.0018 | 0.0028 | 0.0016 | 0.046 | 0.041 | 0.030 | 0.230 | 0.0033 | 0.38 | 0.30 | 0.35 |
| BB6 | 0.44 | 0.006 | 0.0015 | 0.0032 | 0.0034 | 0.042 | 0.030 | 0.033 | 0.202 | 0.0030 | 0.43 | 0.32 | 0.26 |
| BB7 | 0.48 | 0.009 | 0.0018 | 0.0019 | 0.0024 | 0.039 | 0.034 | 0.044 | 0.234 | 0.0029 | 0.42 | 0.35 | 0.29 |
| BB8 | 0.46 | 0.006 | 0.0013 | 0.0019 | 0.0030 | 0.039 | 0.028 | 0.026 | 0.216 | 0.0024 | 0.44 | 0.32 | 0.26 |
| BB9 | 0.46 | 0.007 | 0.0009 | 0.0025 | 0.0030 | 0.051 | 0.030 | 0.042 | 0.156 | 0.0018 | 0.43 | 0.30 | 0.33 |
| BB10 | 0.47 | 0.008 | 0.0007 | 0.0027 | 0.0035 | 0.044 | 0.043 | 0.044 | 0.138 | 0.0022 | 0.45 | 0.35 | 0.25 |
| CC1 | 0.46 | 0.005 | 0.0014 | 0.0025 | 0.0014 | 0.047 | 0.020 | 0.043 | 0.140 | 0.0032 | 0.44 | 0.30 | 0.35 |
| CC2 | 0.47 | 0.009 | 0.0020 | 0.0026 | 0.0026 | 0.049 | 0.026 | 0.036 | 0.178 | 0.0029 | 0.40 | 0.29 | 0.34 |
| CC3 | 0.45 | 0.005 | 0.0006 | 0.0022 | 0.0030 | 0.041 | 0.026 | 0.044 | 0.235 | 0.0024 | 0.40 | 0.31 | 0.26 |
| CC4 | 0.48 | 0.007 | 0.0023 | 0.0022 | 0.0024 | 0.044 | 0.027 | 0.031 | 0.167 | 0.0021 | 0.41 | 0.33 | 0.28 |

TABLE 1-continued

| | | | | | | | | | | | | | | | |
|---|---|---|---|---|---|---|---|---|---|---|---|---|---|---|---|
| CC5 | 0.47 | 0.007 | 0.0022 | 0.0024 | 0.0036 | 0.048 | 0.040 | 0.025 | 0.141 | 0.0031 | 0.45 | 0.31 | 0.24 | | |
| CC6 | 0.48 | 0.006 | 0.0013 | 0.0028 | 0.0027 | 0.040 | 0.026 | 0.026 | 0.174 | 0.0034 | 0.38 | 0.29 | 0.22 | | |
| CC7 | 0.44 | 0.008 | 0.0021 | 0.0022 | 0.0029 | 0.045 | 0.025 | 0.042 | 0.196 | 0.0021 | 0.40 | 0.32 | 0.28 | | |
| CC8 | 0.48 | 0.008 | 0.0009 | 0.0021 | 0.0029 | 0.044 | 0.032 | 0.028 | 0.199 | 0.0017 | 0.39 | 0.32 | 0.29 | | |
| CC9 | 0.44 | 0.004 | 0.0005 | 0.0030 | 0.0027 | 0.042 | 0.031 | 0.039 | 0.152 | 0.0033 | 0.41 | 0.29 | 0.26 | | |
| CC10 | 0.49 | 0.009 | 0.0008 | 0.0029 | 0.0030 | 0.039 | 0.034 | 0.036 | 0.165 | 0.0021 | 0.45 | 0.32 | 0.25 | | |
| DD1 | 0.47 | 0.006 | 0.0011 | 0.0025 | 0.0029 | 0.048 | 0.026 | 0.026 | 0.186 | 0.0033 | 0.42 | 0.31 | 0.23 | | |
| DD2 | 0.46 | 0.007 | 0.0006 | 0.0034 | 0.0027 | 0.045 | 0.028 | 0.037 | 0.155 | 0.0026 | 0.42 | 0.31 | 0.35 | | |
| DD3 | 0.46 | 0.004 | 0.0017 | 0.0032 | 0.0024 | 0.048 | 0.017 | 0.026 | 0.145 | 0.0027 | 0.38 | 0.30 | 0.32 | | |
| DD4 | 0.47 | 0.007 | 0.0012 | 0.0027 | 0.0015 | 0.049 | 0.031 | 0.025 | 0.138 | 0.0022 | 0.45 | 0.30 | 0.31 | | |
| DD5 | 0.47 | 0.009 | 0.0012 | 0.0024 | 0.0019 | 0.046 | 0.020 | 0.034 | 0.242 | 0.0022 | 0.44 | 0.30 | 0.24 | | |
| DD6 | 0.44 | 0.006 | 0.0021 | 0.0022 | 0.0023 | 0.045 | 0.033 | 0.031 | 0.143 | 0.0026 | 0.41 | 0.30 | 0.27 | | |
| DD7 | 0.47 | 0.007 | 0.0014 | 0.0022 | 0.0027 | 0.042 | 0.027 | 0.040 | 0.160 | 0.0025 | 0.40 | 0.31 | 0.25 | | |
| DD8 | 0.44 | 0.008 | 0.0018 | 0.0021 | 0.0035 | 0.045 | 0.018 | 0.036 | 0.183 | 0.0020 | 0.44 | 0.34 | 0.26 | | |
| DD9 | 0.45 | 0.004 | 0.0014 | 0.0031 | 0.0030 | 0.050 | 0.031 | 0.041 | 0.194 | 0.0021 | 0.41 | 0.30 | 0.30 | | |
| DD10 | 0.45 | 0.008 | 0.0016 | 0.0024 | 0.0015 | 0.049 | 0.027 | 0.035 | 0.219 | 0.0019 | 0.41 | 0.33 | 0.32 | | |
| FF1 | 0.47 | 0.008 | 0.0012 | 0.0024 | 0.0019 | 0.046 | 0.019 | 0.034 | 0.239 | 0.0022 | 0.45 | 0.30 | 0.24 | | |
| FF2 | 0.45 | 0.006 | 0.0021 | 0.0022 | 0.0024 | 0.046 | 0.033 | 0.031 | 0.145 | 0.0027 | 0.41 | 0.29 | 0.27 | | |
| FF3 | 0.48 | 0.007 | 0.0014 | 0.0022 | 0.0027 | 0.042 | 0.028 | 0.041 | 0.158 | 0.0025 | 0.39 | 0.30 | 0.25 | | |
| GG1 | 0.44 | 0.008 | 0.0017 | 0.0021 | 0.0034 | 0.045 | 0.018 | 0.036 | 0.181 | 0.0021 | 0.43 | 0.34 | 0.25 | | |
| GG2 | 0.46 | 0.004 | 0.0014 | 0.0031 | 0.0031 | 0.050 | 0.031 | 0.040 | 0.192 | 0.0021 | 0.41 | 0.30 | 0.31 | | |
| GG3 | 0.46 | 0.008 | 0.0016 | 0.0024 | 0.0014 | 0.049 | 0.027 | 0.035 | 0.224 | 0.0019 | 0.41 | 0.33 | 0.32 | | |
| EE1 | 0.47 | 0.007 | 0.0021 | 0.0029 | 0.0029 | 0.053 | 0.021 | 0.036 | 0.149 | 0.0027 | 0.41 | 0.32 | 0.31 | | 0.08 | 0.24 |
| EE2 | 0.48 | 0.004 | 0.0024 | 0.0020 | 0.0024 | 0.048 | 0.034 | 0.043 | 0.131 | 0.0027 | 0.43 | 0.31 | 0.37 | | |
| EE3 | 0.47 | 0.003 | 0.0008 | 0.0033 | 0.0019 | 0.058 | 0.034 | 0.043 | 0.233 | 0.0020 | 0.40 | 0.33 | 0.33 | 1.01 | |
| EE4 | 0.44 | 0.009 | 0.0021 | 0.0023 | 0.0019 | 0.055 | 0.031 | 0.034 | 0.214 | 0.0034 | 0.43 | 0.33 | 0.36 | | 0.05 | 0.25 |
| EE5 | 0.48 | 0.007 | 0.0011 | 0.0020 | 0.0017 | 0.043 | 0.031 | 0.042 | 0.209 | 0.0032 | 0.43 | 0.21 | 0.23 | | |
| EE6 | 0.49 | 0.006 | 0.0005 | 0.0030 | 0.0015 | 0.048 | 0.020 | 0.030 | 0.190 | 0.0020 | 0.43 | 0.33 | 0.28 | | |
| EE7 | 0.45 | 0.003 | 0.0011 | 0.0021 | 0.0027 | 0.048 | 0.041 | 0.032 | 0.161 | 0.0028 | 0.45 | 0.20 | 0.26 | | |
| EE8 | 0.48 | 0.004 | 0.0005 | 0.0032 | 0.0033 | 0.039 | 0.023 | 0.029 | 0.202 | 0.0025 | 0.45 | 0.10 | 0.33 | | |

| | Chemical composition (mass %), balance: Fe and impurities | | | | | | | | | | | | | | | | |
|---|---|---|---|---|---|---|---|---|---|---|---|---|---|---|---|---|---|
| Steel | V | Ca | Mg | REM | Sb | Zr | Sn | As | W | Ta | Re | Os | Ir | Tc | Se | Bi | Remarks |
| A1 | | | | | | | | | | | | | | | | | Comp. steel |
| A2 | | | | | | | | | | | | | | | | | Inv. steel |
| A3 | | | | | | | | | | | | | | | | | Inv. steel |
| A4 | | | | | | | | | | | | | | | | | Inv. steel |
| A5 | | | | | | | | | | | | | | | | | Inv. steel |
| A6 | | | | | | | | | | | | | | | | | Inv. steel |
| A7 | | | | | | | | | | | | | | | | | Inv. steel |
| A8 | | | | | | | | | | | | | | | | | Inv. steel |
| A9 | | | | | | | | | | | | | | | | | Inv. steel |
| A10 | | | | | | | | | | | | | | | | | Inv. steel |
| A11 | | | | | | | | | | | | | | | | | Inv. steel |
| A12 | | | | | | | | | | | | | | | | | Inv. steel |
| A13 | | | | | | | | | | | | | | | | | Inv. steel |
| A14 | | | | | | | | | | | | | | | | | Comp. steel |
| B1 | | | | | | | | | | | | | | | | | Inv. steel |
| B2 | | | | | | | | | | | | | | | | | Inv. steel |
| B3 | | | | | | | | | | | | | | | | | Inv. steel |
| B4 | | | | | | | | | | | | | | | | | Inv. steel |
| B5 | | | | | | | | | | | | | | | | | Inv. steel |
| B6 | | | | | | | | | | | | | | | | | Inv. steel |
| B7 | | | | | | | | | | | | | | | | | Inv. steel |
| B8 | | | | | | | | | | | | | | | | | Inv. steel |
| B9 | | | | | | | | | | | | | | | | | Inv. steel |
| B10 | | | | | | | | | | | | | | | | | Inv. steel |
| B11 | | | | | | | | | | | | | | | | | Inv. steel |
| B12 | | | | | | | | | | | | | | | | | Inv. steel |
| B13 | | | | | | | | | | | | | | | | | Inv. steel |
| B14 | | | | | | | | | | | | | | | | | Inv. steel |
| B15 | | | | | | | | | | | | | | | | | Comp. steel |
| C1 | | | | | | | | | | | | | | | | | Inv. steel |
| C2 | | | | | | | | | | | | | | | | | Inv. steel |
| C3 | | | | | | | | | | | | | | | | | Inv. steel |
| C4 | | | | | | | | | | | | | | | | | Inv. steel |
| C5 | | | | | | | | | | | | | | | | | Inv. steel |
| C6 | | | | | | | | | | | | | | | | | Inv. steel |
| C7 | | | | | | | | | | | | | | | | | Inv. steel |
| C8 | | | | | | | | | | | | | | | | | Inv. steel |
| C9 | | | | | | | | | | | | | | | | | Inv. steel |
| C10 | | | | | | | | | | | | | | | | | Inv. steel |
| C11 | | | | | | | | | | | | | | | | | Inv. steel |
| C12 | | | | | | | | | | | | | | | | | Inv. steel |
| C13 | | | | | | | | | | | | | | | | | Inv. steel |
| C14 | | | | | | | | | | | | | | | | | Comp. steel |
| D1 | | | | | | | | | | | | | | | | | Inv. steel |
| D2 | | | | | | | | | | | | | | | | | Inv. steel |

TABLE 1-continued

| | |
|---|---|
| D3 | Inv. steel |
| D4 | Inv. steel |
| D5 | Inv. steel |
| D6 | Inv. steel |
| D7 | Inv. steel |
| D8 | Inv. steel |
| D9 | Comp. steel |
| E1 | Inv. steel |
| E2 | Inv. steel |
| E3 | Inv. steel |
| E4 | Inv. steel |
| E5 | Inv. steel |
| E6 | Inv. steel |
| E7 | Inv. steel |
| E8 | Inv. steel |
| E9 | Comp. steel |
| F1 | Inv. steel |
| F2 | Inv. steel |
| F3 | Inv. steel |
| F4 | Inv. steel |
| F5 | Inv. steel |
| F6 | Inv. steel |
| F7 | Inv. steel |
| F8 | Inv. steel |
| F9 | Comp. steel |
| G1 | Inv. steel |
| G2 | Inv. steel |
| G3 | Inv. steel |
| G4 | Inv. steel |
| G5 | Inv. steel |
| G6 | Inv. steel |
| G7 | Inv. steel |
| G8 | Comp. steel |
| H1 | Comp. steel |
| H2 | Inv. steel |
| H3 | Inv. steel |
| H4 | Inv. steel |
| H5 | Inv. steel |
| H6 | Inv. steel |
| H7 | Inv. steel |
| H8 | Inv. steel |
| H9 | Inv. steel |
| H10 | Inv. steel |
| H11 | Inv. steel |
| H12 | Inv. steel |
| H13 | Inv. steel |
| H14 | Comp. steel |
| I1 | Comp. steel |
| I2 | Inv. steel |
| I3 | Inv. steel |
| I4 | Inv. steel |
| I5 | Inv. steel |
| I6 | Inv. steel |
| I7 | Inv. steel |
| I8 | Inv. steel |
| I9 | Inv. steel |
| I10 | Inv. steel |
| I11 | Inv. steel |
| I12 | Inv. steel |
| I13 | Inv. steel |
| I14 | Comp. steel |
| J1 | Comp. steel |
| J2 | Inv. steel |
| J3 | Inv. steel |
| J4 | Inv. steel |
| J5 | Inv. steel |
| J6 | Inv. steel |
| J7 | Inv. steel |
| J8 | Inv. steel |
| J9 | Inv. steel |
| J10 | Inv. steel |
| J11 | Inv. steel |
| J12 | Comp. steel |
| K1 | Inv. steel |
| K2 | Inv. steel |
| K3 | Inv. steel |
| K4 | Inv. steel |
| K5 | Inv. steel |
| K6 | Inv. steel |
| K7 | Inv. steel |

TABLE 1-continued

| | | |
|---|---|---|
| K8 | | Inv. steel |
| K9 | | Inv. steel |
| K10 | | Inv. steel |
| K11 | | Inv. steel |
| K12 | | Inv. steel |
| K13 | | Inv. steel |
| K14 | | Comp. steel |
| L1 | | Comp. steel |
| L2 | | Inv. steel |
| L3 | | Inv. steel |
| L4 | | Inv. steel |
| L5 | | Inv. steel |
| L6 | | Inv. steel |
| L7 | | Inv. steel |
| L8 | | Inv. steel |
| L9 | | Inv. steel |
| L10 | | Inv. steel |
| L11 | | Inv. steel |
| L12 | | Inv. steel |
| L13 | | Comp. steel |
| M1 | | Comp. steel |
| M2 | | Inv. steel |
| M3 | | Inv. steel |
| M4 | | Inv. steel |
| M5 | | Inv. steel |
| M6 | | Inv. steel |
| M7 | | Inv. steel |
| M8 | | Inv. steel |
| M9 | | Inv. steel |
| M10 | | Inv. steel |
| M11 | | Comp. steel |
| N1 | | Inv. steel |
| N2 | | Inv. steel |
| N3 | | Inv. steel |
| N4 | | Inv. steel |
| N5 | | Inv. steel |
| N6 | | Inv. steel |
| N7 | | Inv. steel |
| N8 | | Inv. steel |
| N9 | | Inv. steel |
| N10 | | Inv. steel |
| N11 | | Inv. steel |
| N12 | | Inv. steel |
| N13 | | Inv. steel |
| O1 | | Inv. steel |
| O2 | | Inv. steel |
| O3 | | Inv. steel |
| O4 | | Inv. steel |
| O5 | | Inv. steel |
| O6 | | Inv. steel |
| O7 | | Inv. steel |
| O8 | | Inv. steel |
| O9 | | Inv. steel |
| O10 | | Inv. steel |
| O11 | | Inv. steel |
| O12 | | Inv. steel |
| P1 | | Inv. steel |
| P2 | | Inv. steel |
| P3 | | Inv. steel |
| P4 | | Inv. steel |
| P5 | | Inv. steel |
| P6 | | Inv. steel |
| P7 | | Inv. steel |
| P8 | | Inv. steel |
| P9 | | Inv. steel |
| P10 | | Inv. steel |
| P11 | | Inv. steel |
| P12 | | Inv. steel |
| Q1 | 0.05 | Inv. steel |
| Q2 | 0.11 | Inv. steel |
| Q3 | 0.22 | Inv. steel |
| Q4 | 0.45 | Inv. steel |
| Q5 | 0.83 | Inv. steel |
| Q6 | 1.23 | Inv. steel |
| Q7 | 1.57 | Inv. steel |
| Q8 | 1.72 | Inv. steel |
| Q9 | 2.10 | Inv. steel |
| Q10 | 2.58 | Inv. steel |
| Q11 | 2.71 | Inv. steel |
| Q12 | 2.74 | Inv. steel |

TABLE 1-continued

| | | |

TABLE 1-continued

| | | | | | | | | | | |
|---|---|---|---|---|---|---|---|---|---|---|
| AA10 | | | | | 0.80 | | | | | Inv. steel |
| BB1 | | | | | | 0.003 | | | | Inv. steel |
| BB2 | | | | | | 0.01 | | | | Inv. steel |
| BB3 | | | | | | 0.05 | | | | Inv. steel |
| BB4 | | | | | | 0.07 | | | | Inv. steel |
| BB5 | | | | | | 0.14 | | | | Inv. steel |
| BB6 | | | | | | 0.18 | | | | Inv. steel |
| BB7 | | | | | | 0.26 | | | | Inv. steel |
| BB8 | | | | | | 0.47 | | | | Inv. steel |
| BB9 | | | | | | 0.60 | | | | Inv. steel |
| BB10 | | | | | | 0.87 | | | | Inv. steel |
| CC1 | | | | | | | 0.002 | | | Inv. steel |
| CC2 | | | | | | | 0.005 | | | Inv. steel |
| CC3 | | | | | | | 0.04 | | | Inv. steel |
| CC4 | | | | | | | 0.08 | | | Inv. steel |
| CC5 | | | | | | | 0.15 | | | Inv. steel |
| CC6 | | | | | | | 0.17 | | | Inv. steel |
| CC7 | | | | | | | 0.21 | | | Inv. steel |
| CC8 | | | | | | | 0.44 | | | Inv. steel |
| CC9 | | | | | | | 0.63 | | | Inv. steel |
| CC10 | | | | | | | 0.88 | | | Inv. steel |
| DD1 | | | | | | | | 0.002 | | Inv. steel |
| DD2 | | | | | | | | 0.01 | | Inv. steel |
| DD3 | | | | | | | | 0.03 | | Inv. steel |
| DD4 | | | | | | | | 0.08 | | Inv. steel |
| DD5 | | | | | | | | 0.11 | | Inv. steel |
| DD6 | | | | | | | | 0.18 | | Inv. steel |
| DD7 | | | | | | | | 0.23 | | Inv. steel |
| DD8 | | | | | | | | 0.49 | | Inv. steel |
| DD9 | | | | | | | | 0.60 | | Inv. steel |
| DD10 | | | | | | | | 0.89 | | Inv. steel |
| FF1 | | | | | | | | | 0.002 | Inv. steel |
| FF2 | | | | | | | | | 0.56 | Inv. steel |
| FF3 | | | | | | | | | 0.94 | Inv. steel |
| GG1 | | | | | | | | | | 0.003 Inv. steel |
| GG2 | | | | | | | | | | 0.48 Inv. steel |
| GG3 | | | | | | | | | | 0.92 Inv. steel |
| EE1 | | | | | | | | | | Inv. steel |
| EE2 | | | | | | | | | | Inv. steel |
| EE3 | | | | | | | | | | Inv. steel |
| EE4 | | | 0.121 | | | | | | | Inv. steel |
| EE5 | | | | | | | | | | Inv. steel |
| EE6 | | | | 0.40 | | | | | | Inv. steel |
| EE7 | | | | 1.01 | | | | | | Inv. steel |
| EE8 | | | | 1.91 | | | | | | Inv. steel |

Underlines indicate outside scope of present invention.

TABLE 2

| | | | Preheating step | | Hot stamping step | | | |
|---|---|---|---|---|---|---|---|---|
| Test no. | Steel | Hot rolling step Coiling temp. ° C. | Heating temp. ° C. | Average cooling temp. down to less than 350° C. ° C./s | Heating temp. ° C. | Holding times | Others | Remarks |
| 1 | A1 | 273 | 1288 | 478 | 912 | 362 | | Comp. ex. |
| 2 | A2 | 398 | 1279 | 591 | 901 | 348 | | Inv. ex. |
| 3 | A3 | 354 | 1253 | 530 | 912 | 364 | | Inv. ex. |
| 4 | A4 | 414 | 1288 | 523 | 913 | 377 | | Inv. ex. |
| 5 | A5 | 414 | 1252 | 448 | 912 | 362 | | Inv. ex. |
| 6 | A6 | 371 | 1253 | 555 | 913 | 350 | | Inv. ex. |
| 7 | A7 | 422 | 1234 | 407 | 933 | 366 | | Inv. ex. |
| 8 | A8 | 397 | 1260 | 539 | 922 | 368 | | Inv. ex. |
| 9 | A9 | 326 | 1289 | 512 | 917 | 353 | | Inv. ex. |
| 10 | A10 | 431 | 1301 | 544 | 888 | 374 | | Inv. ex. |
| 11 | A11 | 323 | 1263 | 673 | 910 | 370 | | Inv. ex. |
| 12 | A12 | 424 | 1249 | 642 | 911 | 371 | | Inv. ex. |
| 13 | A13 | 268 | 1246 | 631 | 915 | 366 | | Inv. ex. |
| 14 | A14 | 328 | 1289 | 623 | 910 | 351 | | Comp. ex. |
| 15 | B1 | 416 | 1292 | 441 | 903 | 354 | | Inv. ex. |
| 16 | B2 | 351 | 1270 | 421 | 910 | 354 | | Inv. ex. |
| 17 | B3 | 406 | 1243 | 509 | 903 | 370 | | Inv. ex. |
| 18 | B4 | 439 | 1285 | 566 | 915 | 359 | | Inv. ex. |
| 19 | B5 | 437 | 1252 | 512 | 920 | 351 | | Inv. ex. |

TABLE 2-continued

| Test no. | Steel | Hot rolling step: Coiling temp. ° C. | Preheating step: Heating temp. ° C. | Average cooling temp. down to less than 350° C. ° C./s | Hot stamping step: Heating temp. ° C. | Hot stamping step: Holding times | Others | Remarks |
|---|---|---|---|---|---|---|---|---|
| 20 | B6 | 382 | 1274 | 610 | 890 | 375 | | Inv. ex. |
| 21 | B7 | 364 | 1237 | 537 | 906 | 373 | | Inv. ex. |
| 22 | B8 | 358 | 1237 | 438 | 910 | 377 | | Inv. ex. |
| 23 | B9 | 373 | 1268 | 575 | 888 | 368 | | Inv. ex. |
| 24 | B10 | 312 | 1275 | 618 | 901 | 360 | | Inv. ex. |
| 25 | B11 | 331 | 1239 | 653 | 921 | 345 | | Inv. ex. |
| 26 | B12 | 295 | 1248 | 418 | 897 | 360 | | Inv. ex. |
| 27 | B13 | 331 | 1293 | 678 | 911 | 369 | | Inv. ex. |
| 28 | B14 | 387 | 1242 | 697 | 862 | 357 | | Inv. ex. |
| 29 | B15 | 397 | 1251 | 411 | 924 | 365 | | Comp. ex. |
| 30 | C1 | 379 | 1254 | 491 | 924 | 346 | | Inv. ex. |
| 31 | C2 | 413 | 1264 | 639 | 889 | 375 | | Inv. ex. |
| 32 | C3 | 282 | 1286 | 686 | 902 | 364 | | Inv. ex. |
| 33 | C4 | 427 | 1237 | 474 | 922 | 373 | | Inv. ex. |
| 34 | C5 | 416 | 1263 | 497 | 927 | 369 | | Inv. ex. |
| 35 | C6 | 306 | 1232 | 507 | 905 | 354 | | Inv. ex. |
| 36 | C7 | 422 | 1270 | 595 | 900 | 362 | | Inv. ex. |
| 37 | C8 | 328 | 1274 | 697 | 907 | 367 | | Inv. ex. |
| 38 | C9 | 396 | 1271 | 670 | 911 | 368 | | Inv. ex. |
| 39 | C10 | 319 | 1270 | 499 | 898 | 366 | | Inv. ex. |
| 40 | C11 | 412 | 1283 | 467 | 914 | 365 | | Inv. ex. |
| 41 | C12 | 314 | 1246 | 532 | 901 | 352 | | Inv. ex. |
| 42 | C13 | 337 | 1290 | 677 | 910 | 343 | | Inv. ex. |
| 43 | C14 | 336 | 1232 | 688 | 886 | 372 | | Comp. ex. |
| 44 | D1 | 322 | 1231 | 458 | 910 | 368 | | Inv. ex. |
| 45 | D2 | 318 | 1281 | 679 | 910 | 374 | | Inv. ex. |
| 46 | D3 | 315 | 1274 | 605 | 934 | 368 | | Inv. ex. |
| 47 | D4 | 399 | 1284 | 612 | 934 | 372 | | Inv. ex. |
| 48 | D5 | 298 | 1247 | 421 | 907 | 353 | | Inv. ex. |
| 49 | D6 | 387 | 1269 | 648 | 892 | 368 | | Inv. ex. |
| 50 | D7 | 256 | 1286 | 617 | 934 | 358 | | Inv. ex. |
| 51 | D8 | 364 | 1258 | 410 | 891 | 365 | | Inv. ex. |
| 52 | D9 | 427 | 1258 | 481 | 905 | 359 | | Comp. ex. |
| 53 | E1 | 312 | 1230 | 677 | 912 | 355 | | Inv. ex. |
| 54 | E2 | 347 | 1237 | 434 | 909 | 379 | | Inv. ex. |
| 55 | E3 | 423 | 1289 | 544 | 911 | 351 | | Inv. ex. |
| 56 | E4 | 389 | 1238 | 491 | 925 | 361 | | Inv. ex. |
| 57 | E5 | 319 | 1233 | 634 | 909 | 374 | | Inv. ex. |
| 58 | E6 | 325 | 1266 | 402 | 915 | 369 | | Inv. ex. |
| 59 | E7 | 399 | 1240 | 533 | 898 | 361 | | Inv. ex. |
| 60 | E8 | 390 | 1268 | 472 | 897 | 356 | | Inv. ex. |
| 61 | E9 | 374 | 1260 | 520 | 895 | 343 | | Comp. ex. |
| 62 | F1 | 262 | 1287 | 673 | 913 | 351 | | Inv. ex. |
| 63 | F2 | 334 | 1241 | 424 | 904 | 367 | | Inv. ex. |
| 64 | F3 | 330 | 1245 | 570 | 896 | 357 | | Inv. ex. |
| 65 | F4 | 385 | 1275 | 599 | 909 | 365 | | Inv. ex. |
| 66 | F5 | 408 | 1292 | 609 | 914 | 353 | | Inv. ex. |
| 67 | F6 | 322 | 1284 | 599 | 902 | 366 | | Inv. ex. |
| 68 | F7 | 338 | 1261 | 592 | 911 | 361 | | Inv. ex. |
| 69 | F8 | 291 | 1274 | 406 | 915 | 359 | | Inv. ex. |
| 70 | F9 | 383 | 1291 | 504 | 929 | 358 | | Comp. ex. |
| 71 | G1 | 356 | 1256 | 652 | 916 | 351 | | Inv. ex. |
| 72 | G2 | 270 | 1251 | 485 | 912 | 363 | | Inv. ex. |
| 73 | G3 | 423 | 1266 | 692 | 904 | 358 | | Inv. ex. |
| 74 | G4 | 426 | 1252 | 602 | 910 | 354 | | Inv. ex. |
| 75 | G5 | 374 | 1265 | 419 | 916 | 364 | | Inv. ex. |
| 76 | G6 | 424 | 1290 | 588 | 906 | 359 | | Inv. ex. |
| 77 | G7 | 359 | 1269 | 434 | 902 | 351 | | Inv. ex. |
| 78 | G8 | 296 | 1281 | 643 | 901 | 364 | | Comp. ex. |
| 79 | H1 | 366 | 1274 | 641 | 923 | 349 | | Comp. ex. |
| 80 | H2 | 250 | 1268 | 462 | 934 | 362 | | Inv. ex. |
| 81 | H3 | 395 | 1291 | 680 | 905 | 355 | | Inv. ex. |
| 82 | H4 | 254 | 1257 | 416 | 913 | 366 | | Inv. ex. |
| 83 | H5 | 265 | 1270 | 443 | 925 | 350 | | Inv. ex. |
| 84 | H6 | 434 | 1269 | 622 | 910 | 345 | | Inv. ex. |
| 85 | H7 | 337 | 1271 | 687 | 916 | 342 | | Inv. ex. |
| 86 | H8 | 307 | 1262 | 636 | 923 | 348 | | Inv. ex. |
| 87 | H9 | 432 | 1252 | 644 | 908 | 342 | | Inv. ex. |
| 88 | H10 | 329 | 1296 | 483 | 918 | 371 | | Inv. ex. |
| 89 | H11 | 309 | 1246 | 485 | 911 | 347 | | Inv. ex. |
| 90 | H12 | 279 | 1253 | 639 | 912 | 368 | | Inv. ex. |

TABLE 2-continued

| Test no. | Steel | Hot rolling step: Coiling temp. ° C. | Preheating step: Heating temp. ° C. | Average cooling temp. down to less than 350° C. ° C./s | Hot stamping step: Heating temp. ° C. | Hot stamping step: Holding times | Others | Remarks |
|---|---|---|---|---|---|---|---|---|
| 91 | H13 | 376 | 1268 | 461 | 925 | 362 | | Inv. ex. |
| 92 | H14 | 279 | 1253 | 565 | 929 | 376 | | Comp. ex. |
| 93 | I1 | 316 | 1266 | 531 | 915 | 355 | | Comp. ex. |
| 94 | I2 | 300 | 1277 | 550 | 888 | 367 | | Inv. ex. |
| 95 | I3 | 361 | 1282 | 532 | 910 | 370 | | Inv. ex. |
| 96 | I4 | 365 | 1274 | 550 | 895 | 378 | | Inv. ex. |
| 97 | I5 | 379 | 1269 | 691 | 897 | 346 | | Inv. ex. |
| 98 | I6 | 343 | 1272 | 491 | 887 | 359 | | Inv. ex. |
| 99 | I7 | 311 | 1254 | 582 | 898 | 363 | | Inv. ex. |
| 100 | I8 | 362 | 1262 | 585 | 903 | 370 | | Inv. ex. |
| 101 | I9 | 310 | 1276 | 461 | 911 | 365 | | Inv. ex. |
| 102 | I10 | 257 | 1269 | 678 | 914 | 375 | | Inv. ex. |
| 103 | I11 | 340 | 1260 | 471 | 912 | 368 | | Inv. ex. |
| 104 | I12 | 259 | 1253 | 434 | 902 | 349 | | Inv. ex. |
| 105 | I13 | 356 | 1281 | 599 | 898 | 350 | | Inv. ex. |
| 106 | I14 | 252 | 1265 | 687 | 894 | 355 | | Comp. ex. |
| 107 | J1 | 401 | 1271 | 619 | 914 | 351 | | Comp. ex. |
| 108 | J2 | 365 | 1254 | 644 | 910 | 379 | | Inv. ex. |
| 109 | J3 | 393 | 1242 | 658 | 932 | 369 | | Inv. ex. |
| 110 | J4 | 321 | 1277 | 422 | 912 | 354 | | Inv. ex. |
| 111 | J5 | 306 | 1295 | 577 | 920 | 346 | | Inv. ex. |
| 112 | J6 | 296 | 1268 | 553 | 932 | 361 | | Inv. ex. |
| 113 | J7 | 418 | 1254 | 575 | 919 | 359 | | Inv. ex. |
| 114 | J8 | 322 | 1267 | 469 | 931 | 361 | | Inv. ex. |
| 115 | J9 | 394 | 1251 | 505 | 934 | 352 | | Inv. ex. |
| 116 | J10 | 357 | 1252 | 541 | 915 | 343 | | Inv. ex. |
| 117 | J11 | 283 | 1298 | 631 | 919 | 368 | | Inv. ex. |
| 118 | J12 | 382 | 1244 | 498 | 904 | 379 | | Comp. ex. |
| 119 | K1 | 291 | 1285 | 575 | 897 | 347 | | Inv. ex. |
| 120 | K2 | 317 | 1249 | 631 | 917 | 359 | | Inv. ex. |
| 121 | K3 | 305 | 1297 | 476 | 888 | 357 | | Inv. ex. |
| 122 | K4 | 439 | 1228 | 689 | 912 | 356 | | Inv. ex. |
| 123 | K5 | 355 | 1267 | 421 | 911 | 347 | | Inv. ex. |
| 124 | K6 | 328 | 1235 | 671 | 928 | 351 | | Inv. ex. |
| 125 | K7 | 385 | 1272 | 572 | 930 | 368 | | Inv. ex. |
| 126 | K8 | 293 | 1243 | 596 | 903 | 372 | | Inv. ex. |
| 127 | K9 | 441 | 1242 | 671 | 924 | 364 | | Inv. ex. |
| 128 | K10 | 379 | 1271 | 534 | 908 | 358 | | Inv. ex. |
| 129 | K11 | 412 | 1250 | 703 | 916 | 348 | | Inv. ex. |
| 130 | K12 | 265 | 1289 | 488 | 906 | 374 | | Inv. ex. |
| 131 | K13 | 442 | 1245 | 630 | 896 | 363 | | Inv. ex. |
| 132 | K14 | 309 | 1281 | 506 | 895 | 359 | | Comp. ex. |
| 133 | L1 | 265 | 1267 | 410 | 913 | 355 | | Comp. ex. |
| 134 | L2 | 257 | 1247 | 634 | 934 | 353 | | Inv. ex. |
| 135 | L3 | 270 | 1269 | 679 | 905 | 352 | | Inv. ex. |
| 136 | L4 | 323 | 1257 | 553 | 913 | 361 | | Inv. ex. |
| 137 | L5 | 420 | 1259 | 556 | 926 | 354 | | Inv. ex. |
| 138 | L6 | 363 | 1264 | 439 | 908 | 367 | | Inv. ex. |
| 139 | L7 | 391 | 1281 | 433 | 908 | 372 | | Inv. ex. |
| 140 | L8 | 378 | 1286 | 459 | 897 | 350 | | Inv. ex. |
| 141 | L9 | 415 | 1265 | 571 | 912 | 366 | | Inv. ex. |
| 142 | L10 | 436 | 1250 | 471 | 910 | 349 | | Inv. ex. |
| 143 | L11 | 353 | 1299 | 536 | 906 | 365 | | Inv. ex. |
| 144 | L12 | 375 | 1255 | 683 | 913 | 359 | | Inv. ex. |
| 145 | L13 | 348 | 1246 | 550 | 907 | 356 | | Comp. ex. |
| 146 | M1 | 354 | 1289 | 410 | 896 | 368 | | Comp. ex. |
| 147 | M2 | 353 | 1272 | 509 | 927 | 347 | | Inv. ex. |
| 148 | M3 | 253 | 1267 | 469 | 914 | 351 | | Inv. ex. |
| 149 | M4 | 301 | 1262 | 595 | 912 | 357 | | Inv. ex. |
| 150 | M5 | 375 | 1266 | 571 | 890 | 347 | | Inv. ex. |
| 151 | M6 | 399 | 1272 | 423 | 921 | 349 | | Inv. ex. |
| 152 | M7 | 254 | 1267 | 433 | 919 | 354 | | Inv. ex. |
| 153 | M8 | 263 | 1276 | 462 | 906 | 363 | | Inv. ex. |
| 154 | M9 | 318 | 1264 | 636 | 909 | 362 | | Inv. ex. |
| 155 | M10 | 297 | 1243 | 669 | 921 | 353 | | Inv. ex. |
| 156 | M11 | 335 | 1251 | 511 | 887 | 368 | | Comp. ex. |
| 157 | N1 | 303 | 1243 | 546 | 915 | 354 | | Inv. ex. |
| 158 | N2 | 445 | 1263 | 439 | 908 | 364 | | Inv. ex. |
| 159 | N3 | 425 | 1278 | 670 | 898 | 370 | | Inv. ex. |
| 160 | N4 | 403 | 1288 | 474 | 900 | 364 | | Inv. ex. |
| 161 | N5 | 361 | 1265 | 504 | 927 | 378 | | Inv. ex. |

TABLE 2-continued

| Test no. | Steel | Hot rolling step: Coiling temp. ° C. | Preheating step: Heating temp. ° C. | Preheating step: Average cooling temp. down to less than 350° C. ° C./s | Hot stamping step: Heating temp. ° C. | Hot stamping step: Holding times | Others | Remarks |
|---|---|---|---|---|---|---|---|---|
| 162 | N6 | 427 | 1279 | 497 | 895 | 366 | | Inv. ex. |
| 163 | N7 | 352 | 1284 | 668 | 918 | 368 | | Inv. ex. |
| 164 | N8 | 263 | 1257 | 490 | 903 | 357 | | Inv. ex. |
| 165 | N9 | 339 | 1256 | 692 | 929 | 364 | | Inv. ex. |
| 166 | N10 | 430 | 1262 | 572 | 897 | 366 | | Inv. ex. |
| 167 | N11 | 271 | 1260 | 471 | 912 | 353 | | Inv. ex. |
| 168 | N12 | 369 | 1285 | 521 | 912 | 363 | | Inv. ex. |
| 169 | N13 | 250 | 1269 | 442 | 909 | 366 | | Inv. ex. |
| 170 | O1 | 412 | 1277 | 434 | 928 | 352 | | Inv. ex. |
| 171 | O2 | 358 | 1263 | 654 | 896 | 353 | | Inv. ex. |
| 172 | O3 | 332 | 1279 | 500 | 932 | 351 | | Inv. ex. |
| 173 | O4 | 410 | 1265 | 569 | 905 | 368 | | Inv. ex. |
| 174 | O5 | 387 | 1266 | 471 | 911 | 367 | | Inv. ex. |
| 175 | O6 | 325 | 1249 | 688 | 904 | 369 | | Inv. ex. |
| 176 | O7 | 258 | 1243 | 544 | 899 | 375 | | Inv. ex. |
| 177 | O8 | 322 | 1236 | 581 | 933 | 369 | | Inv. ex. |
| 178 | O9 | 396 | 1274 | 407 | 899 | 348 | | Inv. ex. |
| 179 | O10 | 307 | 1268 | 428 | 912 | 371 | | Inv. ex. |
| 180 | O11 | 370 | 1238 | 476 | 907 | 351 | | Inv. ex. |
| 181 | O12 | 348 | 1271 | 636 | 892 | 368 | | Inv. ex. |
| 182 | P1 | 443 | 1302 | 434 | 901 | 344 | | Inv. ex. |
| 183 | P2 | 327 | 1249 | 424 | 899 | 357 | | Inv. ex. |
| 184 | P3 | 337 | 1281 | 520 | 913 | 366 | | Inv. ex. |
| 185 | P4 | 417 | 1296 | 697 | 913 | 370 | | Inv. ex. |
| 186 | P5 | 355 | 1288 | 420 | 919 | 352 | | Inv. ex. |
| 187 | P6 | 327 | 1286 | 529 | 905 | 348 | | Inv. ex. |
| 188 | P7 | 323 | 1280 | 480 | 915 | 373 | | Inv. ex. |
| 189 | P8 | 254 | 1240 | 617 | 909 | 356 | | Inv. ex. |
| 190 | P9 | 441 | 1276 | 690 | 907 | 360 | | Inv. ex. |
| 191 | P10 | 283 | 1286 | 586 | 924 | 347 | | Inv. ex. |
| 192 | P11 | 369 | 1267 | 684 | 906 | 375 | | Inv. ex. |
| 193 | P12 | 417 | 1266 | 630 | 887 | 350 | | Inv. ex. |
| 194 | Q1 | 393 | 1274 | 679 | 887 | 355 | | Inv. ex. |
| 195 | Q2 | 388 | 1245 | 590 | 896 | 354 | | Inv. ex. |
| 196 | Q3 | 305 | 1301 | 615 | 914 | 351 | | Inv. ex. |
| 197 | Q4 | 305 | 1283 | 414 | 897 | 358 | | Inv. ex. |
| 198 | Q5 | 360 | 1275 | 559 | 899 | 349 | | Inv. ex. |
| 199 | Q6 | 251 | 1288 | 686 | 922 | 357 | | Inv. ex. |
| 200 | Q7 | 299 | 1255 | 458 | 922 | 362 | | Inv. ex. |
| 201 | Q8 | 250 | 1297 | 498 | 897 | 366 | | Inv. ex. |
| 202 | Q9 | 359 | 1293 | 472 | 931 | 348 | | Inv. ex. |
| 203 | Q10 | 367 | 1302 | 419 | 906 | 344 | | Inv. ex. |
| 204 | Q11 | 335 | 1259 | 466 | 921 | 348 | | Inv. ex. |
| 205 | Q12 | 334 | 1249 | 696 | 906 | 342 | | Inv. ex. |
| 206 | R1 | 328 | 1273 | 492 | 888 | 359 | | Inv. ex. |
| 207 | R2 | 292 | 1248 | 545 | 905 | 366 | | Inv. ex. |
| 208 | R3 | 369 | 1248 | 584 | 921 | 348 | | Inv. ex. |
| 209 | R4 | 364 | 1267 | 482 | 907 | 349 | | Inv. ex. |
| 210 | R5 | 336 | 1246 | 691 | 909 | 355 | | Inv. ex. |
| 211 | R6 | 432 | 1242 | 601 | 910 | 372 | | Inv. ex. |
| 212 | R7 | 267 | 1267 | 508 | 917 | 368 | | Inv. ex. |
| 213 | R8 | 331 | 1232 | 526 | 919 | 346 | | Inv. ex. |
| 214 | S1 | 337 | 1274 | 602 | 916 | 355 | | Inv. ex. |
| 215 | S2 | 304 | 1256 | 554 | 910 | 357 | | Inv. ex. |
| 216 | S3 | 441 | 1249 | 443 | 913 | 372 | | Inv. ex. |
| 217 | S4 | 387 | 1274 | 451 | 920 | 376 | | Inv. ex. |
| 218 | S5 | 394 | 1235 | 514 | 901 | 353 | | Inv. ex. |
| 219 | S6 | 258 | 1275 | 706 | 902 | 347 | | Inv. ex. |
| 220 | S7 | 301 | 1264 | 685 | 925 | 359 | | Inv. ex. |
| 221 | S8 | 407 | 1240 | 466 | 895 | 378 | | Inv. ex. |
| 222 | T1 | 285 | 1256 | 530 | 907 | 374 | | Inv. ex. |
| 223 | T2 | 402 | 1277 | 673 | 897 | 348 | | Inv. ex. |
| 224 | T3 | 366 | 1247 | 490 | 897 | 365 | | Inv. ex. |
| 225 | T4 | 444 | 1258 | 543 | 911 | 348 | | Inv. ex. |
| 226 | T5 | 402 | 1265 | 462 | 922 | 376 | | Inv. ex. |
| 227 | T6 | 284 | 1273 | 627 | 921 | 367 | | Inv. ex. |
| 228 | T7 | 291 | 1266 | 495 | 913 | 352 | | Inv. ex. |
| 229 | T8 | 316 | 1247 | 464 | 912 | 369 | | Inv. ex. |
| 230 | U1 | 333 | 1253 | 452 | 900 | 373 | | Inv. ex. |
| 231 | U2 | 335 | 1277 | 547 | 919 | 373 | | Inv. ex. |
| 232 | U3 | 439 | 1250 | 428 | 910 | 379 | | Inv. ex. |

TABLE 2-continued

| Test no. | Steel | Hot rolling step: Coiling temp. ° C. | Preheating step: Heating temp. ° C. | Preheating step: Average cooling temp. down to less than 350° C. ° C./s | Hot stamping step: Heating temp. ° C. | Hot stamping step: Holding times | Others | Remarks |
|---|---|---|---|---|---|---|---|---|
| 233 | U4 | 289 | 1276 | 581 | 903 | 343 | | Inv. ex. |
| 234 | U5 | 431 | 1269 | 620 | 897 | 356 | | Inv. ex. |
| 235 | U6 | 349 | 1282 | 517 | 924 | 346 | | Inv. ex. |
| 236 | U7 | 266 | 1241 | 644 | 912 | 359 | | Inv. ex. |
| 237 | U8 | 304 | 1264 | 520 | 909 | 368 | | Inv. ex. |
| 238 | V1 | 432 | 1272 | 645 | 920 | 370 | | Inv. ex. |
| 239 | V2 | 266 | 1273 | 580 | 900 | 365 | | Inv. ex. |
| 240 | V3 | 406 | 1239 | 545 | 901 | 350 | | Inv. ex. |
| 241 | V4 | 323 | 1275 | 438 | 906 | 344 | | Inv. ex. |
| 242 | V5 | 431 | 1263 | 408 | 920 | 349 | | Inv. ex. |
| 243 | V6 | 438 | 1275 | 469 | 922 | 359 | | Inv. ex. |
| 244 | V7 | 373 | 1263 | 683 | 888 | 369 | | Inv. ex. |
| 245 | V8 | 381 | 1238 | 563 | 888 | 357 | | Inv. ex. |
| 246 | W1 | 395 | 1274 | 619 | 913 | 346 | | Inv. ex. |
| 247 | W2 | 388 | 1270 | 512 | 923 | 348 | | Inv. ex. |
| 248 | W3 | 303 | 1289 | 451 | 912 | 357 | | Inv. ex. |
| 249 | W4 | 433 | 1266 | 653 | 898 | 354 | | Inv. ex. |
| 250 | W5 | 320 | 1243 | 510 | 904 | 377 | | Inv. ex. |
| 251 | W6 | 409 | 1274 | 699 | 906 | 357 | | Inv. ex. |
| 252 | W7 | 385 | 1257 | 694 | 918 | 378 | | Inv. ex. |
| 253 | W8 | 268 | 1269 | 698 | 887 | 354 | | Inv. ex. |
| 254 | X1 | 422 | 1258 | 629 | 903 | 368 | | Inv. ex. |
| 255 | X2 | 285 | 1228 | 468 | 918 | 375 | | Inv. ex. |
| 256 | X3 | 252 | 1282 | 508 | 904 | 360 | | Inv. ex. |
| 257 | Y1 | 345 | 1237 | 546 | 907 | 361 | | Inv. ex. |
| 258 | Y2 | 381 | 1264 | 475 | 919 | 354 | | Inv. ex. |
| 259 | Y3 | 417 | 1238 | 596 | 890 | 366 | | Inv. ex. |
| 260 | Y4 | 270 | 1231 | 657 | 901 | 346 | | Inv. ex. |
| 261 | Y5 | 382 | 1236 | 504 | 910 | 354 | | Inv. ex. |
| 262 | Y6 | 386 | 1301 | 466 | 923 | 347 | | Inv. ex. |
| 263 | Y7 | 375 | 1255 | 595 | 919 | 356 | | Inv. ex. |
| 264 | Y8 | 357 | 1253 | 690 | 902 | 366 | | Inv. ex. |
| 265 | Y9 | 260 | 1277 | 436 | 906 | 346 | | Inv. ex. |
| 266 | Y10 | 352 | 1278 | 553 | 905 | 368 | | Inv. ex. |
| 267 | Z1 | 346 | 1293 | 697 | 909 | 367 | | Inv. ex. |
| 268 | Z2 | 296 | 1240 | 697 | 912 | 373 | | Inv. ex. |
| 269 | Z3 | 320 | 1273 | 586 | 920 | 362 | | Inv. ex. |
| 270 | Z4 | 284 | 1277 | 510 | 919 | 373 | | Inv. ex. |
| 271 | Z5 | 316 | 1288 | 553 | 915 | 355 | | Inv. ex. |
| 272 | Z6 | 348 | 1230 | 421 | 893 | 361 | | Inv. ex. |
| 273 | Z7 | 285 | 1264 | 512 | 894 | 356 | | Inv. ex. |
| 274 | Z8 | 368 | 1256 | 678 | 910 | 370 | | Inv. ex. |
| 275 | Z9 | 392 | 1270 | 436 | 923 | 354 | | Inv. ex. |
| 276 | Z10 | 394 | 1233 | 681 | 934 | 371 | | Inv. ex. |
| 277 | AA1 | 391 | 1273 | 416 | 906 | 371 | | Inv. ex. |
| 278 | AA2 | 365 | 1248 | 563 | 905 | 371 | | Inv. ex. |
| 279 | AA3 | 337 | 1262 | 453 | 898 | 369 | | Inv. ex. |
| 280 | AA4 | 337 | 1276 | 542 | 929 | 359 | | Inv. ex. |
| 281 | AA5 | 386 | 1248 | 589 | 934 | 358 | | Inv. ex. |
| 282 | AA6 | 355 | 1297 | 686 | 910 | 369 | | Inv. ex. |
| 283 | AA7 | 266 | 1299 | 441 | 908 | 347 | | Inv. ex. |
| 284 | AA8 | 340 | 1257 | 677 | 913 | 365 | | Inv. ex. |
| 285 | AA9 | 326 | 1257 | 527 | 897 | 364 | | Inv. ex. |
| 286 | AA10 | 303 | 1242 | 527 | 923 | 343 | | Inv. ex. |
| 287 | BB1 | 292 | 1231 | 434 | 888 | 356 | | Inv. ex. |
| 288 | BB2 | 328 | 1257 | 480 | 923 | 356 | | Inv. ex. |
| 289 | BB3 | 367 | 1288 | 656 | 900 | 355 | | Inv. ex. |
| 290 | BB4 | 369 | 1257 | 523 | 905 | 352 | | Inv. ex. |
| 291 | BB5 | 417 | 1273 | 563 | 911 | 371 | | Inv. ex. |
| 292 | BB6 | 424 | 1267 | 696 | 898 | 371 | | Inv. ex. |
| 293 | BB7 | 401 | 1277 | 506 | 923 | 348 | | Inv. ex. |
| 294 | BB8 | 294 | 1248 | 594 | 916 | 365 | | Inv. ex. |
| 295 | BB9 | 422 | 1290 | 471 | 910 | 374 | | Inv. ex. |
| 296 | BB10 | 321 | 1284 | 492 | 908 | 359 | | Inv. ex. |
| 297 | CC1 | 440 | 1251 | 560 | 917 | 350 | | Inv. ex. |
| 298 | CC2 | 266 | 1253 | 499 | 915 | 367 | | Inv. ex. |
| 299 | CC3 | 374 | 1251 | 486 | 923 | 364 | | Inv. ex. |
| 300 | CC4 | 306 | 1285 | 558 | 898 | 357 | | Inv. ex. |
| 301 | CC5 | 260 | 1253 | 464 | 910 | 350 | | Inv. ex. |
| 302 | CC6 | 438 | 1239 | 674 | 922 | 355 | | Inv. ex. |
| 303 | CC7 | 391 | 1253 | 584 | 918 | 346 | | Inv. ex. |

TABLE 2-continued

| Test no. | Steel | Hot rolling step: Coiling temp. ° C. | Preheating step: Heating temp. ° C. | Preheating step: Average cooling temp. down to less than 350° C. ° C./s | Hot stamping step: Heating temp. ° C. | Hot stamping step: Holding times | Others | Remarks |
|---|---|---|---|---|---|---|---|---|
| 304 | CC8 | 418 | 1266 | 463 | 907 | 362 | | Inv. ex. |
| 305 | CC9 | 347 | 1256 | 628 | 892 | 375 | | Inv. ex. |
| 306 | CC10 | 360 | 1245 | 541 | 924 | 365 | | Inv. ex. |
| 307 | DD1 | 309 | 1288 | 699 | 929 | 367 | | Inv. ex. |
| 308 | DD2 | 383 | 1284 | 622 | 925 | 377 | | Inv. ex. |
| 309 | DD3 | 338 | 1246 | 674 | 910 | 342 | | Inv. ex. |
| 310 | DD4 | 420 | 1244 | 680 | 917 | 349 | | Inv. ex. |
| 311 | DD5 | 296 | 1273 | 508 | 908 | 374 | | Inv. ex. |
| 312 | DD6 | 275 | 1284 | 590 | 916 | 359 | | Inv. ex. |
| 313 | DD7 | 251 | 1260 | 673 | 904 | 369 | | Inv. ex. |
| 314 | DD8 | 264 | 1291 | 429 | 910 | 367 | | Inv. ex. |
| 315 | DD9 | 321 | 1239 | 409 | 896 | 351 | | Inv. ex. |
| 316 | DD10 | 303 | 1256 | 442 | 910 | 368 | | Inv. ex. |
| 317 | FF1 | 296 | 1260 | 518 | 908 | 370 | | Inv. ex. |
| 318 | FF2 | 270 | 1284 | 590 | 907 | 366 | | Inv. ex. |
| 319 | FF3 | 251 | 1235 | 673 | 922 | 361 | | Inv. ex. |
| 320 | GG1 | 261 | 1304 | 429 | 910 | 374 | | Inv. ex. |
| 321 | GG2 | 315 | 1215 | 409 | 896 | 348 | | Inv. ex. |
| 322 | GG3 | 297 | 1231 | 442 | 919 | 375 | | Inv. ex. |
| 323 | EE1 | 335 | 1274 | 680 | 934 | 348 | | Inv. ex. |
| 324 | EE2 | 392 | 1229 | 415 | 918 | 357 | | Inv. ex. |
| 325 | EE3 | 345 | 1253 | 663 | 902 | 363 | | Inv. ex. |
| 326 | EE4 | 392 | 1289 | 550 | 913 | 352 | | Inv. ex. |
| 327 | EE5 | 374 | 1266 | 705 | 895 | 362 | | Inv. ex. |
| 328 | EE6 | 280 | 1258 | 613 | 915 | 358 | | Inv. ex. |
| 329 | EE7 | 351 | 1256 | 513 | 889 | 377 | | Inv. ex. |
| 330 | EE8 | 277 | 1278 | 448 | 895 | 364 | | Inv. ex. |
| 331 | EE6 | 327 | 1283 | 655 | 911 | 364 | | Inv. ex. |
| 332 | EE6 | 328 | 1271 | 470 | 909 | 356 | | Inv. ex. |
| 333 | EE6 | 354 | 1243 | 555 | 893 | 364 | | Inv. ex. |
| 334 | EE6 | 347 | 1261 | 571 | 913 | 375 | | Inv. ex. |
| 335 | EE6 | 420 | 1241 | 703 | 892 | 350 | | Inv. ex. |
| 336 | EE6 | 460 | 1254 | 422 | 910 | 376 | | Comp. ex. |
| 337 | EE6 | 260 | 1237 | 423 | 924 | 366 | Softening heat treatment | Inv. ex. |
| 338 | EE6 | 260 | 1303 | 561 | 909 | 346 | Softening heat treatment | Inv. ex. |
| 339 | EE6 | 422 | 1303 | 481 | 887 | 367 | Softening heat treatment | Inv. ex. |
| 340 | EE6 | 342 | 1278 | 562 | 907 | 349 | No cold rolling | Inv. ex. |
| 341 | EE6 | 345 | 1276 | 556 | 893 | 357 | Annealing | Inv. ex. |
| 342 | EE6 | 372 | 1255 | 524 | 918 | 366 | Al-plating | Inv. ex. |
| 343 | EE6 | 349 | 1270 | 578 | 905 | 369 | Al—Zn plating | Inv. ex. |
| 344 | EE6 | 401 | 1257 | 696 | 917 | 364 | Al—Si plating | Inv. ex. |
| 345 | EE6 | 445 | 1252 | 552 | 933 | 346 | Hot dip galvanization | Inv. ex. |
| 346 | EE6 | 320 | 1303 | 480 | 917 | 362 | Electrogalvanization | Inv. ex. |
| 347 | EE6 | 319 | 1270 | 529 | 897 | 352 | Hot dip galvannealing | Inv. ex. |
| 348 | EE6 | 313 | 1275 | 670 | 925 | 342 | Zn—Ni plating | Inv. ex. |
| 349 | EE6 | 307 | 1275 | 676 | 915 | 372 | Al—Mg—Zn-based plating | Inv. ex. |
| 350 | EE6 | 319 | 1268 | 450 | 905 | 356 | Temper rolling | Inv. ex. |
| 351 | EE6 | 399 | 1160 | 611 | 915 | 355 | | Comp. ex. |
| 352 | EE6 | 341 | 1232 | 657 | 923 | 370 | | Inv. ex. |
| 353 | EE6 | 380 | 1263 | 658 | 922 | 378 | | Inv. ex. |
| 354 | EE6 | 396 | 1280 | 645 | 919 | 345 | | Inv. ex. |
| 355 | EE6 | 312 | 1307 | 422 | 904 | 365 | | Inv. ex. |
| 356 | EE6 | 430 | 1390 | 679 | 888 | 357 | | Inv. ex. |
| 357 | EE6 | 445 | 1300 | 6 | 914 | 362 | | Comp. ex. |
| 358 | EE6 | 418 | 1258 | 12 | 925 | 379 | | Inv. ex. |
| 359 | EE6 | 444 | 1236 | 54 | 906 | 357 | | Inv. ex. |
| 360 | EE6 | 291 | 1258 | 110 | 889 | 363 | | Inv. ex. |
| 361 | EE6 | 315 | 1263 | 230 | 897 | 354 | | Inv. ex. |
| 362 | EE6 | 277 | 1266 | 509 | 920 | 374 | | Inv. ex. |
| 363 | EE6 | 295 | 1229 | 1031 | 901 | 359 | | Inv. ex. |
| 364 | EE6 | 304 | 1262 | 530 | 744 | 374 | | Comp. ex. |
| 365 | EE6 | 261 | 1266 | 669 | 812 | 357 | | Inv. ex. |
| 366 | EE6 | 386 | 1266 | 398 | 824 | 374 | | Inv. ex. |
| 367 | EE6 | 333 | 1285 | 524 | 832 | 375 | | Inv. ex. |
| 368 | EE6 | 356 | 1266 | 653 | 845 | 362 | | Inv. ex. |
| 369 | EE6 | 284 | 1280 | 508 | 868 | 344 | | Inv. ex. |
| 370 | EE6 | 421 | 1303 | 606 | 870 | 354 | | Inv. ex. |
| 371 | EE6 | 356 | 1287 | 496 | 897 | 363 | | Inv. ex. |
| 372 | EE6 | 310 | 1282 | 605 | 913 | 359 | | Inv. ex. |
| 373 | EE6 | 273 | 1282 | 511 | 922 | 354 | | Inv. ex. |
| 374 | EE6 | 287 | 1251 | 547 | 927 | 364 | | Inv. ex. |

TABLE 2-continued

| Test no. | Steel | Hot rolling step: Coiling temp. ° C. | Preheating step: Heating temp. ° C. | Preheating step: Average cooling temp. down to less than 350° C. ° C./s | Hot stamping step: Heating temp. ° C. | Hot stamping step: Holding times | Others | Remarks |
|---|---|---|---|---|---|---|---|---|
| 375 | EE6 | 380 | 1290 | 474 | 943 | 350 | | Inv. ex. |
| 376 | EE6 | 285 | 1290 | 573 | 971 | 374 | | Inv. ex. |
| 377 | EE6 | 433 | 1245 | 432 | 986 | 357 | | Inv. ex. |
| 378 | EE6 | 316 | 1262 | 685 | 1021 | 352 | | Comp. ex. |
| 379 | EE6 | 298 | 1279 | 463 | 925 | 48 | | Comp. ex. |
| 380 | EE6 | 276 | 1258 | 488 | 906 | 64 | | Inv. ex. |
| 381 | EE6 | 258 | 1247 | 679 | 916 | 86 | | Inv. ex. |
| 382 | EE6 | 335 | 1268 | 692 | 901 | 101 | | Inv. ex. |
| 383 | EE6 | 267 | 1271 | 434 | 912 | 144 | | Inv. ex. |
| 384 | EE6 | 312 | 1250 | 619 | 906 | 201 | | Inv. ex. |
| 385 | EE6 | 394 | 1287 | 503 | 900 | 243 | | Inv. ex. |
| 386 | EE6 | 401 | 1267 | 662 | 917 | 294 | | Inv. ex. |
| 387 | EE6 | 441 | 1263 | 613 | 893 | 340 | | Inv. ex. |
| 388 | EE6 | 261 | 1264 | 434 | 920 | 375 | | Inv. ex. |
| 389 | EE6 | 255 | 1248 | 405 | 888 | 392 | | Inv. ex. |
| 390 | EE6 | 341 | 1269 | 572 | 921 | 444 | | Inv. ex. |
| 391 | EE6 | 298 | 1244 | 483 | 918 | 492 | | Inv. ex. |
| 392 | EE6 | 391 | 1249 | 665 | 918 | 538 | | Inv. ex. |
| 393 | EE6 | 387 | 1258 | 540 | 905 | 571 | | Inv. ex. |
| 394 | EE6 | 259 | 1289 | 444 | 929 | 589 | | Inv. ex. |
| 395 | EE6 | 276 | 1252 | 456 | 931 | 637 | | Comp. ex. |
| 396 | EE6 | 438 | 1264 | 491 | 916 | 352 | Gas combustion atmosphere (air-fuel ratio 0.80) | Inv. ex. |
| 397 | EE6 | 324 | 1268 | 692 | 924 | 365 | Gas combustion atmosphere (air-fuel ratio 0.85) | Inv. ex. |
| 398 | EE6 | 407 | 1273 | 428 | 917 | 370 | Gas combustion atmosphere (air-fuel ratio 1.1) | Inv. ex. |
| 399 | EE6 | 258 | 1265 | 486 | 909 | 348 | Air | Inv. ex. |
| 400 | EE6 | 312 | 1256 | 622 | 897 | 368 | Nitrogen gas (dew point − 30° C. ) | Inv. ex. |
| 401 | EE6 | 349 | 1256 | 583 | 905 | 374 | Nitrogen gas (dew point0° C. ) | Inv. ex. |
| 402 | EE6 | 274 | 1266 | 576 | 919 | 362 | Nitrogen gas (dew point + 10° C. ) | Inv. ex. |
| 403 | EE6 | 419 | 1234 | 532 | 911 | 365 | Ohmic heating | Inv. ex. |
| 404 | EE6 | 405 | 1236 | 535 | 892 | 347 | Tempering temp. 152° C. | Inv. ex. |
| 405 | EE6 | 318 | 1246 | 692 | 910 | 350 | Tempering temp. 170° C. | Inv. ex. |
| 406 | EE6 | 352 | 1240 | 636 | 907 | 348 | Tempering temp. 201° C. | Inv. ex. |
| 407 | EE6 | 347 | 1286 | 462 | 920 | 353 | Tempering temp. 341° C. | Inv. ex. |
| 408 | EE6 | 291 | 1269 | 572 | 906 | 374 | Tempering temp. 433° C. | Inv. ex. |
| 409 | EE6 | 382 | 1245 | 613 | 904 | 370 | Tempering temp. 521° C. | Inv. ex. |
| 410 | EE6 | 286 | 1252 | 607 | 910 | 379 | Tempering temp. 591° C. | Inv. ex. |
| 411 | EE6 | 363 | 1256 | 705 | 910 | 351 | Partial softening treatment | Inv. ex. |

Underlines indicate production conditions not preferable.

The properties of the obtained hot stamped body were measured and evaluated by the following methods:

[Tensile Strength (TS)]

The tensile strength (TS) of the hot stamped body was obtained from any position of the hot stamped body by preparing a No. 5 test piece and conducting a tensile test based on JIS Z 2241: 2011. The crosshead speed was 1 mm/min.

[Hydrogen Embrittlement Resistance]

The hydrogen embrittlement resistance of the hot stamped body was evaluated as follows by the slow strain rate technique (SSRT). First, a 1.0 t×9.0 W×120 L (mm) test piece was prepared. The test piece was made one of a parallel part length of 20 mm and a diameter of the parallel part of 2.0 mm. At the two sides of the center of the parallel part, U-notches each having a notch depth of 0.35 mm and a notch bottom radius of 0.1 mm were provided. This test piece was dipped in a 3% NaCl solution. Hydrogen was charged using a galvanostat as a power source and controlling the current density of a dipping portion of the test piece surface to become 0.1 mA/cm$^2$. Next, the test piece charged with hydrogen was subjected to a slow strain rate test by a tensile rate of 0.0060 mm/min and the load at the time of fracture was investigated. Samples of the same test nos. were similarly tested three times. Cases where the average value of three measurements of the fracture load in a hydrogen environment was 500 MPa or more were evaluated as passing and cases where the fracture load was less than 500 MPa were evaluated as failing.

Cases where the tensile strength was 2200 MPa or more and the hydrogen embrittlement resistance was evaluated as passing were evaluated as a hot stamped body which is high in strength and able to suppress hydrogen embrittlement. The area ratio of the hard structures in Table 3 means the total of the area ratios of the martensite, bainite, and tempered martensite. Further, the balance of the structures other than the hard structures was comprised of ferrite, retained austenite, and/or pearlite. While not shown in Table 3, the average sizes of the prior austenite grains were measured, whereupon the average sizes of the prior austenite grains of the hot stamped bodies in the invention examples in Table 3 were all 8 μm or less.

TABLE 3

| Test no. | Steel | Area ratio of hard structures % | Segregation amount of prior γ grain boundaries: Mo segregation amount atm % | W segregation amount atm % | Total segregation amount atm % | Covering | Tensile strength MPa | Hydrogen embrittlement resistance | Remarks |
|---|---|---|---|---|---|---|---|---|---|
| 1 | A1 | 99 | 0.13 | | 0.13 | None | 2108 | Good | Comp. ex. |
| 2 | A2 | 96 | 0.14 | | 0.14 | None | 2296 | Good | Inv. ex. |
| 3 | A3 | 93 | 0.14 | | 0.14 | None | 2347 | Good | Inv. ex. |
| 4 | A4 | 97 | 0.14 | | 0.14 | None | 2326 | Good | Inv. ex. |
| 5 | A5 | 96 | 0.13 | | 0.13 | None | 2348 | Good | Inv. ex. |
| 6 | A6 | 99 | 0.13 | | 0.13 | None | 2472 | Good | Inv. ex. |
| 7 | A7 | 95 | 0.14 | | 0.14 | None | 2416 | Good | Inv. ex. |
| 8 | A8 | 97 | 0.14 | | 0.14 | None | 2470 | Good | Inv. ex. |
| 9 | A9 | 94 | 0.14 | | 0.14 | None | 2616 | Good | Inv. ex. |
| 10 | A10 | 99 | 0.13 | | 0.13 | None | 2802 | Good | Inv. ex. |
| 11 | A11 | 98 | 0.13 | | 0.13 | None | 2911 | Good | Inv. ex. |
| 12 | A12 | 99 | 0.13 | | 0.13 | None | 3004 | Good | Inv. ex. |
| 13 | A13 | 98 | 0.14 | | 0.14 | None | 3075 | Good | Inv. ex. |
| 14 | A14 | 98 | 0.14 | | 0.14 | None | 3305 | Poor | Comp. ex. |
| 15 | B1 | 99 | 0.13 | | 0.13 | None | 2251 | Good | Inv. ex. |
| 16 | B2 | 99 | 0.14 | | 0.14 | None | 2264 | Good | Inv. ex. |
| 17 | B3 | 97 | 0.13 | | 0.13 | None | 2235 | Good | Inv. ex. |
| 18 | B4 | 98 | 0.14 | | 0.14 | None | 2230 | Good | Inv. ex. |
| 19 | B5 | 98 | 0.14 | | 0.14 | None | 2340 | Good | Inv. ex. |
| 20 | B6 | 100 | 0.14 | | 0.14 | None | 2344 | Good | Inv. ex. |
| 21 | B7 | 98 | 0.13 | | 0.13 | None | 2394 | Good | Inv. ex. |
| 22 | B8 | 96 | 0.13 | | 0.13 | None | 2448 | Good | Inv. ex. |
| 23 | B9 | 97 | 0.14 | | 0.14 | None | 2468 | Good | Inv. ex |
| 24 | B10 | 96 | 0.14 | | 0.14 | None | 2490 | Good | Inv. ex. |
| 25 | B11 | 92 | 0.14 | | 0.14 | None | 2233 | Good | Inv. ex. |
| 26 | B12 | 91 | 0.14 | | 0.14 | None | 2290 | Good | Inv. ex. |
| 27 | B13 | 85 | 0.13 | | 0.13 | None | 2338 | Good | Inv. ex. |
| 28 | B14 | 75 | 0.14 | | 0.14 | None | 2234 | Good | Inv. ex. |
| 29 | B15 | 73 | 0.13 | | 0.13 | None | 2107 | Good | Comp. ex. |
| 30 | C1 | 94 | 0.14 | | 0.14 | None | 2347 | Good | Inv. ex. |
| 31 | C2 | 97 | 0.14 | | 0.14 | None | 2412 | Good | Inv. ex. |
| 32 | C3 | 99 | 0.13 | | 0.13 | None | 2365 | Good | Inv. ex. |
| 33 | C4 | 96 | 0.13 | | 0.13 | None | 2325 | Good | Inv. ex. |
| 34 | C5 | 98 | 0.13 | | 0.13 | None | 2329 | Good | Inv. ex. |
| 35 | C6 | 99 | 0.13 | | 0.13 | None | 2427 | Good | Inv. ex. |
| 36 | C7 | 98 | 0.14 | | 0.14 | None | 2536 | Good | Inv. ex. |
| 37 | C8 | 96 | 0.13 | | 0.13 | None | 2468 | Good | Inv. ex. |
| 38 | C9 | 98 | 0.14 | | 0.14 | None | 2499 | Good | Inv. ex. |
| 39 | C10 | 97 | 0.14 | | 0.14 | None | 2410 | Good | Inv. ex. |
| 40 | C11 | 98 | 0.14 | | 0.14 | None | 2433 | Good | Inv. ex |
| 41 | C12 | 95 | 0.13 | | 0.13 | None | 2522 | Good | Inv. ex. |
| 42 | C13 | 98 | 0.13 | | 0.13 | None | 2451 | Good | Inv. ex. |
| 43 | C14 | 94 | 0.13 | | 0.13 | None | 2475 | Poor | Comp. ex. |
| 44 | D1 | 95 | 0.14 | | 0.14 | None | 2398 | Good | Inv. ex. |
| 45 | D2 | 95 | 0.13 | | 0.13 | None | 2414 | Good | Inv. ex |
| 46 | D3 | 96 | 0.14 | | 0.14 | None | 2426 | Good | Inv. ex. |
| 47 | D4 | 100 | 0.14 | | 0.14 | None | 2502 | Good | Inv. ex. |
| 48 | D5 | 92 | 0.14 | | 0.14 | None | 2422 | Good | Inv. ex. |
| 49 | D6 | 98 | 0.14 | | 0.14 | None | 2458 | Good | Inv. ex. |
| 50 | D7 | 97 | 0.13 | | 0.13 | None | 2341 | Good | Inv. ex. |
| 51 | D8 | 93 | 0.14 | | 0.14 | None | 2341 | Good | Inv. ex. |
| 52 | D9 | 98 | 0.13 | | 0.13 | None | 2410 | Poor | Comp. ex. |
| 53 | E1 | 96 | 0.14 | | 0.14 | None | 2367 | Good | Inv. ex. |
| 54 | E2 | 97 | 0.14 | | 0.14 | None | 2346 | Good | Inv. ex. |
| 55 | E3 | 94 | 0.13 | | 0.13 | None | 2515 | Good | Inv. ex. |
| 56 | E4 | 99 | 0.13 | | 0.13 | None | 2376 | Good | Inv. ex. |
| 57 | E5 | 95 | 0.13 | | 0.13 | None | 2467 | Good | Inv. ex |
| 58 | E6 | 96 | 0.14 | | 0.14 | None | 2410 | Good | Inv. ex. |
| 59 | E7 | 94 | 0.13 | | 0.13 | None | 2460 | Good | Inv. ex. |
| 60 | E8 | 98 | 0.13 | | 0.13 | None | 2446 | Good | Inv. ex. |
| 61 | E9 | 96 | 0.14 | | 0.14 | None | 2365 | Poor | Comp. ex. |
| 62 | F1 | 95 | 0.14 | | 0.14 | None | 2375 | Good | Inv. ex. |
| 63 | F2 | 97 | 0.14 | | 0.14 | None | 2359 | Good | Inv. ex. |
| 64 | F3 | 97 | 0.14 | | 0.14 | None | 2303 | Good | Inv. ex. |
| 65 | F4 | 97 | 0.13 | | 0.13 | None | 2407 | Good | Inv. ex. |
| 66 | F5 | 96 | 0.13 | | 0.13 | None | 2474 | Good | Inv. ex. |
| 67 | F6 | 94 | 0.13 | | 0.13 | None | 2358 | Good | Inv. ex. |
| 68 | F7 | 96 | 0.14 | | 0.14 | None | 2399 | Good | Inv. ex. |
| 69 | F8 | 97 | 0.13 | | 0.13 | None | 2344 | Good | Inv. ex. |
| 70 | F9 | 100 | 0.14 | | 0.14 | None | 2436 | Poor | Comp. ex. |
| 71 | G1 | 100 | 0.14 | | 0.14 | None | 2412 | Good | Inv. ex. |
| 72 | G2 | 95 | 0.13 | | 0.13 | None | 2434 | Good | Inv. ex. |

TABLE 3-continued

| Test no. | Steel | Area ratio of hard structures % | Segregation amount of prior γ grain boundaries: Mo segregation amount atm % | W segregation amount atm % | Total segregation amount atm % | Covering | Tensile strength MPa | Hydrogen embrittlement resistance | Remarks |
|---|---|---|---|---|---|---|---|---|---|
| 73 | G3 | 97 | 0.13 | | 0.13 | None | 2335 | Good | Inv. ex. |
| 74 | G4 | 98 | 0.13 | | 0.13 | None | 2465 | Good | Inv. ex |
| 75 | G5 | 95 | 0.14 | | 0.14 | None | 2329 | Good | Inv. ex. |
| 76 | G6 | 96 | 0.14 | | 0.14 | None | 2328 | Good | Inv. ex. |
| 77 | G7 | 95 | 0.13 | | 0.13 | None | 2418 | Good | Inv. ex. |
| 78 | G8 | 96 | 0.14 | | 0.14 | None | 2489 | Poor | Comp. ex. |
| 79 | H1 | 99 | 0.14 | | 0.14 | None | 2396 | Poor | Comp. ex. |
| 80 | H2 | 92 | 0.13 | | 0.13 | None | 2409 | Good | Inv. ex. |
| 81 | H3 | 96 | 0.14 | | 0.14 | None | 2515 | Good | Inv. ex. |
| 82 | H4 | 93 | 0.13 | | 0.13 | None | 2510 | Good | Inv. ex. |
| 83 | H5 | 97 | 0.14 | | 0.14 | None | 2421 | Good | Inv. ex. |
| 84 | H6 | 95 | 0.14 | | 0.14 | None | 2285 | Good | Inv. ex. |
| 85 | H7 | 97 | 0.14 | | 0.14 | None | 2352 | Good | Inv. ex. |
| 86 | H8 | 97 | 0.13 | | 0.13 | None | 2354 | Good | Inv. ex. |
| 87 | H9 | 94 | 0.14 | | 0.14 | None | 2475 | Good | Inv. ex. |
| 88 | H10 | 96 | 0.13 | | 0.13 | None | 2354 | Good | Inv. ex. |
| 89 | H11 | 94 | 0.14 | | 0.14 | None | 2437 | Good | Inv. ex. |
| 90 | H12 | 95 | 0.13 | | 0.13 | None | 2329 | Good | Inv. ex. |
| 91 | H13 | 95 | 0.13 | | 0.13 | None | 2292 | Good | Inv. ex. |
| 92 | H14 | 100 | 0.14 | | 0.14 | None | 2347 | Poor | Comp. ex. |
| 93 | I1 | 97 | 0.13 | | 0.13 | None | 2072 | Good | Comp. ex. |
| 94 | I2 | 98 | 0.13 | | 0.13 | None | 2240 | Good | Inv. ex. |
| 95 | I3 | 100 | 0.14 | | 0.14 | None | 2280 | Good | Inv. ex. |
| 96 | I4 | 93 | 0.14 | | 0.14 | None | 2272 | Good | Inv. ex. |
| 97 | I5 | 95 | 0.14 | | 0.14 | None | 2350 | Good | Inv. ex. |
| 98 | I6 | 92 | 0.13 | | 0.13 | None | 2441 | Good | Inv. ex. |
| 99 | I7 | 97 | 0.13 | | 0.13 | None | 2438 | Good | Inv. ex. |
| 100 | I8 | 94 | 0.13 | | 0.13 | None | 2364 | Good | Inv. ex. |
| 101 | I9 | 93 | 0.13 | | 0.13 | None | 2421 | Good | Inv. ex. |
| 102 | I10 | 98 | 0.13 | | 0.13 | None | 2434 | Good | Inv. ex. |
| 103 | I11 | 97 | 0.13 | | 0.13 | None | 2422 | Good | Inv. ex. |
| 104 | I12 | 93 | 0.14 | | 0.14 | None | 2466 | Good | Inv. ex. |
| 105 | I13 | 95 | 0.14 | | 0.14 | None | 2356 | Good | Inv. ex. |
| 106 | I14 | 97 | 0.14 | | 0.14 | None | 2435 | Poor | Comp. ex. |
| 107 | J1 | 98 | 0.13 | | 0.13 | None | 1925 | Good | Comp. ex. |
| 108 | J2 | 96 | 0.13 | | 0.13 | None | 2208 | Good | Inv. ex. |
| 109 | J3 | 97 | 0.13 | | 0.13 | None | 2326 | Good | Inv. ex. |
| 110 | J4 | 97 | 0.14 | | 0.14 | None | 2308 | Good | Inv. ex. |
| 111 | J5 | 98 | 0.13 | | 0.13 | None | 2459 | Good | Inv. ex. |
| 112 | J6 | 97 | 0.13 | | 0.13 | None | 2286 | Good | Inv. ex. |
| 113 | J7 | 97 | 0.14 | | 0.14 | None | 2465 | Good | Inv. ex. |
| 114 | J8 | 93 | 0.13 | | 0.13 | None | 2292 | Good | Inv. ex. |
| 115 | J9 | 97 | 0.14 | | 0.14 | None | 2521 | Good | Inv. ex. |
| 116 | J10 | 96 | 0.13 | | 0.13 | None | 2420 | Good | Inv. ex. |
| 117 | J11 | 97 | 0.13 | | 0.13 | None | 2436 | Good | Inv. ex. |
| 118 | J12 | 95 | 0.13 | | 0.13 | None | 2498 | Poor | Comp. ex. |
| 119 | K1 | 95 | 0.14 | | 0.14 | None | 2232 | Good | Inv. ex. |
| 120 | K2 | 96 | 0.13 | | 0.13 | None | 2251 | Good | Inv. ex. |
| 121 | K3 | 98 | 0.14 | | 0.14 | None | 2290 | Good | Inv. ex. |
| 122 | K4 | 95 | 0.13 | | 0.13 | None | 2317 | Good | Inv. ex. |
| 123 | K5 | 98 | 0.13 | | 0.13 | None | 2257 | Good | Inv. ex |
| 124 | K6 | 95 | 0.14 | | 0.14 | None | 2275 | Good | Inv. ex. |
| 125 | K7 | 94 | 0.14 | | 0.14 | None | 2446 | Good | Inv. ex. |
| 126 | K8 | 96 | 0.13 | | 0.13 | None | 2483 | Good | Inv. ex. |
| 127 | K9 | 99 | 0.13 | | 0.13 | None | 2383 | Good | Inv. ex. |
| 128 | K10 | 96 | 0.13 | | 0.13 | None | 2449 | Good | Inv. ex. |
| 129 | K11 | 94 | 0.13 | | 0.13 | None | 2410 | Good | Inv. ex. |
| 130 | K12 | 96 | 0.14 | | 0.14 | None | 2401 | Good | Inv. ex. |
| 131 | K13 | 97 | 0.14 | | 0.14 | None | 2409 | Good | Inv. ex. |
| 132 | K14 | 97 | 0.14 | | 0.14 | None | 2468 | Poor | Comp. ex. |
| 133 | L1 | 95 | 0.05 | | 0.05 | None | 2472 | Poor | Comp. ex. |
| 134 | L2 | 96 | 0.11 | | 0.11 | None | 2498 | Good | Inv. ex. |
| 135 | L3 | 98 | 0.14 | | 0.14 | None | 2460 | Good | Inv. ex. |
| 136 | L4 | 96 | 0.14 | | 0.14 | None | 2452 | Good | Inv. ex. |
| 137 | L5 | 96 | 0.14 | | 0.14 | None | 2308 | Good | Inv. ex. |
| 138 | L6 | 97 | 0.16 | | 0.16 | None | 2503 | Good | Inv. ex. |
| 139 | L7 | 94 | 0.19 | | 0.19 | None | 2393 | Good | Inv. ex. |
| 140 | L8 | 99 | 0.15 | | 0.15 | None | 2383 | Good | Inv. ex. |
| 141 | L9 | 97 | 0.21 | | 0.21 | None | 2393 | Good | Inv. ex. |
| 142 | L10 | 93 | 0.13 | | 0.13 | None | 2445 | Good | Inv. ex. |
| 143 | L11 | 98 | 0.13 | | 0.13 | None | 2402 | Good | Inv. ex. |
| 144 | L12 | 98 | 0.11 | | 0.11 | None | 2412 | Good | Inv. ex. |

TABLE 3-continued

| Test no. | Steel | Area ratio of hard structures % | Segregation amount of prior γ grain boundaries: Mo segregation amount atm % | W segregation amount atm % | Total segregation amount atm % | Covering | Tensile strength MPa | Hydrogen embrittlement resistance | Remarks |
|---|---|---|---|---|---|---|---|---|---|
| 145 | L13 | 95 | 0.03 | | 0.03 | None | 2397 | Poor | Comp. ex. |
| 146 | M1 | 96 | 0.14 | | 0.14 | None | 2098 | Good | Comp. ex. |
| 147 | M2 | 99 | 0.13 | | 0.13 | None | 2250 | Good | Inv. ex. |
| 148 | M3 | 96 | 0.14 | | 0.14 | None | 2323 | Good | Inv. ex. |
| 149 | M4 | 98 | 0.13 | | 0.13 | None | 2399 | Good | Inv. ex. |
| 150 | M5 | 98 | 0.14 | | 0.14 | None | 2399 | Good | Inv. ex. |
| 151 | M6 | 93 | 0.13 | | 0.13 | None | 2400 | Good | Inv. ex. |
| 152 | M7 | 95 | 0.13 | | 0.13 | None | 2408 | Good | Inv. ex. |
| 153 | M8 | 97 | 0.14 | | 0.14 | None | 2350 | Good | Inv. ex. |
| 154 | M9 | 93 | 0.14 | | 0.14 | None | 2436 | Good | Inv. ex. |
| 155 | M10 | 93 | 0.13 | | 0.13 | None | 2405 | Good | Inv. ex. |
| 156 | M11 | 92 | 0.14 | | 0.14 | None | 2390 | Poor | Comp. ex. |
| 157 | N1 | 96 | 0.13 | | 0.13 | None | 2726 | Good | Inv. ex. |
| 158 | N2 | 98 | 0.13 | | 0.13 | None | 2949 | Good | Inv. ex. |
| 159 | N3 | 96 | 0.14 | | 0.14 | None | 2686 | Good | Inv. ex. |
| 160 | N4 | 95 | 0.13 | | 0.13 | None | 2712 | Good | Inv. ex. |
| 161 | N5 | 97 | 0.14 | | 0.14 | None | 2625 | Good | Inv. ex. |
| 162 | N6 | 95 | 0.14 | | 0.14 | None | 2705 | Good | Inv. ex. |
| 163 | N7 | 95 | 0.14 | | 0.14 | None | 2906 | Good | Inv. ex. |
| 164 | N8 | 95 | 0.14 | | 0.14 | None | 2477 | Good | Inv. ex. |
| 165 | N9 | 93 | 0.13 | | 0.13 | None | 2819 | Good | Inv. ex. |
| 166 | N10 | 98 | 0.13 | | 0.13 | None | 2910 | Good | Inv. ex. |
| 167 | N11 | 97 | 0.14 | | 0.14 | None | 2495 | Good | Inv. ex. |
| 168 | N12 | 99 | 0.13 | | 0.13 | None | 2805 | Good | Inv. ex. |
| 169 | N13 | 97 | 0.13 | | 0.13 | None | 2600 | Good | Inv. ex. |
| 170 | O1 | 92 | 0.14 | | 0.14 | None | 2936 | Good | Inv. ex. |
| 171 | O2 | 96 | 0.14 | | 0.14 | None | 2880 | Good | Inv. ex. |
| 172 | O3 | 94 | 0.13 | | 0.13 | None | 2766 | Good | Inv. ex. |
| 173 | O4 | 95 | 0.13 | | 0.13 | None | 2793 | Good | Inv. ex. |
| 174 | O5 | 100 | 0.14 | | 0.14 | None | 2863 | Good | Inv. ex. |
| 175 | O6 | 94 | 0.14 | | 0.14 | None | 2516 | Good | Inv. ex. |
| 176 | O7 | 94 | 0.13 | | 0.13 | None | 2810 | Good | Inv. ex. |
| 177 | O8 | 95 | 0.13 | | 0.13 | None | 2467 | Good | Inv. ex. |
| 178 | O9 | 97 | 0.13 | | 0.13 | None | 2655 | Good | Inv. ex. |
| 179 | O10 | 99 | 0.13 | | 0.13 | None | 2680 | Good | Inv. ex. |
| 180 | O11 | 93 | 0.14 | | 0.14 | None | 2953 | Good | Inv. ex. |
| 181 | O12 | 94 | 0.14 | | 0.14 | None | 2687 | Good | Inv. ex. |
| 182 | P1 | 94 | 0.13 | | 0.13 | None | 2709 | Good | Inv. ex. |
| 183 | P2 | 98 | 0.13 | | 0.13 | None | 2812 | Good | Inv. ex. |
| 184 | P3 | 98 | 0.13 | | 0.13 | None | 2684 | Good | Inv. ex. |
| 185 | P4 | 96 | 0.14 | | 0.14 | None | 2518 | Good | Inv. ex. |
| 186 | P5 | 92 | 0.14 | | 0.14 | None | 2581 | Good | Inv. ex. |
| 187 | P6 | 99 | 0.13 | | 0.13 | None | 2822 | Good | Inv. ex. |
| 188 | P7 | 98 | 0.14 | | 0.14 | None | 2551 | Good | Inv. ex. |
| 189 | P8 | 97 | 0.14 | | 0.14 | None | 2455 | Good | Inv. ex. |
| 190 | P9 | 96 | 0.14 | | 0.14 | None | 2761 | Good | Inv. ex. |
| 191 | P10 | 96 | 0.14 | | 0.14 | None | 2770 | Good | Inv. ex. |
| 192 | P11 | 98 | 0.14 | | 0.14 | None | 2556 | Good | Inv. ex. |
| 193 | P12 | 98 | 0.13 | | 0.13 | None | 2536 | Good | Inv. ex. |
| 194 | Q1 | 96 | 0.14 | | 0.14 | None | 2842 | Good | Inv. ex. |
| 195 | Q2 | 95 | 0.14 | | 0.14 | None | 2883 | Good | Inv. ex. |
| 196 | Q3 | 97 | 0.14 | | 0.14 | None | 2593 | Good | Inv. ex. |
| 197 | Q4 | 96 | 0.13 | | 0.13 | None | 2793 | Good | Inv. ex. |
| 198 | Q5 | 93 | 0.14 | | 0.14 | None | 2621 | Good | Inv. ex. |
| 199 | Q6 | 93 | 0.14 | | 0.14 | None | 2846 | Good | Inv. ex. |
| 200 | Q7 | 94 | 0.14 | | 0.14 | None | 2484 | Good | Inv. ex. |
| 201 | Q8 | 97 | 0.13 | | 0.13 | None | 2599 | Good | Inv. ex. |
| 202 | Q9 | 94 | 0.13 | | 0.13 | None | 2887 | Good | Inv. ex. |
| 203 | Q10 | 98 | 0.13 | | 0.13 | None | 2782 | Good | Inv. ex. |
| 204 | Q11 | 97 | 0.13 | | 0.13 | None | 2877 | Good | Inv. ex. |
| 205 | Q12 | 99 | 0.13 | | 0.13 | None | 2543 | Good | Inv. ex. |
| 206 | R1 | 98 | 0.14 | | 0.14 | None | 2284 | Good | Inv. ex. |
| 207 | R2 | 97 | 0.14 | | 0.14 | None | 2402 | Good | Inv. ex. |
| 208 | R3 | 96 | 0.14 | | 0.14 | None | 2440 | Good | Inv. ex. |
| 209 | R4 | 94 | 0.13 | | 0.13 | None | 2404 | Good | Inv. ex. |
| 210 | R5 | 94 | 0.13 | | 0.13 | None | 2384 | Good | Inv. ex. |
| 211 | R6 | 97 | 0.14 | | 0.14 | None | 2409 | Good | Inv. ex. |
| 212 | R7 | 94 | 0.14 | | 0.14 | None | 2512 | Good | Inv. ex. |
| 213 | R8 | 96 | 0.13 | | 0.13 | None | 2398 | Good | Inv. ex. |
| 214 | S1 | 93 | 0.13 | | 0.13 | None | 2491 | Good | Inv. ex. |
| 215 | S2 | 95 | 0.14 | | 0.14 | None | 2462 | Good | Inv. ex. |
| 216 | S3 | 97 | 0.14 | | 0.14 | None | 2403 | Good | Inv. ex. |

TABLE 3-continued

| Test no. | Steel | Area ratio of hard structures % | Segregation amount of prior γ grain boundaries: Mo segregation amount atm % | W segregation amount atm % | Total segregation amount atm % | Covering | Tensile strength MPa | Hydrogen embrittlement resistance | Remarks |
|---|---|---|---|---|---|---|---|---|---|
| 217 | S4 | 96 | 0.13 | | 0.13 | None | 2412 | Good | Inv. ex. |
| 218 | S5 | 93 | 0.13 | | 0.13 | None | 2472 | Good | Inv. ex. |
| 219 | S6 | 97 | 0.14 | | 0.14 | None | 2299 | Good | Inv. ex. |
| 220 | S7 | 96 | 0.14 | | 0.14 | None | 2465 | Good | Inv. ex. |
| 221 | S8 | 95 | 0.13 | | 0.13 | None | 2483 | Good | Inv. ex. |
| 222 | T1 | 93 | 0.13 | | 0.13 | None | 2383 | Good | Inv. ex. |
| 223 | T2 | 95 | 0.13 | | 0.13 | None | 2411 | Good | Inv. ex. |
| 224 | T3 | 96 | 0.14 | | 0.14 | None | 2358 | Good | Inv. ex. |
| 225 | T4 | 97 | 0.14 | | 0.14 | None | 2475 | Good | Inv. ex. |
| 226 | T5 | 98 | 0.14 | | 0.14 | None | 2357 | Good | Inv. ex. |
| 227 | T6 | 96 | 0.13 | | 0.13 | None | 2509 | Good | Inv. ex. |
| 228 | T7 | 95 | 0.13 | | 0.13 | None | 2489 | Good | Inv. ex. |
| 229 | T8 | 93 | 0.14 | | 0.14 | None | 2316 | Good | Inv. ex. |
| 230 | U1 | 94 | 0.14 | | 0.14 | None | 2538 | Good | Inv. ex. |
| 231 | U2 | 97 | 0.13 | | 0.13 | None | 2373 | Good | Inv. ex. |
| 232 | U3 | 94 | 0.13 | | 0.13 | None | 2541 | Good | Inv. ex. |
| 233 | U4 | 96 | 0.13 | | 0.13 | None | 2510 | Good | Inv. ex. |
| 234 | U5 | 95 | 0.14 | | 0.14 | None | 2406 | Good | Inv. ex. |
| 235 | U6 | 94 | 0.13 | | 0.13 | None | 2335 | Good | Inv. ex. |
| 236 | U7 | 94 | 0.14 | | 0.14 | None | 2322 | Good | Inv. ex. |
| 237 | U8 | 100 | 0.13 | | 0.13 | None | 2349 | Good | Inv. ex. |
| 238 | V1 | 95 | 0.13 | | 0.13 | None | 2292 | Good | Inv. ex. |
| 239 | V2 | 99 | 0.14 | | 0.14 | None | 2393 | Good | Inv. ex. |
| 240 | V3 | 97 | 0.14 | | 0.14 | None | 2486 | Good | Inv. ex. |
| 241 | V4 | 95 | 0.14 | | 0.14 | None | 2438 | Good | Inv. ex. |
| 242 | V5 | 99 | 0.13 | | 0.13 | None | 2496 | Good | Inv. ex. |
| 243 | V6 | 94 | 0.14 | | 0.14 | None | 2449 | Good | Inv. ex. |
| 244 | V7 | 93 | 0.14 | | 0.14 | None | 2497 | Good | Inv. ex. |
| 245 | V8 | 96 | 0.14 | | 0.14 | None | 2386 | Good | Inv. ex. |
| 246 | W1 | 96 | 0.14 | | 0.14 | None | 2347 | Good | Inv. ex. |
| 247 | W2 | 99 | 0.14 | | 0.14 | None | 2373 | Good | Inv. ex. |
| 248 | W3 | 94 | 0.13 | | 0.13 | None | 2404 | Good | Inv. ex. |
| 249 | W4 | 92 | 0.14 | | 0.14 | None | 2550 | Good | Inv. ex. |
| 250 | W5 | 99 | 0.13 | | 0.13 | None | 2410 | Good | Inv. ex. |
| 251 | W6 | 98 | 0.13 | | 0.13 | None | 2317 | Good | Inv. ex. |
| 252 | W7 | 95 | 0.14 | | 0.14 | None | 2340 | Good | Inv. ex. |
| 253 | W8 | 97 | 0.13 | | 0.13 | None | 2470 | Good | Inv. ex. |
| 254 | X1 | 95 | 0.13 | | 0.13 | None | 2333 | Good | Inv. ex. |
| 255 | X2 | 98 | 0.13 | | 0.13 | None | 2451 | Good | Inv. ex. |
| 256 | X3 | 96 | 0.13 | | 0.13 | None | 2396 | Good | Inv. ex. |
| 257 | Y1 | 100 | 0.13 | 0.12 | 0.25 | None | 2341 | Good | Inv. ex. |
| 258 | Y2 | 92 | 0.14 | 0.12 | 0.26 | None | 2474 | Good | Inv. ex. |
| 259 | Y3 | 95 | 0.14 | 0.13 | 0.27 | None | 2486 | Good | Inv. ex. |
| 260 | Y4 | 94 | 0.13 | 0.13 | 0.26 | None | 2454 | Good | Inv. ex. |
| 261 | Y5 | 92 | 0.13 | 0.13 | 0.26 | None | 2481 | Good | Inv. ex. |
| 262 | Y6 | 98 | 0.13 | 0.14 | 0.27 | None | 2501 | Good | Inv. ex. |
| 263 | Y7 | 96 | 0.13 | 0.15 | 0.28 | None | 2380 | Good | Inv. ex. |
| 264 | Y8 | 95 | 0.14 | 0.16 | 0.30 | None | 2377 | Good | Inv. ex. |
| 265 | Y9 | 98 | 0.14 | 0.16 | 0.30 | None | 2295 | Good | Inv. ex. |
| 266 | Y10 | 99 | 0.13 | 0.16 | 0.29 | None | 2435 | Good | Inv. ex. |
| 267 | Z1 | 99 | 0.14 | | 0.23 | None | 2413 | Good | Inv. ex. |
| 268 | Z2 | 95 | 0.13 | | 0.22 | None | 2441 | Good | Inv. ex. |
| 269 | Z3 | 97 | 0.13 | | 0.24 | None | 2436 | Good | Inv. ex. |
| 270 | Z4 | 94 | 0.13 | | 0.15 | None | 2526 | Good | Inv. ex. |
| 271 | Z5 | 96 | 0.13 | | 0.21 | None | 2403 | Good | Inv. ex. |
| 272 | Z6 | 99 | 0.14 | | 0.25 | None | 2483 | Good | Inv. ex. |
| 273 | Z7 | 96 | 0.14 | | 0.19 | None | 2391 | Good | Inv. ex. |
| 274 | Z8 | 100 | 0.14 | | 0.25 | None | 2397 | Good | Inv. ex. |
| 275 | Z9 | 96 | 0.14 | | 0.21 | None | 2419 | Good | Inv. ex. |
| 276 | Z10 | 96 | 0.14 | | 0.15 | None | 2328 | Good | Inv. ex. |
| 277 | AA1 | 94 | 0.13 | | 0.25 | None | 2389 | Good | Inv. ex. |
| 278 | AA2 | 99 | 0.14 | | 0.24 | None | 2390 | Good | Inv. ex. |
| 279 | AA3 | 95 | 0.14 | | 0.19 | None | 2438 | Good | Inv. ex. |
| 280 | AA4 | 97 | 0.13 | | 0.23 | None | 2378 | Good | Inv. ex. |
| 281 | AA5 | 99 | 0.13 | | 0.23 | None | 2312 | Good | Inv. ex. |
| 282 | AA6 | 95 | 0.13 | | 0.15 | None | 2395 | Good | Inv. ex. |
| 283 | AA7 | 94 | 0.14 | | 0.16 | None | 2421 | Good | Inv. ex. |
| 284 | AA8 | 97 | 0.13 | | 0.15 | None | 2332 | Good | Inv. ex. |
| 285 | AA9 | 95 | 0.14 | | 0.18 | None | 2383 | Good | Inv. ex. |
| 286 | AA10 | 97 | 0.14 | | 0.21 | None | 2432 | Good | Inv. ex. |
| 287 | BB1 | 95 | 0.13 | | 0.19 | None | 2430 | Good | Inv. ex. |
| 288 | BB2 | 95 | 0.13 | | 0.18 | None | 2436 | Good | Inv. ex. |

TABLE 3-continued

| Test no. | Steel | Area ratio of hard structures % | Segregation amount of prior γ grain boundaries: Mo segregation amount atm % | W segregation amount atm % | Total segregation amount atm % | Covering | Tensile strength MPa | Hydrogen embrittlement resistance | Remarks |
|---|---|---|---|---|---|---|---|---|---|
| 289 | BB3 | 100 | 0.13 | | 0.20 | None | 2347 | Good | Inv. ex. |
| 290 | BB4 | 99 | 0.14 | | 0.15 | None | 2365 | Good | Inv. ex. |
| 291 | BB5 | 99 | 0.14 | | 0.15 | None | 2500 | Good | Inv. ex. |
| 292 | BB6 | 100 | 0.13 | | 0.17 | None | 2430 | Good | Inv. ex. |
| 293 | BB7 | 96 | 0.14 | | 0.23 | None | 2461 | Good | Inv. ex. |
| 294 | BB8 | 98 | 0.14 | | 0.24 | None | 2328 | Good | Inv. ex. |
| 295 | BB9 | 96 | 0.14 | | 0.17 | None | 2528 | Good | Inv. ex. |
| 296 | BB10 | 97 | 0.14 | | 0.20 | None | 2404 | Good | Inv. ex. |
| 297 | CC1 | 95 | 0.14 | | 0.20 | None | 2460 | Good | Inv. ex. |
| 298 | CC2 | 94 | 0.13 | | 0.16 | None | 2352 | Good | Inv. ex. |
| 299 | CC3 | 97 | 0.13 | | 0.19 | None | 2383 | Good | Inv. ex. |
| 300 | CC4 | 96 | 0.14 | | 0.25 | None | 2424 | Good | Inv. ex. |
| 301 | CC5 | 94 | 0.13 | | 0.18 | None | 2462 | Good | Inv. ex. |
| 302 | CC6 | 94 | 0.14 | | 0.23 | None | 2474 | Good | Inv. ex. |
| 303 | CC7 | 97 | 0.13 | | 0.16 | None | 2379 | Good | Inv. ex. |
| 304 | CC8 | 94 | 0.13 | | 0.21 | None | 2410 | Good | Inv. ex. |
| 305 | CC9 | 96 | 0.13 | | 0.18 | None | 2388 | Good | Inv. ex. |
| 306 | CC10 | 95 | 0.14 | | 0.22 | None | 2399 | Good | Inv. ex. |
| 307 | DD1 | 95 | 0.14 | | 0.16 | None | 2428 | Good | Inv. ex. |
| 308 | DD2 | 96 | 0.13 | | 0.20 | None | 2427 | Good | Inv. ex. |
| 309 | DD3 | 96 | 0.14 | | 0.18 | None | 2539 | Good | Inv. ex. |
| 310 | DD4 | 97 | 0.13 | | 0.15 | None | 2462 | Good | Inv. ex. |
| 311 | DD5 | 97 | 0.14 | | 0.20 | None | 2376 | Good | Inv. ex. |
| 312 | DD6 | 96 | 0.14 | | 0.16 | None | 2338 | Good | Inv. ex. |
| 313 | DD7 | 97 | 0.14 | | 0.23 | None | 2371 | Good | Inv. ex. |
| 314 | DD8 | 100 | 0.14 | | 0.21 | None | 2464 | Good | Inv. ex. |
| 315 | DD9 | 100 | 0.14 | | 0.23 | None | 2393 | Good | Inv. ex. |
| 316 | DD10 | 95 | 0.14 | | 0.22 | None | 2394 | Good | Inv. ex. |
| 317 | FF1 | 98 | 0.14 | | 0.14 | None | 2423 | Good | Inv. ex. |
| 318 | FF2 | 96 | 0.14 | | 0.14 | None | 2291 | Good | Inv. ex. |
| 319 | FF3 | 98 | 0.14 | | 0.14 | None | 2394 | Good | Inv. ex. |
| 320 | GG1 | 100 | 0.14 | | 0.14 | None | 2488 | Good | Inv. ex. |
| 321 | GG2 | 100 | 0.14 | | 0.14 | None | 2345 | Good | Inv. ex. |
| 322 | GG3 | 94 | 0.14 | | 0.14 | None | 2346 | Good | Inv. ex. |
| 323 | EE1 | 96 | 0.13 | | 0.13 | None | 2470 | Good | Inv. ex. |
| 324 | EE2 | 92 | 0.14 | | 0.14 | None | 2427 | Good | Inv. ex. |
| 325 | EE3 | 93 | 0.13 | | 0.13 | None | 2441 | Good | Inv. ex. |
| 326 | EE4 | 96 | 0.14 | | 0.14 | None | 2516 | Good | Inv. ex. |
| 327 | EE5 | 97 | 0.14 | | 0.14 | None | 2416 | Good | Inv. ex. |
| 328 | EE6 | 97 | 0.14 | 0.12 | 0.26 | None | 2419 | Good | Inv. ex. |
| 329 | EE7 | 92 | 0.13 | 0.15 | 0.28 | None | 2353 | Good | Inv. ex. |
| 330 | EE8 | 99 | 0.13 | 0.17 | 0.30 | None | 2458 | Good | Inv. ex. |
| 331 | EE6 | 99 | 0.14 | | 0.14 | None | 2452 | Good | Inv. ex. |
| 332 | EE6 | 95 | 0.14 | | 0.14 | None | 2453 | Good | Inv. ex. |
| 333 | EE6 | 94 | 0.14 | | 0.14 | None | 2358 | Good | Inv. ex. |
| 334 | EE6 | 94 | 0.14 | | 0.14 | None | 2420 | Good | Inv. ex. |
| 335 | EE6 | 95 | 0.14 | | 0.14 | None | 2417 | Good | Inv. ex. |
| 336 | EE6 | 99 | 0.08 | | 0.08 | None | 2370 | Poor | Comp. ex. |
| 337 | EE6 | 97 | 0.14 | | 0.14 | None | 2456 | Good | Inv. ex. |
| 338 | EE6 | 96 | 0.13 | | 0.13 | None | 2418 | Good | Inv. ex. |
| 339 | EE6 | 97 | 0.13 | | 0.13 | None | 2511 | Good | Inv. ex. |
| 340 | EE6 | 96 | 0.13 | | 0.13 | None | 2435 | Good | Inv. ex. |
| 341 | EE6 | 94 | 0.13 | | 0.13 | None | 2406 | Good | Inv. ex. |
| 342 | EE6 | 98 | 0.13 | | 0.13 | Fe—Al-based covering | 2441 | Good | Inv. ex. |
| 343 | EE6 | 100 | 0.13 | | 0.13 | Fe—Al-based covering | 2491 | Good | Inv. ex. |
| 344 | EE6 | 93 | 0.13 | | 0.13 | Fe—Al-based covering | 2441 | Good | Inv. ex. |
| 345 | EE6 | 99 | 0.14 | | 0.14 | Fe—Zn-based covering | 2548 | Good | Inv. ex. |
| 346 | EE6 | 96 | 0.14 | | 0.14 | Fe—Zn-based covering | 2446 | Good | Inv. ex. |
| 347 | EE6 | 96 | 0.14 | | 0.14 | Fe—Zn-based covering | 2413 | Good | Inv. ex. |
| 348 | EE6 | 96 | 0.13 | | 0.13 | Fe—Zn—Ni-based covering | 2327 | Good | Inv. ex. |
| 349 | EE6 | 96 | 0.14 | | 0.14 | Fe—Al—Mg—Zn-based covering | 2527 | Good | Inv. ex. |
| 350 | EE6 | 97 | 0.14 | | 0.14 | None | 2362 | Good | Inv. ex. |
| 351 | EE6 | 98 | 0.04 | | 0.04 | None | 2457 | Poor | Comp. ex. |
| 352 | EE6 | 97 | 0.12 | | 0.12 | None | 2377 | Good | Inv. ex. |
| 353 | EE6 | 96 | 0.13 | | 0.13 | None | 2343 | Good | Inv. ex. |
| 354 | EE6 | 100 | 0.13 | | 0.13 | None | 2429 | Good | Inv. ex. |
| 355 | EE6 | 96 | 0.15 | | 0.15 | None | 2421 | Good | Inv. ex. |
| 356 | EE6 | 99 | 0.25 | | 0.25 | None | 2319 | Good | Inv. ex. |
| 357 | EE6 | 99 | 0.08 | | 0.08 | None | 2468 | Poor | Comp. ex. |
| 358 | EE6 | 92 | 0.11 | | 0.11 | None | 2431 | Good | Inv. ex. |
| 359 | EE6 | 94 | 0.14 | | 0.14 | None | 2383 | Good | Inv. ex. |
| 360 | EE6 | 95 | 0.13 | | 0.13 | None | 2407 | Good | Inv. ex. |

TABLE 3-continued

| Test no. | Steel | Area ratio of hard structures % | Segregation amount of prior γ grain boundaries: Mo segregation amount atm % | W segregation amount atm % | Total segregation amount atm % | Covering | Tensile strength MPa | Hydrogen embrittlement resistance | Remarks |
|---|---|---|---|---|---|---|---|---|---|
| 361 | EE6 | 93 | 0.14 | | 0.14 | None | 2353 | Good | Inv. ex. |
| 362 | EE6 | 97 | 0.21 | | 0.21 | None | 2479 | Good | Inv. ex. |
| 363 | EE6 | 98 | 0.25 | | 0.25 | None | 2384 | Good | Inv. ex. |
| 364 | EE6 | 68 | 0.04 | | 0.04 | None | 2057 | Poor | Comp. ex. |
| 365 | EE6 | 91 | 0.13 | | 0.13 | None | 2271 | Good | Inv. ex. |
| 366 | EE6 | 91 | 0.13 | | 0.13 | None | 2300 | Good | Inv. ex. |
| 367 | EE6 | 96 | 0.14 | | 0.14 | None | 2449 | Good | Inv. ex. |
| 368 | EE6 | 96 | 0.13 | | 0.13 | None | 2403 | Good | Inv. ex. |
| 369 | EE6 | 95 | 0.14 | | 0.14 | None | 2313 | Good | Inv. ex. |
| 370 | EE6 | 96 | 0.13 | | 0.13 | None | 2396 | Good | Inv. ex. |
| 371 | EE6 | 98 | 0.13 | | 0.13 | None | 2455 | Good | Inv. ex. |
| 372 | EE6 | 96 | 0.13 | | 0.13 | None | 2393 | Good | Inv. ex. |
| 373 | EE6 | 93 | 0.14 | | 0.14 | None | 2536 | Good | Inv. ex. |
| 374 | EE6 | 97 | 0.13 | | 0.13 | None | 2446 | Good | Inv. ex. |
| 375 | EE6 | 98 | 0.14 | | 0.14 | None | 2361 | Good | Inv. ex. |
| 376 | EE6 | 99 | 0.13 | | 0.13 | None | 2397 | Good | Inv. ex. |
| 377 | EE6 | 96 | 0.13 | | 0.13 | None | 2403 | Good | Inv. ex. |
| 378 | EE6 | 93 | 0.07 | | 0.07 | None | 2330 | Poor | Comp. ex. |
| 379 | EE6 | 100 | 0.06 | | 0.06 | None | 2488 | Poor | Comp. ex. |
| 380 | EE6 | 97 | 0.14 | | 0.14 | None | 2409 | Good | Inv. ex. |
| 381 | EE6 | 97 | 0.14 | | 0.14 | None | 2484 | Good | Inv. ex. |
| 382 | EE6 | 96 | 0.14 | | 0.14 | None | 2370 | Good | Inv. ex. |
| 383 | EE6 | 94 | 0.13 | | 0.13 | None | 2453 | Good | Inv. ex. |
| 384 | EE6 | 98 | 0.13 | | 0.13 | None | 2352 | Good | Inv. ex. |
| 385 | EE6 | 97 | 0.13 | | 0.13 | None | 2377 | Good | Inv. ex. |
| 386 | EE6 | 95 | 0.14 | | 0.14 | None | 2408 | Good | Inv. ex. |
| 387 | EE6 | 96 | 0.14 | | 0.14 | None | 2409 | Good | Inv. ex. |
| 388 | EE6 | 94 | 0.13 | | 0.13 | None | 2425 | Good | Inv. ex. |
| 389 | EE6 | 99 | 0.13 | | 0.13 | None | 2382 | Good | Inv. ex. |
| 390 | EE6 | 94 | 0.14 | | 0.14 | None | 2457 | Good | Inv. ex. |
| 391 | EE6 | 95 | 0.14 | | 0.14 | None | 2428 | Good | Inv. ex. |
| 392 | EE6 | 94 | 0.13 | | 0.13 | None | 2375 | Good | Inv. ex. |
| 393 | EE6 | 95 | 0.13 | | 0.13 | None | 2443 | Good | Inv. ex. |
| 394 | EE6 | 98 | 0.14 | | 0.14 | None | 2422 | Good | Inv. ex. |
| 395 | EE6 | 95 | 0.05 | | 0.05 | None | 2392 | Poor | Comp. ex. |
| 396 | EE6 | 95 | 0.13 | | 0.13 | None | 2483 | Good | Inv. ex. |
| 397 | EE6 | 94 | 0.13 | | 0.13 | None | 2572 | Good | Inv. ex. |
| 398 | EE6 | 92 | 0.13 | | 0.13 | None | 2506 | Good | Inv. ex. |
| 399 | EE6 | 94 | 0.14 | | 0.14 | None | 2499 | Good | Inv. ex. |
| 400 | EE6 | 97 | 0.13 | | 0.13 | None | 2520 | Good | Inv. ex. |
| 401 | EE6 | 97 | 0.13 | | 0.13 | None | 2468 | Good | Inv. ex. |
| 402 | EE6 | 98 | 0.13 | | 0.13 | None | 2547 | Good | Inv. ex. |
| 403 | EE6 | 94 | 0.14 | | 0.14 | None | 2550 | Good | Inv. ex. |
| 404 | EE6 | 93 | 0.14 | | 0.14 | None | 2395 | Good | Inv. ex. |
| 405 | EE6 | 94 | 0.14 | | 0.14 | None | 2394 | Good | Inv. ex. |
| 406 | EE6 | 95 | 0.13 | | 0.13 | None | 2351 | Good | Inv. ex. |
| 407 | EE6 | 95 | 0.13 | | 0.13 | None | 2326 | Good | Inv. ex. |
| 408 | EE6 | 95 | 0.14 | | 0.14 | None | 2269 | Good | Inv. ex. |
| 409 | EE6 | 96 | 0.13 | | 0.13 | None | 2228 | Good | Inv. ex. |
| 410 | EE6 | 94 | 0.14 | | 0.14 | None | 2276 | Good | Inv. ex. |
| 411 | EE6 | 96 | 0.13 | | 0.13 | None | 2423 | Good | Inv. ex. |

Underlines indicate outside scope of present invention or properties not preferable.

Referring to Tables 1 to 3, in Comparative Example 1, the C content was low, therefore the tensile strength fell. In Comparative Example 14, the C content was high, therefore the strength became too high and the hydrogen embrittlement resistance fell. In Comparative Example 29, the Si content was high, therefore the amount of ferrite increased and the tensile strength fell. In Comparative Example 43, the Mn content was high, therefore it is believed the prior austenite grain boundaries become brittle. As a result, the hydrogen embrittlement resistance fell. In Comparative Examples 52, 61, 70, 78, 79, and 92, the respective P, S, N, O, or Al contents were not suitable, therefore the hydrogen embrittlement resistances fell. In Comparative Examples 93, 107, and 146, the respective Nb, Ti, and B contents were low, therefore the strengths could not be sufficiently improved and the tensile strengths fell. In Comparative Examples 106, 118, 132, 145, and 156, the respective Nb, Ti, Cr, Mo, and B contents were high, therefore it is believed coarse carbonitrides, coarse intermetallic compounds, etc., or coarse borides were formed and as a result the hydrogen embrittlement resistances fell. In Comparative Example 133, the Mo content was low, therefore the total amount of segregation of the grain boundary strengthening elements at the prior austenite grain boundaries become lower and the hydrogen embrittlement resistance fell.

In Comparative Example 336, the coiling temperature was high, therefore it is believed the carbides and/or intermetallic compounds of the grain boundary strengthening elements could not be sufficiently refined and, in the following preheating step, the grain boundary strengthening elements could not be made to sufficiently dissolve in the steel sheet. As a result, the total amount of segregation of the grain boundary strengthening elements at the prior austenite grain boundaries became low and the hydrogen embrittlement resistance fell. In Comparative Example 351, the heating temperature at the preheating step was low, therefore it is believed it was not possible to make the grain boundary strengthening elements sufficiently dissolve in the steel sheet. As a result, the total amount of segregation of the grain boundary strengthening elements at the prior austenite grain boundaries became low and the hydrogen embrittlement resistance fell. In Comparative Example 357, the average cooling speed at the preheating step was slow, therefore it is believed the grain boundary strengthening elements dissolved in the steel sheet by preheating precipitated as compounds. As a result the total amount of segregation of the grain boundary strengthening elements at the prior austenite grain boundaries became low and the hydrogen embrittlement resistance fell. In Comparative Example 364, the heating temperature at the hot stamping step was low, therefore it is believed the grain boundary strengthening elements did not sufficiently disperse to the austenite grain boundaries. As a result the total amount of segregation of the grain boundary strengthening elements at the prior austenite grain boundaries became low and the hydrogen embrittlement resistance fell. In Comparative Example 378, the heating temperature at the hot stamping step was high, therefore grain boundary segregation excessively proceeded, the segregated grain boundary strengthening elements precipitated as carbides or intermetallic compounds, and the amount of grain boundary segregation decreased. As a result, the desired total amount of segregation at the grain boundary strengthening elements could not be achieved and the hydrogen embrittlement resistance fell. In Comparative Example 379, the holding time in the hot stamping step was short, therefore it is believed the grain boundary strengthening elements did not sufficiently disperse to the austenite grain boundaries. As a result, the total amount of segregation of the grain boundary strengthening elements at the prior austenite grain boundaries became lower and the hydrogen embrittlement resistance fell. In Comparative Example 395, the holding time in the hot stamping step was long, therefore grain boundary segregation excessively proceeded, the grain boundary segregated grain boundary strengthening elements precipitated as carbides and intermetallic compounds, and the amount of grain boundary segregation decreased. As a result, it was not possible to achieve the desired total amount of segregation at the grain boundary strengthening elements, and the hydrogen embrittlement resistance fell.

In contrast to this, the hot stamped bodies according to all of the invention examples have the predetermined chemical compositions and are controlled to give a total amount of segregation of the grain boundary strengthening elements at the prior austenite grain boundaries, i.e., at least one of Mo, W, Ta, Re, Os, Ir, and Tc, of 0.10 atm % or more, whereby hydrogen embrittlement can be reliably suppressed regardless of having high tensile strengths of 2200 MPa or more.

The invention claimed is:

1. A hot stamped body having a chemical composition comprising, by mass %,

C: 0.40 to 0.70%,
P: 0.100% or less,
S: 0.0100% or less,
N: 0.0200% or less,
O: 0.0200% or less,
Al: 0.0010 to 0.500%,
Nb: 0.0010 to 0.100%,
Ti: 0.010 to 0.200%,
Mo: 0.010 to 2.000%,
B: 0.0005 to 0.0200%,
Si: 0 to 3.00%,
Mn: 0 to 0.48%,
Cr: 0 to 1.00%,
Co: 0 to 4.00%,
Ni: 0 to 3.00%,
Cu: 0 to 3.00%,
V: 0 to 3.00%,
Ca: 0 to 1.000%,
Mg: 0 to 1.000%,
REM: 0 to 1.000%,
Sb: 0 to 1.00%,
Zr: 0 to 1.00%,
Sn: 0 to 1.00%,
As: 0 to 0.100%,
W: 0 to 3.000%,
at least one of Ta, Re, Os, Ir, and Tc: 0 to 1.00% in total,
Se: 0 to 1.00%,
Bi: 0 to 1.00%, and
balance: Fe and impurities, and
wherein a total amount of segregation of one or more of Mo, W, Ta, Re, Os, Ir, and Tc at prior austenite grain boundaries of the hot stamped body is 0.10 atm % or more.

2. The hot stamped body according to claim 1, comprising, by area ratio, at least one of martensite, bainite, and tempered martensite: 70% or more in total.

3. The hot stamped body according to claim 1, wherein the amount of segregation of Mo at the prior austenite grain boundaries is 0.10 atm % or more.

4. The hot stamped body according to claim 1, wherein the amount of segregation of W at the prior austenite grain boundaries is 0.10 atm % or more.

5. The hot stamped body according to claim 1, wherein the total amount of segregation is 0.15 atm % or more.

6. The hot stamped body according to claim 1, having a covering on the surface.

7. The hot stamped body according to claim 6, wherein the covering is mainly comprised of an Fe—Al-based alloy.

8. The hot stamped body according to claim 6, wherein the covering is mainly comprised of an Fe—Zn-based alloy.

9. The hot stamped body according to claim 2, wherein the amount of segregation of Mo at the prior austenite grain boundaries is 0.10 atm % or more.

10. The hot stamped body according to claim 2, wherein the amount of segregation of W at the prior austenite grain boundaries is 0.10 atm % or more.

11. The hot stamped body according to claim 2, wherein the total amount of segregation is 0.15 atm % or more.

12. The hot stamped body according to claim 3, wherein the total amount of segregation is 0.15 atm % or more.

13. The hot stamped body according to claim 4, wherein the total amount of segregation is 0.15 atm % or more.

14. The hot stamped body according to claim 2, having a covering on the surface.

15. The hot stamped body according to claim 3, having a covering on the surface.

16. The hot stamped body according to claim 4, having a covering on the surface.

17. The hot stamped body according to claim 5, having a covering on the surface.

* * * * *